US007026085B2

(12) United States Patent
Yoshino et al.

(10) Patent No.: US 7,026,085 B2
(45) Date of Patent: Apr. 11, 2006

(54) DRY TONER FOR ELECTROSTATIC LATENT IMAGE DEVELOPER, DEVELOPER AND IMAGE FORMING METHOD

(75) Inventors: Susumu Yoshino, Minamiashigara (JP); Motoko Sakai, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 10/669,286

(22) Filed: Sep. 25, 2003

(65) Prior Publication Data

US 2004/0185361 A1 Sep. 23, 2004

(30) Foreign Application Priority Data

Mar. 20, 2003 (JP) ..... 2003-079194
Mar. 20, 2003 (JP) ..... 2003-079195
Mar. 24, 2003 (JP) ..... 2003-079896

(51) Int. Cl.
*G03G 9/00* (2006.01)

(52) U.S. Cl. ..... 430/108.1; 430/124; 430/125

(58) Field of Classification Search ..... 430/108.1, 430/124, 125
See application file for complete search history.

(56) References Cited

FOREIGN PATENT DOCUMENTS

| | | |
|---|---|---|
| JP | 49-65231 | 6/1974 |
| JP | A 56-125751 | 10/1981 |
| JP | A 60-198556 | 10/1985 |
| JP | A 61-123859 | 6/1986 |
| JP | A 61-231562 | 10/1986 |
| JP | A 61-231563 | 10/1986 |
| JP | A 62-267766 | 11/1987 |
| JP | A 1-133065 | 5/1989 |
| JP | A 2-89064 | 3/1990 |
| JP | A 2-100059 | 4/1990 |
| JP | A 2-161466 | 6/1990 |
| JP | A 3-122660 | 5/1991 |
| JP | A 3-229265 | 10/1991 |
| JP | A 3-260659 | 11/1991 |
| JP | A 4-452 | 1/1992 |
| JP | A 4-40471 | 2/1992 |
| JP | A 4-204750 | 7/1992 |
| JP | A 5-66607 | 3/1993 |
| JP | A 5-165250 | 7/1993 |
| JP | A 6-161145 | 6/1994 |
| JP | A 6-208241 | 7/1994 |
| JP | A 7-84398 | 3/1995 |
| JP | A 7-295293 | 11/1995 |
| JP | A 8-160659 | 6/1996 |
| JP | A 8-190221 | 7/1996 |
| JP | A 8-305082 | 11/1996 |
| JP | A 9-325513 | 12/1997 |
| JP | A 10-161342 | 6/1998 |
| JP | A 11-38656 | 2/1999 |
| JP | A 2002-287411 | 10/2002 |

*Primary Examiner*—Mark A. Chapman
(74) *Attorney, Agent, or Firm*—Oliff & Berridge, PLC

(57) ABSTRACT

The invention provides an electrostatic latent image developing dry toner composition that is used for forming images on both sides of a recording material, in which the toner contains calcium compound particles, and the amount W of the calcium compound particles added and the size d of the calcium compound particles meet the requirement of $5<W/d<500$ . . . (1) (W: ratio to the total amount of toner (% by weight), d: volume average particle size (μm)), a developer constituted by the toner composition and a carrier, and an image forming method using the toner composition.

19 Claims, 7 Drawing Sheets

OUTLINE OF FIXATION TEST

OUTLINE OF FIXATION TEST

DRY TONER FOR ELECTROSTATIC LATENT IMAGE DEVELOPER, DEVELOPER AND IMAGE FORMING METHOD

BACKGROUND OF THE INVENTION

1. Field of the Invention

The present invention relates to a toner that is used for development of an electrostatic latent image in an electrophotographic method and an electrostatic recording method, a developer, a production method and an image forming method.

2. Description of the Related Art

Traditionally, a Carson method is generally used when an image is formed in a copier, laser beam printer or the like. In the conventional image forming method, an electrostatic latent image formed on a latent holding member (photosensitive member) is developed with toners containing colorants, a resultant toner image is transferred onto a transferring body (e.g. recording material), and this is fixed by a heat roller or the like to obtain an image, while the latent holding member is cleaned in preparation for forming an electrostatic latent image again. Dry developers for use in this electrophotographic method and the like are classified broadly into single-component developers using solely toners having colorants and the like blended in binder resins, and two-component developers with carriers mixed with the toners. The one-component developer maybe classified into magnetic one-component type in which a latent image is carried to a development carrier (photosensitive member) by a magnetic force using a magnetic powder, and an image is developed, and the nonmagnetic one-component type in which a latent image is carried to a development carrier by charge transfer from a charging roller or the like without using a magnetic powder, and an image is developed.

Since the late-1980s, size reductions and improvements in functions have been increasingly required in the electrophotograph market under the keyword of digitization, and sophisticated printing and high quality close to that of silver salt photography are desired, especially for full color image quality.

Digitization processing is essential as means for achieving high image quality, and effects of such digitization on image quality include a capability of carrying out complicated image processing at a high speed. Consequently, letters and photographic images can be controlled separately, and thus reproducibility of quality of both the letters and images are significantly improved compared with analog techniques. For a photographic image, in particular, digitization makes it possible to perform tone correction and color correction, and is advantageous with respect to tone characteristics, precision, sharpness, color reproducibility and graininess compared to analog techniques. On the other hand, however, for image output, a latent image created in an optical system should be faithfully developed, and for toners, size reductions are being increasingly promoted, and activities aimed at faithful reproducibility are being vigorously pursued. However, it is difficult to achieve high quality with stability by merely reducing the size of the toner, and improvements in basic characteristics in development, transfer and fixing characteristics become more important.

Particularly in color images, color toners of three or four colors are superimposed to form an image. Therefore, if any one of the toners exhibits characteristics different from initial characteristics or a performance different from those of other color toners in terms of development, transfer and fixing, a reduction in color reproducibility and degradation of image quality such as degradation of graininess and color shading will be caused. How the characteristics of each toner are controlled with stability is important for maintaining stable high quality images equivalent to those at the initial stage even as time passes.

Electrophotographic dry developers that have been used for development of an electrostatic latent image formed on an electrophotographic photosensitive layer generally include a one-component developer comprised of a toner obtained by melt-kneading a binder resin constituted by resins such as polystyrene, a styrene-butadiene copolymer, a copolymer of styrene-acryl based monomers, polyester and polyepoxy with a pigment or dye such as carbon black or phthalocyanine blue as a colorant, and crushing the same, or a two-component developer prepared by mixing a toner with particles of glass bead, iron, nickel, ferrite or the like having an average particle size almost equal to that of the toner or 500 μm or smaller, or such a material covered with various kinds of resins as a carrier. In the two-component developer, since the toner is caused to be frictionally charged by stirring the toner and the carrier, the frictional charge amount of the toner can be appropriately controlled by selecting characteristics of the carrier and stirring conditions, and therefore excellent image quality is achieved with high reliability.

However, the above toner and developer alone cannot achieve adequate characteristics such as storage stability (blocking resistance), transportability, developing characteristics, transformability and charge characteristics. Thus, Japanese Patent Laid-Open Publication No. Hei 4-204750, Japanese Patent Laid-Open Publication No. Hei 6-208241, Japanese Patent Laid-Open Publication No. Hei 7-295293 and Japanese Patent Laid-Open Publication No. Hei 8-160659 propose that an additive such as silica or titanium oxide, or an additive prepared by treating its surface with an organic silane compound to impart a hydrophobic nature thereto, or covering the surface with an inorganic oxide, is externally added for the purpose of improving those characteristics. However, these measures bring about some degree of improvements in storage stability (blocking resistance), transportability, developing characteristics, transformability, charge characteristics, but provide no improvement in fixing characteristics. In addition, Japanese Patent Laid-Open Publication No. Hei 8-190221 proposes the use of abrasive particles with a particle size of 0.1 to 10 μm containing calcium carbonate to prevent contamination of the surface of the photosensitive member. In addition, Japanese Patent Laid-Open Publication No. 2002-287411 proposes a toner for a recycle system such that calcium carbonate particles are deposited on the toner to prevent contamination of the surface of the photosensitive member. However, no improvements in fixing characteristics have been found.

On the other hand, Japanese Patent Laid-Open Publication No. Sho 56-125751, Japanese Patent Laid-Open Publication No. Sho 62-267766 and Japanese Patent Publication No. Hei 7-120086 propose methods in which the volume specific resistance of the carrier is controlled to faithfully reproduce a high quality image, specifically halftones, black solids and letters. In these methods, the resistance is adjusted by the type of carrier coating layer and the coating amount, and a desired volume specific resistance can be achieved to form high quality images in the initial stage, but peeling in the carrier coating layer or the like occurs under stress in a developing device, causing the volume specific resistance to vary significantly. Thus, it is difficult to form high quality images over a long period of time.

On the other hand, Japanese Patent Laid-Open Publication No. Hei 4-40471 proposes a method in which carbon black is added in the carrier coating layer to adjust the volume specific resistance.

According to this method, the volume specific resistance can be prevented from being varied due to peeling in the coating layer, but external additives added in the toner or toner constituent components are deposited on the carrier to cause the volume specific resistance to vary, thus making it difficult to form high quality images over a long period of time as in the case of the carrier described above.

In addition, Japanese Patent Laid-Open Publication No. Hei 9-325513 proposes a toner for electrostatic image developer made by depositing on the surfaces of image developing electrostatic toner particles of at least one type of carbonate fine particles selected from a group consisting of calcium carbonate, barium carbonate, strontium and zinc carbonate having a primary average particle size of 0.01 to 0.5 μm and a specific surface area of 25 $m^2/g$ to 200 $m^2/g$ for providing good developed images and maintaining high image quality over a long period of time.

On the other hand, hitherto, monochrome images have been formed when forming images on double sides, and in this case, images in a recording material have high quality if the above described toner is used. In the case of forming color images on double sides, however, since an image is transferred to the first face of the recording material and also to the second face corresponding to the back face of the first face, the recording material should be made to pass through transfer-separation means and fixation means twice, and in this case, charge unevenness may occur in the recording material after the first passage. If a toner image is transferred to the second face with the recording material having charge unevenness in this way, the charge unevenness develops into a large noise to disturb a transfer electric field, and consequently the toner flies off, thus causing a problem such that the medium color becomes unclear, especially in the case of color images.

For achieving offset resistance during fixing, in the toner, it has been proposed that the molecular weight of the binder resin of the toner be controlled, that many types of resins be used in combination, that the viscosity be specified (see, for example, Japanese Patent Laid-Open Publication No. Hei 1-133065, Japanese Patent Laid-Open Publication No. Hei 2-161466, Japanese Patent Laid-Open Publication No. Hei 2-100059 and Japanese Patent Laid-Open Publication No. Hei 3-229265), and that properties such as a glass transition temperature, a melting temperature and a viscoelasticity be specified. In addition, Japanese Patent Publication No. Sho 52-3304 proposes various kinds of waxes such as polyethylene and polypropylene, and partially modified waxes for release agents, Japanese Patent Laid-Open Publication No. Hei 3-260659 and Japanese Patent Laid-Open Publication No. Hei 3-122660 propose that a melting point and a melting viscosity be specified, and Japanese Patent Laid-Open Publication No. Hei 7-84398 and Japanese Patent Laid-Open Publication No. Hei 6-161145 propose that properties such as a dispersion size in the toner and a toner surface exposure ratio be specified. In these propositions, however, offset resistance during fixing can be improved to some extent, but the problem of the toner flying off as a single piece during fixing cannot be solved, resulting in images far from high quality images in which letter images and line images are blurred.

In addition, Japanese Patent Laid-Open Publication No. Hei 8-305082 proposes a resin composition for toners having as a main component a vinyl based copolymer containing at least a low molecular weight polymer component with the maximum value in the molecular weight distribution being in the range of $2\times10^3$ to $4\times10^4$, and a high molecular weight polymer component with the maximum value in the molecular weight distribution being in the range of $3\times10^5$ to $8\times10^6$, and containing 0.1 to 30% by weight of calcium carbonate with the average particle size of 0.1 to 3 μm based on the total amount of resin composition. However, since this resin composition for toners contains a high molecular weight polymer component with the maximum value in the molecular weight distribution being in the range of $3\times10^5$ to $8\times10^6$, the calcium carbonate in the overall resin for toners tends to be unevenly distributed, thus making it difficult to achieve sharpness in charge characteristics, raising the possibility that charge characteristics will become inadequate.

In addition, for cleaning, cleaning characteristics are required such that a residual toner can easily drop off the surface of the photosensitive member, and the photosensitive member is not scratched when the toner is used in combination with cleaning members such as a blade and a web. In order to meet these requirements, various kinds of toners having externally added thereto inorganic fine powders such as silica, organic fine powders such as aliphatic acids, metal salts thereof and derivatives thereof, fluororesin fine powders and the like are proposed so that flowability, durability and cleaning characteristics are improved in dry developers.

In the proposed additives, however, inorganic compounds such as silica, titania and alumina can considerably improve the flowability, but tend to cause the photosensitive member surface layer to be dented and scratched due to hardness of the inorganic compound fine powder, thus raising a problem such that the toner is easily fixed in the scratched area. Furthermore, in recent years, recycled paper has been increasingly used for the sake of conservation of resources, but the recycled paper has a disadvantage that a large amount of paper powder is generated, and the paper powder or the like is trapped between the photosensitive member and the blade, thus causing cleaning defects such as black stripes. In addition, for solving these problems, a fatty acid metal salt is externally added as an additive in Japanese Patent Laid-Open Publication No. Sho 60-198556, and a wax is externally added in Japanese Patent Laid-Open Publication No. Sho 61-231562 and Japanese Patent Laid-Open Publication No. Sho 61-231563. In the methods disclosed in these patent documents, the particle sizes of additives are as large as 3 to 20 μm, and a considerable amount of additive must be added to allow the effect to be exhibited efficiently. In addition, the additive is effective in the initial stage, but cannot form a film uniformly as a lubricant due to filming unique to the additive (lubricant), thus raising a problem such that white dropouts, shading and the like occur in an image.

In addition, Japanese Patent Laid-Open Publication No. Hei 4-452 proposes titanium oxide particles treated with a fatty acid metal salt, Japanese Patent Laid-Open Publication No. Hei 5-66607 proposes titanium oxide particles with the surfaces treated with a fatty acid compound being hydrolyzed in an aqueous system, Japanese Patent Laid-Open Publication No. Hei 5-165250 proposes an inorganic compound with the surface treated with a fatty acid metal salt, and Japanese Patent Laid-Open Publication No. Hei 10-161342 proposes a fine particle titanium oxide endowed with a hydrophobic nature by treating the surface with an aliphatic aluminum. The aliphatic metal is used for the surface treatment to avoid the above described problems originating from the particle size of the fatty acid metal salt itself. In any case, however, these methods are effective to some extent, but cannot sufficiently prevent the surface of the photosensitive member from being scratched.

On the other hand, in Japanese Patent Laid-Open Publication No. Hei 2-89064, a hydrophobic hard fine powder is externally added to the toner, and the photosensitive member is chipped by means of the sanding effect of the hard fine powder to prevent toner filming. However, this method is effective in inhibition of filming, but has a disadvantage of abrading the surface of the photosensitive member, resulting in a considerable reduction in the life of the photosensitive member. At the same time, the cleaning blade is abraded with the hard fine powder, resulting in a considerable reduction in the life of the blade.

In addition, an electrophotographic toner having externally added thereto a total of 0.1 to 3 parts by weight of abrasive particles containing at least calcium carbonate and having a Mohs hardness of 3.5 or greater and a volume-based average particle size of 0.1 to 10 μm, and silica based external additive, based on 100 parts by weight of toner particles, for abrading and removing the surface oxidized layer of the photosensitive member has been proposed (see, for example, Japanese Patent Laid-Open Publication No. Hei 8-190221). In addition, in recent years, an image forming method using a photosensitive member having a hard surface has been proposed (see, for example, Japanese Patent Laid-Open Publication No. Hei 11-38656) However, if image forming is repeated using the photosensitive member having a hard surface, a problem of image flow or other image defects will arise. These image defects result from accumulation of discharge products in electrification of the photosensitive member, or deposition of the toner, paper and the like because the surface of the photosensitive member has a high level of hardness, namely the surface of the photosensitive member is hardly chipped.

The present invention has been made in view of the situation of the conventional technique described above. An advantage of the present invention is to provide an electrostatic latent image dry toner having toner flowability, charge characteristics, developing characteristics, transferability, cleaning characteristics and fixing characteristics at the same time, and capable of being satisfactorily used over a long period of time, an electrostatic latent image developer using the toner, and an image forming method.

In addition, another advantage of the present invention is to provide a toner for electrostatic latent image developer having toner flowability, charge characteristics, developing characteristics, transferability, cleaning characteristics and fixing characteristics at the same time, forming particularly the medium color of color images on both sides of the recording material when images are formed on both sides of the recording material, capable of being satisfactorily used over a long period of time, and having alleviated the problem of collecting a residual toner on a latent image holding member using an electrostatic brush, a toner for electrostatic latent image developer having the alleviated problem of collecting again a residual toner on a latent image holding member after transference in a developing device for electrostatic latent image development, and an electrostatic latent image developer using the same.

In addition, another advantage of the present invention is to provide an image forming method capable of performing development, transference and fixing to satisfy the requirement for high image quality.

SUMMARY OF THE INVENTION

As a result of continuously conducting vigorous studies for achieving the advantages described above, the inventors have found that by using inorganic compound particles in a toner, or by using specified inorganic compound particles in the toner in an image forming method using a photosensitive member having a hard surface, the advantages can be achieved, leading to completion of the present invention.

Specific aspects are as follows.

According to one aspect of the present invention there is provided a dry toner composition for electrostatic latent image developer that is used for forming images on both sides of a recording material, wherein the above described toner contains calcium compound particles, and the amount W of the above described calcium compound particles added and the size of the above described calcium compound particles meet the requirement of $5<W/d<500$ . . . (1) (W: ratio to the total amount of toner (% by weight), d: volume average particle size (μm)).

According to another aspect of the present invention there is provided a dry toner composition for electrostatic latent image developer having as components a binder resin having a molecular distribution Mw/Mn of 3 to 15 and a colorant, wherein the above described toner contains 10 to 60 parts by weight of calcium compound particles based on the total amount of the above described toner.

According to another aspect of the present invention there is provided a developer for electrostatic latent image development constituted by a carrier and a toner composition, wherein the above described carrier has, on a core material, a coat resin layer having a conductive material dispersed in a matrix resin, the above described toner composition is used for forming images on both sides of a recording material, and contains calcium compound particles, and the amount W of the calcium compound particles added and the size d of the calcium compound particles meet the requirement of $5<W/d<500$ . . . (1) (W: ratio to the total amount of toner (% by weight), d: volume average particle size (μm)).

According to another aspect of the present invention there is provided an image forming method for forming an image using an image forming apparatus comprising charge means for charging an electrostatic latent image holding member, latent image processing means for forming an electrostatic latent image on the charged latent image holding member by exposing the same to light, developing means for developing the above described electrostatic latent image using a toner, transfer-separate means for transferring a formed toner image to a recording material to separate the toner image from the latent image holding member being a toner image holding member, and fixation means for contact heat-fixing the transferred toner image on the recording material, wherein the above described toner contains calcium compound particles, and the amount W of the above described calcium compound particles added and the size d of the above described calcium compound particles meet the requirement of $5<W/d<500$ . . . (1) (W: ratio to the total amount of toner (% by weight), d: volume average particle size (μm)), and the surface layer of the above described latent image holding member has charge transport property, and is constituted by a siloxane based resin having a crosslinked structure.

According to another aspect of the present invention there is provided a double side image forming method for forming an image using a double side image forming apparatus comprising charge means for charging an electrostatic latent image holding member, latent image processing means for forming an electrostatic latent image on the charged latent image holding member by exposing the same to light, developing means for developing the above described electrostatic latent image using a toner, transfer-separate means for transferring a formed first toner image to a first face of a recording material to separate the toner image from the latent image holding member being a toner image holding member, and transferring a formed second toner image to a second face of the recording material to separate the toner image from the above described latent image holding member, and fixation means for contact heat-fixing the transferred first and second toner images to the first and second faces of the recording material one after another, wherein the toner for use in the above described image forming method contains calcium compound particles, and the amount W of the above described calcium compound particles added and the size d of the above described calcium compound particles meet the requirement of $5<W/d<500$ . . . (1) (W: ratio to the total amount of toner (% by weight), d: volume average particle size (μm)), and the above described transfer-separate means develops the toner of each color on the above described latent image holding member, transfers the toner to a transferring belt or transferring drum, and then transfers the toner of each color to the first face and the second face of the recording material one at a time [BS1].

DESCRIPTION OF THE PREFERRED EMBODIMENTS

Figure 1:
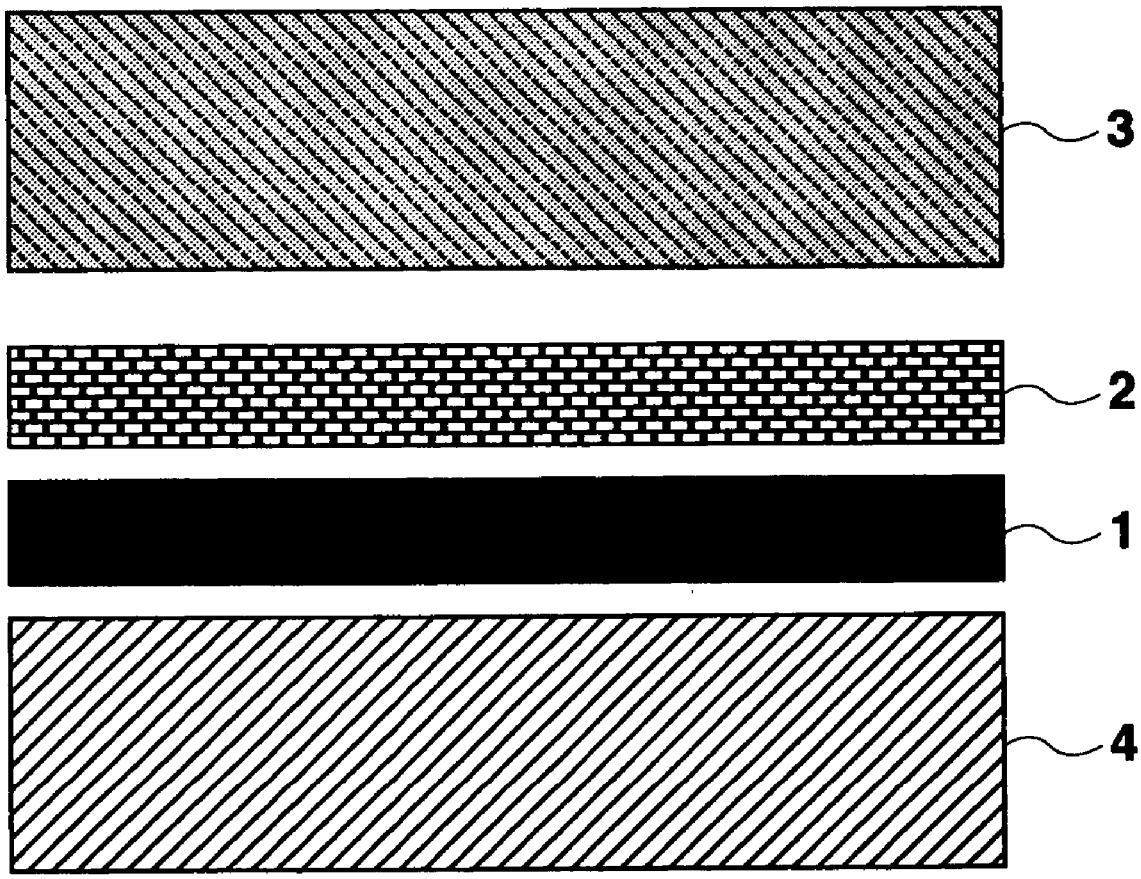
FIG. 1 is an expanded sectional view showing one example of a photosensitive member for use in the present invention.

The preferred embodiment of the present invention will be described below.

[Toner Composition]

Dry Toner Composition for Electrostatic Latent Image Developer for Double-side Copying:

In a dry toner for electrostatic latent image developer that is used for forming images on both sides of a recording material, the toner contains calcium compound particles, and the amount W of the calcium compound particles added and the size d of the calcium compound particles meet the requirement of $5<W/d<500$ . . . (1) (W: ratio to the total amount of toner (% by weight), d: volume average particle size (μm)).

As described previously, additives on the surface of the toner should be very highly controlled in consideration of not only storage stability (blocking resistance), transport property, developing characteristics, transformability and charge characteristics, but also fixing characteristics. The fixing is a stage of fixing toner particles deposited on a transferring material (e.g. recording material), and in the case of color images, toner particles should be not only fixed, but also melted to smooth the surface of an image constituted by a toner and thereby enhances a gloss finish to increase a level of clarity in some cases. The fixing is classified broadly into heat fixing and pressure fixing, but heat fixing is mainly employed because in the case of pressure fixing, size/weight reductions of the apparatus are difficult to achieve in terms of the structure, the occurrence of defects such as scratches originating from a pressure fixing member in a fixed image is hard to prevent, and so on. In addition, the heat fixing includes a flash fixing method of heating a toner without contacting the toner, and a roller fixing or belt fixing method of contact-heating the toner with a heating roller or belt, but the roller fixing or belt fixing method is mainly used because the flash fixing method requires a large amount of electric power.

In the case of the roller fixing or belt fixing, a heated roller or belt contacts the entire recording material (mainly paper) with toner particles deposited thereon so that some level of pressure is applied to the recording material.

When fixing is performed, the roller or belt repeatedly contacts and separates from the recording material and the toner, and not only the roller or belt but also the recording material is charged at the time of fixing. It can be considered that this charging results from the roller or belt contacting and separating from the recording material or toner. For example, if charge unevenness occurs in the recording material after an image is fixed to the first face of the recording material in double side image forming, the toner forming a second toner image is scattered on the recording material when the second toner image is transferred to the back face of the first face of the recording material, namely the second face, thus raising the possibility of irregularities and inconsistency in the image, and unclearness of the medium color becoming prominent, especially when a color image is transferred. Various methods can be considered for preventing such behavior, but it is effective to make an adjustment so that the material deposited on the toner surface has components similar to those of ordinary paper being a main recording material wherever possible.

As a result of conducting vigorous studies, the inventors have found that ordinary paper contains calcium carbonate particles as a bulking agent for enhancing the degree of whiteness of the paper, and since the calcium carbonate particles have a significant influence on charge, the problems in the fixation stage can be alleviated by providing calcium carbonate particles or similar materials on the toner surface. The amount of calcium compound to be added to the toner is determined taking into consideration the volume average size (μm), and preferably satisfies the formula (1) described above. If W/d is equal to or less than 5, the coverage of the toner surface by the calcium compound decreases, and charge with the fixing roll or belt is very inconsistent with charge with the paper as a recording material[BS 2], thus causing inconsistencies in the toner to reduce image quality. On the other hand, if W/d is equal to or greater than 500, the calcium compound adversely affects toner charging. W/d is more preferably greater than 10 and less than 100.

In the present invention, calcium compound particles are added to and mixed with toner particles, and they may be mixed by a well known mixer such as a V-type blender, Henschel mixer or Loedige mixer, for example.

In addition, at this time, various kinds of additives may be added as necessary. These additives include fluidizing agents such as organic particles and inorganic particles, and cleaning aids or transfer aids such as polystyrene fine particles, polymethyl methacrylate fine particles and polyvinylidene fluoride fine particles, which are considered as other well known additives.

In addition, as a method for externally adding additives to the toner, calcium compound particles and the other additives may be added at the same time.

In addition, the toner may be subjected to a screening process after additives are added to and mixed with the toner.

The toner for electrostatic latent image developer for double copying is comprised of a binder resin, a colorant and a release agent, and toner particles having a particle size of 2 to 8 μm may be used for the toner.

In addition, an image of high developing characteristics and transformability and high quality can be obtained by using a toner having an average shape factor SF1 of 100 to 140.

$$SF1=(ML^2/A)\times(\pi/4)\times 100$$

In the above equation, ML is the absolute maximum length of the toner, A is the projector area of the toner, and they are determined as values by analyzing mainly a microscopic image or scanning electron microscopic image using an image analyzing apparatus.

Methods for producing calcium compounds according to the present invention will be described below.

Calcium compounds according to the present invention include calcium carbonate synthesized using as a raw material milk of lime, being a calcium hydroxide aqueous suspension, calcium phosphates such as calcium dihydrogen phosphate, calcium hydrogen phosphate, tricalcium hydrogen phosphate, hydroxylapatite and fluoroapatite, and calcium sulfoaluminate.

For the method for producing calcium carbonate, a method in which carbon dioxide is blown into milk of lime, being an aqueous dispersion of calcium hydroxide, is known (Japanese Patent Publication No. Sho 37-519, Japanese Patent Publication No. Sho 47-22944 and Japanese Patent Publication No. Sho 56-40118).

For production of the calcium phosphate, a method in which α-type tricalcium phosphate was produced, and a hydrospace conversion reaction of a phosphate compound carried out in a system containing an agar or sodium dodecylbenzenesulfonate to produce fine crystal aggregated particles ("Inorganic Phosphorous Chemistry" by Takafumi Kanazawa, p. 168–170), or a method in which milk of lime is made to react with an aqueous phosphoric acid solution while they are grinded together, or while they are mixed and then made to undergo a grinding reaction to produce hydroxyapatite, being a calcium phosphate (Japanese Patent Publication No. Sho 62-4324), is known.

For production of calcium sulfoaluminate, a method in which milk of lime and an aqueous solution of aluminum sulfate are continuously mixed and made to react with each other instantaneously at a temperature of about 40° C. by a mixer of high-speed and high shearing force is known (Japanese Patent Laid-Open Publication No. Sho 53-14692).

In these methods, the crystal particle size, the crystal particle shape, and the like are adjusted by strict temperature control of a reaction system, addition of third substances such as organic and inorganic materials, mechanochemical reactions with grinding and high shearing force in order to improve quality such as dispersibility indicating which grain size of rubbers, plastics, paints, inks and the like is dispersed in a powder bulking agent, and redispersibility indicating how a powder bulking agent is dispersed when the powder bulking agent is obtained by drying a slurry bulking agent in a solvent.

Specific embodiments of methods for producing calcium compounds obtained in the present invention will be described below.

(1) Synthesis of Calcium Carbonate

The method for producing calcium carbonate by blowing carbon dioxide into milk of lime can be classified into two types depending on conditions for carbonation. For normal conditions, the calcium carbonate produced by one type of method is cubic particles known as precipitated calcium carbonate colloidal having an average particle size of 0.1 μm or smaller, and is usually obtained by blowing carbon dioxide into milk of lime with the concentration of calcium hydroxide of 15% or lower to carry out a reaction at a rate of 2.0 L/min. or higher (calculated based on 100% carbon dioxide) per Kg of calcium hydroxide at a combination starting temperature of 25° C. or lower. In addition, the calcium carbonate produced by the other type of method is spindle-shaped particles known as a soft calcium carbonate having an average particle size of 0.5 μm or greater, and is usually obtained with a desired particle size/particle shape by blowing carbon dioxide into milk of lime with the concentration of calcium hydroxide of 15% or higher to carry out a reaction at a rate of 2.0 L/min. or lower (calculated based on 100% carbon dioxide) per Kg of calcium hydroxide at a combination starting temperature of 25° C. or higher.

(2) Synthesis of Calcium Phosphate

Hydroxyapatite being one type of calcium phosphates is usually obtained by a wet combination method in which an aqueous solution of phosphoric acid or a salt thereof is gradually added to milk of lime with the concentration of calcium hydroxide of 4 to 20% by weight while stirring the milk of lime until the Ca/P molar ratio reaches about 1.6 to 1.7 (stoichiometric molar ratio is 1.67).

(3) Synthesis of Calcium Sulfoaluminate

Calcium sulfoaluminate is usually obtained by adding an aqueous aluminum sulfate solution with the concentration of aluminum sulfate of about 5 to 30% by weight to milk of lime with the concentration of calcium hydroxide of about 4 to 20% by weight so that the $CaO/Al_2O_3$ molar ratio reaches 6 to 8 to carry out a reaction.

The average particle size of the calcium compound particles described above maybe set as appropriate depending on the application of a final product, but the primary particle size is usually about 0.005 to 10 μm, preferably 0.005 to 1.0 μm, and most preferably 0.005 to 0.07 μm.

The calcium compound particles are preferably calcium carbonate particles. This is because calcium carbonate is popular as a bulking agent in paper, and is most unlikely to cause a problem in a fixing process.

In addition, a surface treatment may be carried out as necessary. The surface treatment is not specifically limited, but the surface treatment may be a treatment using, for example, a silane coupling agent, titanate coupling agent, aluminate based coupling agent, various silicone oils, a fatty acid, fatty acid metal salt, ester thereof or rosin acid. The silane coupling agent and various silicone oils may be especially suitable for use. The amount of surface treatment is not specifically limited, but it is preferably 2.0 to 30 wt %. If the amount of surface treatment is less than 2.0 wt %, the effect of the surface treatment cannot be achieved, and if the amount is greater than 30 wt %, aggregation of particles occurs.

The method for producing the toner for use in the present invention is not specifically limited, and any well known method may be used as long as it has a shape factor and a particle size within the range specified above.

The toner may be produced by, for example, a kneading-grinding method in which a binder resin, a colorant and a release agent, and a charge control agent and the like, as necessary, are kneaded, grinded and classified, a method in which particles obtained by the kneading-grinding method are changed in shape by a mechanical impact or heat energy, emulsion polymerization aggregation in which polymerizing monomers of the binder resin are emulsion-polymerized, a formed dispersion is mixed with dispersions of a colorant and a release agent and a charge control agent and the like as necessary, and the mixture is aggregated and heat-bonded together to obtain toner particles, suspension polymerization in which polymerizing monomers for obtaining a binder resin, and solutions of a colorant and are lease agent and a charge control agent and the like as necessary are suspended in an aqueous solvent to carry out polymerization, solution suspension in which a binder resin, and solutions of a colorant and a release agent and a charge control agent and the like as necessary are suspended in an aqueous solvent to form particles, and so on. In addition, a production method may be used in which the toner obtained in the method described above is used as a core, and aggregated particles are further deposited and heat-bonded together to provide a core shell structure.

Binder resins that are used may include, for example, homopolymers and copolymers of styrenes such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, and particularly typical binder resins may include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. Furthermore, they may include polyester, polyurethane, epoxy resins, silicone resins, polyamide, modified rosins and paraffin waxes.

In addition, colorants of the toner may include, for example, magnetic powders such as magnetite and ferrite, carbon black, aniline blue, charcoal blue, chrome yellow, ultramarine blue, Dupont oil red, quinoline yellow, methylene blue chloride, phtalocyanine blue, malachite green oxalate, lamp black, rose Bengal, C.I. pigment red 48:1, C.I. pigment red 122, C.I. pigment red 57:1, C.I. pigment yellow 97, C.I. pigment yellow 17, C.I. pigment blue 15:1 and C.I. pigment blue 15:3 as typical colorants.

Release agents may include, for example, low molecular weight polyethylene, low molecular polypropylene, Fisher-Tropsh wax, montan wax, carnauba wax, rice wax and candelilla wax as typical release agents.

In addition, the toner for electrostatic latent image developer of the present invention may contain a charge control agent as necessary. For the charge control agent, a well known substance may be used, as well as azo based metal complex compounds, salicylic acid metal complex compounds, and resin-type charge control agents containing polar groups. In the case where the toner is produced by a wet production method, a material that is difficult to dissolve in water is preferably used in terms of control of ion intensity and reduction of waste water pollution. The toner in the present invention may be any of a magnetic toner containing a magnetic material and a nonmagnetic toner containing no magnetic material. Dry Toner Composition for Electrostatic Latent Image Developer:

Another preferred dry toner composition for electrostatic latent image developer is a dry toner composition for electrostatic latent image developer having as components at least a binder resin with the molecular distribution Mw/Mn of 3 to 15 and a colorant, wherein the toner contains 10 to 60 parts by weight of calcium compound based on the total amount of the toner.

As described previously, the toner should be very highly controlled in consideration of not only transportability, developing characteristics, transformability and charge characteristics, but also fixing characteristics. The fixing is a stage of fixing toner particles deposited on a transferring material (e.g. recording material). The fixing is classified broadly into heat fixing and pressure fixing, but heat fixing is mainly employed because in the case of pressure fixing, size/weight reductions of the apparatus are difficult to achieve in terms of the structure, occurrence of defects such as scratches originating from a pressure fixing member in a fixed image is hard to prevent, and so on. In addition, the heat fixing includes a flash fixing method of heating a toner without contacting the toner, and a roller fixing or belt fixing method of contact-heating the toner with a heating roller or the like, but the roller fixing or belt fixing method is mainly used because the flash fixing method requires a large amount of electric power.

In the case of this roller fixing or belt fixing, a heated roller or belt contacts the entire recording material (mainly paper) with toner particles deposited thereon so that some level of pressure is applied to the recording material. If a contact part is a nip, a part immediately before contact is a pre-nip, and apart immediately after contact is a post-nip, the toner on the transferring material preferably rushes directly into the nip in the resting state in the pre-nip part, and if the toner is moved by some force, irregularities occur in the image.

When fixing is performed, a roller or belt repeatedly contacts and separates from the recording material and the toner, but the roller or belt is charged at the time of fixing. This charging results from the roller or belt contacting and separating from the recording material or the toner, but because the recording material and the toner are constituted by different materials, the roller or belt is charged differently at the part of contact with the transferring material and at the part of contact with the toner. Specifically, for example, when performing fixing, the fixing roller contacts and separates from a part in which the image occupies a large area and a part in which the image occupies a small area, and therefore it is charged differently in the direction of the roller axis. This charge unevenness of the roller becomes significant through continuous copying and continuous printing of the same image, and an electrostatic force to the toner in the pre-nip part can no longer be ignored, and undesirable behavior such as the toner moving to the roller in the pre-nip part occur, resulting in irregularities and inconsistencies in the image. Various methods can be considered for inhibiting such behavior, but it is effective to make an adjustment so that the material deposited on the toner surface has components similar to those of ordinary paper being a main recording material wherever possible.

As a result of conducting vigorous studies, the inventors have found that ordinary paper contains calcium carbonate particles as a bulking agent for enhancing the degree of whiteness of the paper, and since the calcium carbonate particles have a significant influence on charge, the problems in the fixation stage can be alleviated by providing calcium carbonate particles or similar materials in the toner.

The toner for electrostatic latent image developer which may be used is constituted by a binder resin, a colorant and a release agent, and has a size of 2 to 20 μm.

In addition, an image of high developing characteristics and transformability and high quality can be obtained by using a toner having an average shape factor SF1 of 100 to 140.

$$SF1=(ML^2/A)\times(\pi/4)\times 100$$

In the above equation, ML is the absolute maximum length of the toner, A is the projector area of the toner, and they are determined as values by analyzing mainly a microscopic image or scanning electron microscopic image by an image analyzing apparatus.

In the dry toner composition for electrostatic latent image developer of this embodiment, the type of calcium compound and the method for producing the calcium compound are same as those described above, and therefore the description thereof is not presented here.

The average size of the calcium compound particles described above may be set as appropriate depending on the application of a final product, but the primary particle size is usually about 0.005 to 10 μm, preferably 0.02 to 1.0 μm, and most preferably 0.002 to 0.4 μm.

The calcium compound particles are preferably calcium carbonate particles. This is because calcium carbonate is popular as a bulking agent in paper, and is most unlikely to cause a problem in a fixing process. Furthermore, the calcium compound such as calcium carbonate is generally hydrophilic, and is therefore difficult to disperse if it is merely mixed with a resin for toner, and thus it is usually dispersed in the resin for toner by exerting a shear thereon. Thus, for improving dispersibility in the toner and enhancing the mechanical strength as a toner, the calcium compound is preferably subjected to a surface treatment for imparting a hydrophobic nature. The surface treatment for imparting a hydrophobic nature may be, but is not limited to, a treatment using as a surface treating compound, for example, a silane coupling agent, titanate coupling agent, aluminate based coupling agent, various silicone oils, a fatty acid, fatty acid metal salt, ester thereof or rosin acid. The aliphatic acid and the rosin acid may be especially suitable for use.

In addition, for the amount of surface treatment, the amount of the surface treating compound described above is, but is not limited to, 0.1 to 30 wt %, preferably 0.2 to 20 wt %, and more preferably 0.2 to 5 wt % based on the weight of calcium compound particles. If the amount of surface treating compound is less than 0.1 wt %, the effect of the surface treatment cannot be achieved, and on the other hand, if the amount is greater than 30 wt %, aggregation of particles occurs.

One example of the method of surface treatment for imparting a hydrophobic nature to calcium compound particles is a method in which a treating agent is added to calcium compound particles dispersed in a solution, then the solution is removed, and the residue is dried by heating, or a method in which calcium compound particles are sprayed (suspended) in air, and a treating agent or a treating agent diluted with a solvent is sprayed into the air, which is heated at the same time.

The amount of calcium compound particles added is 10 to 60 wt %, more preferably 15 to 50 wt % based on the total amount of toner. If the amount is less than 10 wt %, the effect of adding calcium compound particles is not sufficiently achieved, and if the amount is greater than 60 wt %, the mechanical strength as a toner is reduced and thus the toner is easily broken by stirring in a developing machine to adversely affect developing characteristics, and consequently calcium compound particles themselves may separate from the toner, causing the photosensitive member to be contaminated.

The method for producing the toner for use in the present invention is not specifically limited, and any well known method may be used as long as it has a shape factor and a particle size within the range specified above.

The toner may be produced by, for example, a kneading-grinding method in which a binder resin, a colorant and a release agent, and a charge control agent and the like, as necessary, are kneaded, grinded and classified, a method in which particles obtained by the kneading-grinding method are changed in shape by a mechanical impact or heat energy, and the like. In addition, a production method may be used in which the toner obtained in the method described above is used as a core, and aggregated particles are further deposited and heat-bonded together to provide a core shell structure.

In the toner for use in the present invention, addition of the above internal additives to the inside of toner particles by the kneading-grinding method is performed through kneading processing. The kneading in this case may be carried out-using various kinds of heating kneaders. For the heating kneader, a three roller type, a uniaxial screw type, a biaxial screw type and a Banbury mixer type are known.

For the method for producing a toner with the shape factor of the toner controlled to be a specified value, which is used in the present invention, any method may be used. For controlling the shape factor, in the production process, a system for grinding the above kneaded material such as a collision plate type or jet type is selected. The system in which the toner is collided against some object, like the collision type system, is called a surface grinding type, and includes, for example, Microanalyzer, Ulmax and Jet-o-Miser. Furthermore, the system in which toners are collided against each other is called a volume grinding type, and includes KTM (Krypton) and Turbo Mill. Furthermore, the volume grinding type includes a volume/surface grinding type I model Jet-Mill in which a collision plate is provided in the volume grinding type system to have characteristics of both types. Generally, the grinded material tends to have an indeterminate shape in the volume grinding type, while the ground material tends to have a round shape in the surface grinding type. In addition, the shape is also changed depending on the number of classifications, and the larger the number of classifications, the more likely it is that the ground material will have a round shape. Furthermore, by adding Hybridization System (Nara machinery Co., Ltd.), Mechanofusion System (manufactured by Hosokawa Micron Corporation), Kryptron System (manufactured by Kawasaki heavy Industries, Ltd.) or the like as a post stage thereof, the shape can be changed, and the grinding material may also be spheroidized by hot air.

As described previously, binder resins that are used may include, for example, homopolymers and copolymers of styrenes such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, and particularly typical binder resins may include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. Furthermore, they may include polyester, polyurethane, epoxy resins, silicone resins, polyamide, modified rosins and paraffin waxes.

In addition, a resin having a softening point of 90 to 150° C., a glass transition point of 50 to 75° C., and a Mw (weight average molecular weight) of 8,000 to 150,000 may be especially suitable for use. The molecular distribution (Mw/Mn) of the above binder resin is 3 to 15, preferably 3 to 10. If the Mw/Mn of the binder resin is less than 3, a problem arises such that a sufficient available temperature region (latitude) cannot be obtained in fixing characteristics, and if the Mw/Mn is greater than 15, the dispersibility of calcium compound particles to be internally added is reduced, and thus a variation in the content of calcium compound particles in one piece of toner is increased, resulting in insufficient charge characteristics.

In addition, as described previously, colorants of the toner may include, for example, magnetic powders such as magnetite and ferrite, carbon black, aniline blue, charcoal blue, chrome yellow, ultramarine blue, Dupont oil red, quinoline yellow, methylene blue chloride, phtalocyanine blue, malachite green oxalate, lamp black, rose Bengal, C.I. pigment red 48:1, C.I. pigment red 122, C.I. pigment red 57:1, C.I. pigment yellow 97, C.I. pigment yellow 17, C.I. pigment blue 15:1 and C.I. pigment blue 15:3 as typical colorants.

Release agents may include, for example, low molecular weight polyethylene, low molecular polypropylene, Fisher-Tropsh wax, montan wax, carnauba wax, rice wax and candelilla wax as typical release agents.

In addition, the toner for electrostatic latent image developer of the present invention may contain a charge control agent as necessary. For the charge control agent, a well known substance maybe used, as well as azo based metal complex compounds, salicylic acid metal complex compounds, and resin-type charge control agents containing polar groups. In the case where the toner is produced by a wet production method, a material that is difficult to dissolve in water is preferably used in terms of control of ion intensity and reduction of waste water pollution. The toner in the present invention may be any of a magnetic toner containing a magnetic material and a nonmagnetic toner containing no magnetic material.

Furthermore, for improving long-term storage stability, flowability, developing characteristics and transformability of the toner, the toner for use in the present invention may have an inorganic powder or resin powder alone or in combination added to the surface. Inorganic powders include, for example, carbon black, silica, alumina, titania, zinc oxide, strontium titanate, cerium oxide and calcium carbonate, and resin powders include spherical particles such as polystyrene, polymethyl methacrylate (PMMA), nylon, melamine, benzoguanamine and fluoro-based resins, and indeterminate shape powders such as vinylidene chloride and fatty acid metal salts. In the case where the powder is added to the surface, the amount of powder added is 0.1 to 4% by weight, more preferably 0.2 to 3% by weight. Mixing can be carried out by a well known mixer such as a V-type blender, Henschel mixer or Loedige mixer, for example.

In addition, the toner composition of another preferred embodiment of the present invention may be subjected to a screening process after additives are added to and mixed with the toner. Other dry toner composition for electrostatic latent image developer:

The toner should contain at least inorganic particles having a Mohs hardness of 2 to 4.5.

As described before, the toner should be very highly controlled in consideration of not only transportability, developing characteristics, transformability and charge characteristics, but also cleaning characteristics. The cleaning is a function intended mainly for removing toner remaining on the photosensitive member after the toner is transferred. For the cleaning system, a blade system and a brush system are available, but in any case, a mechanical force is exerted on the photosensitive member, and although the toner can be removed, the surface of the photosensitive member may be abraded or scratched by a blade or brush itself, and by involvement of the toner material. For example, toner particles are trapped between the blade pressed by the photosensitive member and the photosensitive member, and silica, titania, alumina and the like constituting the surface of the toner acts on the photosensitive member like an abrasive agent to abrade or scratch the surface of the photosensitive member. This is due to the fact that although silica, titania and alumina are excellent in transportability, developing characteristics and transformability, they are much harder than toner and photosensitive member surface materials. Particularly, when a photosensitive member having a hard surface is used, scratches are alleviated and the durability is improved, but uneven abrasion occurs. If such uneven abrasion occurs, discharge products and depleted parts tend to remain, resulting in degradation of image quality. Thus, by using inorganic particles having a relatively low degree of hardness, among various kinds of inorganic particles, uneven abrasion and scratches in the photosensitive member can be alleviated.

In addition, if the photosensitive member is repeatedly used, it is contaminated with components constituting the toner although it undergoes cleaning. In this respect, the cleaning is also intended to inhibit contamination wherever possible, not just remove toner particles. In this regard, inorganic particles capable of abrading and thereby removing contaminants constituted by toner materials on the photosensitive member should be added to the toner.

As a result of conducting vigorous studies, the inventors have found that by adding inorganic particles with the Mohs hardness of 2 to 4.5 to the toner, abrasion and scratches in the photosensitive member, and also contamination can be inhibited.

The present invention will be described in detail below.

Inorganic Particles with the Mohs Hardness of 2 to 4.5 Include, But Are Not Limited to, Hydrous Aluminum Silicate (2 to 2.5), Mica (2.8) and Calcium Carbonate (3), for Example (Numbers in Parentheses Represent Mohs Hardness)

In addition, in the present invention, calcium carbonate particles may be suitably for use because they are relatively advantageous in negative charge control.

The Mohs hardness is determined using a Mohs hardness meter. This concept, which was devised by F. Mohs, is such that the following ten minerals are selected, and the object is scratched with the minerals one after another, and if the object is scarred when scratched with one of the minerals, the object is found to have a hardness lower than that of the mineral. The minerals listed in ascending order, with the mineral of lowest hardness first, are as follows: 1: talc, 2: plaster, 3: calcite, 4: fluorite, 5: apatite, 6: orthoclase, 7: quartz, 8: topaz, 9: corundum, 10: diamond.

For the method of producing the inorganic particles described above, calcium carbonate is produced, as described previously, by a method in which carbon dioxide is blown into milk of lime, being an aqueous suspension of calcium hydroxide, (Japanese Patent Publication No. Sho 37-519, Japanese Patent Publication No. Sho 47-22944 and Japanese Patent Publication No. Sho 56-40118).

In addition, hydrous aluminum silicate is produced using a hydrothermal synthesis method in which a raw material is kept at a high temperature and under a high pressure for a fixed amount of time under presence of water to obtain hydrous aluminum silicate. Spherical synthesized hydrous aluminum silicate and a method for producing the same have been reported by Shibazaki and Watamura (1983, Clays & Clay minerals) et al., and a method in which hydrous aluminum silicate is produced by a two stage hydrothermal treatment where a uniform mixed gel of silica-alumina is treated at a temperature equal to or lower than 220° C. and then at a temperature higher than 220° C. is known (Japanese Patent Laid-Open Publication No. Hei 6-191829).

In addition, for the mica, any kind of mica such as natural white mica, brown mica, sericite and black mica may be used as natural micas. Synthetic micas, which are generally produced by a melting synthesis method, may include, for example, synthetic fluorine tetra silicon mica and synthetic brown mica.

A specific embodiment of a method for producing calcium carbonate for use in the present invention will be described.

Synthesis of Calcium Carbonate:

The method for producing calcium carbonate by blowing carbon dioxide into milk of lime can be classified into two types depending on conditions for carbonation. For normal conditions, the calcium carbonate produced by one type of method is cubic particles known as precipitated calcium carbonate colloidal having an average particle size of 0.1 μm or smaller, and is usually obtained by blowing carbon dioxide into milk of lime, with the concentration of calcium hydroxide of 15% or lower to carry out a reaction at a rate of 2.0 L/min. or higher (equivalent to 100% carbon dioxide) per kg of calcium hydroxide at a combination starting temperature of 25° C. or lower. In addition, the calcium carbonate produced by the other type of method is spindle-shaped particles known as a soft calcium carbonate having an average particle size of 0.5 μm or greater, and is usually obtained with a desired particle size/particle shape by blowing carbon dioxide into milk of lime with the concentration of calcium hydroxide of 15% or higher to carry out a reaction at a rate of 2.0 L/min. or lower (equivalent to 100% carbon dioxide) per kg of calcium hydroxide at a combination starting temperature of 25° C. or higher.

For the average particle size of calcium carbonate particles, the primary particle size is 70 to 300 nm, preferably 100 to 200 μm. If the primary particle size is less than 70 nm, neither the effect of abrading and removing contaminant on the surface of the photosensitive member nor toner transformability can be achieved, and if the primary particle size is greater than 300 nm, an excessive amount of calcium carbonate particles should be added to the toner for achieving the transformability, thus making it impossible to avoid a detrimental effect on charge characteristics.

In addition, a surface treatment may be carried out for adjusting flowability and charge characteristics. The surface treatment may be, but is not limited to, a treatment using as a surface treating compound, for example, a silane coupling agent, titanate coupling agent, aluminate based coupling agent, various silicone oils, a fatty acid, fatty acid metal salt, ester thereof or rosin acid. The silane coupling agent, the aliphatic acid and the rosin acid may be especially suitable for use.

In addition, for the amount of surface treatment, the amount of the surface treating compound may be, but is not limited to, 0.1 to 30 wt %, preferably 0.2 to 20 wt %, more preferably 0.2 to 10 wt %. If the amount is less than 0.1 wt %, the effect of the surface treatment cannot be achieved, and if the amount is greater than 30 wt %, aggregation of particles occurs. In the present invention, by using the amount of surface treating compound described above, uneven abrasion resulting from an extremely high degree of hardness can be prevented, and the durability can be improved by retaining an appropriate level of abrasion.

Inorganic particles preferably have a small distribution in shape (uniform in shape) like cubic, spindle-shaped and hexahedral particles. By using uniformly shaped particles, the particles can be dispersed uniformly on the surface of the toner, thus making it possible to achieve a stable spacer effect. Furthermore, the contact area is increased and uniformly abraded, thus making it possible to prevent uneven abrasion more effectively.

The amount of the above inorganic particles added is 0.1 to 5 wt %, more preferably 0.3 to 2 wt %. If the amount is less than 0.1 wt %, the effect of adding the inorganic particles is not sufficiently achieved, and if the amount is greater than 5 wt %, flowability and charge characteristics as a toner is significantly influenced, and thus control as a toner becomes difficult.

The toner for electrostatic latent image developer which may be used is constituted by a binder resin, a colorant and release agent, and has a volume average particle size of 2 to 10 μm.

High development, transformability, and high image quality can be obtained using a toner an average shape factor SF1 of 100 to 140.

The method for producing the toner for use in the present invention is not specifically limited, and any well known method may be used as long as it has a shape factor and a particle size within the range specified above.

The toner may be produced by, for example, a kneading-grinding method, a method in which particles obtained by the kneading-grinding method are changed in shape by a mechanical impact or heat energy, emulsion polymerization aggregation, suspension polymerization, solution suspension and the like, as in the method for producing the dry toner composition for electrostatic latent image developer for double copying described above. In addition, a production method may be used in which the toner obtained in the method described above is used as a core, and aggregated particles are further deposited and heat-bonded together to provide a core shell structure.

In addition, for the binder resin for use in the toner, a resin similar to those used in the toner composition described above may be used, and a resin having a softening point of 90 to 150° C., a glass transition point of 50 to 75° C. and a Mw (weight average molecular weight) of 8,000 to 150,000 may be especially suitable for use.

In addition, for the colorant and the release agent of the toner, agents similar to those used in the toner composition described above may be used.

In addition, the toner for electrostatic latent image developer of the present invention may contain a charge control agent as necessary. For the charge control agent, a well known substance may be used, as well as azo based metal complex compounds, salicylic acid metal complex compounds, and resin-type charge control agents containing polar groups. In the case where the toner is produced by a wet production method, a material that is difficult to dissolve in water is preferably used in terms of control of ion intensity and reduction of waste water pollution. The toner in the present invention may be any of a magnetic toner containing a magnetic material and a nonmagnetic toner containing no magnetic material.

Furthermore, for improving long-term storage stability, flowability, developing characteristics and transformability of the toner, the toner for use in the present invention may have an inorganic powder or resin powder in combination other than inorganic particles for use in the present invention added to the surface. Inorganic powders include, for example, carbon black, silica, alumina, titania, zinc oxide, strontium titanate and cerium oxide, and resin powders include spherical particles such as polystyrene, polymethyl methacrylate (PMMA), nylon, melamine, benzoguanamine and fluoro-based resins, and indeterminate shape powders such as vinylidene chloride and fatty acid metal salts. In the case where the powder is added to the surface, the amount of powder added is 0.1 to 4% by weight, more preferably 0.2 to 3% by weight. Mixing can be carried out by a well known mixer such as a V-type blender, Henschel mixer or Loedige mixer, for example.

In addition, the toner may be subjected to a screening process after additives are added to and mixed with the toner.

[Developer]

The developer according to the present invention is constituted by any one of the toner compositions described above and the carrier described below.

If a spherical toner is used, for example, a packing nature is inevitably enhanced in a carriage control area in a developing device, and consequently a strong force is exerted not only on the toner surface but also on the carrier. It has been found that by dispersing a conductive material in a coat resin layer of the carrier, a significant change in volume specific resistance is prevented even if peeling in the coat resin layer occurs, and as a result, high quality images can be formed over a long period of time.

The carrier constituting a developer together with any one of the toner compositions described above is a resin-coated carrier having, on a core material, a coat resin layer with a conductive material dispersed in a matrix resin for stably controlling the toner charge and the electric resistance.

Matrix resins may include, but are not limited to, polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymers, styrene-acrylic acid copolymers, straight silicone resins comprising organosiloxane bonds or modified products thereof, fluororesins, polyester, polyurethane, polycarbonate, phenol resins, amino resins, melamine resins, benzoguanamine resins, urea resins, amide resins and epoxy resins, for example.

In addition, conductive materials may include, but are not limited to, metals such as gold, silver and copper, titanium oxide, zinc oxide, barium sulfate, aluminum borate, potassium titanate, tin oxide and carbon black, for example.

The content of conductive material is preferably 1 to 50 parts by weight, more preferably 3 to 20 parts by weight based on 100 parts by weight of matrix resin.

Core materials of the carrier include magnetic metals such as iron, nickel and cobalt, magnetic oxides such as ferrite and magnetite, and glass bead, but magnetic materials are preferable for adjusting the volume specific resistance using a magnetic brush method.

The average particle size of the core material is generally 10 to 500 μm, preferably 30 to 100 μm.

Methods for forming a coat resin layer on the surface of the core material of the carrier include a dipping method in which a carrier core material is dipped in a coat layer forming solution containing a matrix resin, a conductive material and a solvent, a spray method in which a coat layer forming solution is sprayed onto the surface of the carrier core material, a fluidized bed method in which a coat layer forming solution is sprayed onto the carrier core material with the carrier core material floated on flowing air, and a kneader coater method in which the carrier core material is mixed with a coat layer forming solution, and a solvent is removed.

The solvent for use in the coat layer forming solution is not specifically limited as long as it dissolves the matrix resin, and for example, aromatic hydrocarbons such as toluene and xylene, ketones such as acetone and methyl ethyl ketone, and ethers such as tetrahydrofuran and dioxane.

In addition, the average thickness of the coat resin layer is usually 0.1 to 10 μm, but in the present invention, it is preferably in the range of 0.5 to 3 μm for maintaining a stable volume specific resistance of the carrier with time.

The volume specific resistance provided as described above is preferably $10^6$ to $10^{14}$ Ωcm in the range of $10^3$ to $10^4$ V/cm equivalent to upper and lower limits of a normal developing contrast potential. If the volume specific resistance of the carrier is less than $10^6$ Ωcm, reproducibility of a narrow line is compromised, and toner fogging associated with introduction of an electric charge is more likely to occur in the background area. If the volume specific resistance of the carrier is greater than $10^{14}$ Ωcm, reproducibility of black solids and halftones is compromised. In addition, the amount of carrier moving to the photosensitive member increases, thus raising the possibility that the photosensitive member will be scratched. The electrostatic brush that may be used is, but is not limited to, a resin containing a conductive filler such as carbon black or a metal oxide, or a fibrous material coated on the surface with the conductive filler.

[Image Forming Method]

The image forming method according to the present invention is a method of forming images on one side or both sides of a recording material using an image forming apparatus described below.

The image forming apparatus comprises charging means for charging a latent image holding member, latent image processing means for forming a latent image on the charged latent image holding member by exposing the same to light, developing means for developing the above described electrostatic latent image using a toner, transfer-separate means for transferring a formed toner image to a recording material to separate the toner image from the latent image holding member being a toner image holding member, and fixation means for contact heat-fixing the transferred toner image on the recording material by a roller, belt or the like, and the image forming method comprises a charging stage of charging a latent image holding member, a latent image processing stage of forming a latent image by exposing the charged latent image holding member to light, a developing stage of developing the above described electrostatic latent image using a toner, a transfer-separate stage of transferring a formed toner image to a recording material to separate the toner image from the latent image holding member being a toner image holding member, and a fixation stage of contact heat-fixing the transferred toner image on the recording material.

In addition, the image forming apparatus may comprise cleaning means for removing toner remaining on the toner image holding member after the toner is transferred between the transfer-separate means and the charging means and in such a case, the image forming method comprises a cleaning stage of removing toner remaining on the toner image holding member after the toner is transferred between the transfer-separate stage and the charging stage.

In addition, an image forming apparatus for use in another image forming method of the present invention may develop the toner of each color on the latent image holding member, transfer the toner to a transferring belt or transferring drum, and then transfer the toner of each color to a transferring member at a time in the transfer-separate means.

Furthermore, in an image forming apparatus for use in another image forming method of the present invention, the fixation means may be fixation means supplying substantially no release agent, which is oilless.

The cleaning means may collect a residual toner on the latent image holding member using an electrostatic brush without scraping the latent image holding member with a blade. A blade cleaning system is generally used because of the high performance stability, but by using the toner of the present invention, a residual toner on the latent image holding member may be collected using the electrostatic brush, thus making it possible to considerably prolong the wear life of the latent image holding member.

The electrostatic brush is, for example, a cleaning brush comprising an axis member provided around the surface of the latent image holding member, and a brush fibrous member placed around the axis member. The fibrous member may have an insulating or conductive resistance value. If the fibrous member is conductive, a voltage may be applied as necessary. In addition, materials of the fibrous member include specifically polypropylene, nylon, rayon and polyester. The thickness, length and the like of such a woolen material may be selected as appropriate as in the case of a well known cleaning apparatus, but it is preferable that the thickness of the brush fibrous member is 15 to 19 [denier], the length is 6 to 12 [mm], and the density is 1 to 3 [1,000 fibers/$cm^2$].

The latent image holding member may use any well known photosensitive member with no specific limitations on the type of photosensitive member, but an organic photosensitive member having a structure called a separated-function type in which a charge generation layer is separated from a charge transport layer may be preferably used in terms of sensitivity and stability. In addition, a photosensitive member with the surface layer having a charge transport property and constituted by a siloxane based resin having a crosslinked structure is used. This surface layer of the photosensitive member is excellent in thermal and mechanical strength, and has a relatively high level of abrasion resistance, and thus allows development and cleaning to be maintained with stability over a long period of time if used in conjunction with the toner of the present invention.

In addition, in another image forming method of the present invention, the siloxane based resin having charge transport property and a crosslinked structure has:

G: inorganic glassy network subgroup; and

F: charge transporting subunit.

Furthermore, in another image forming method of the present invention, the siloxane based resin having charge transport property and a crosslinked structure has:

D: flexible organic subunit.

<Photosensitive Member for Use in the Invention>

Figure 2:
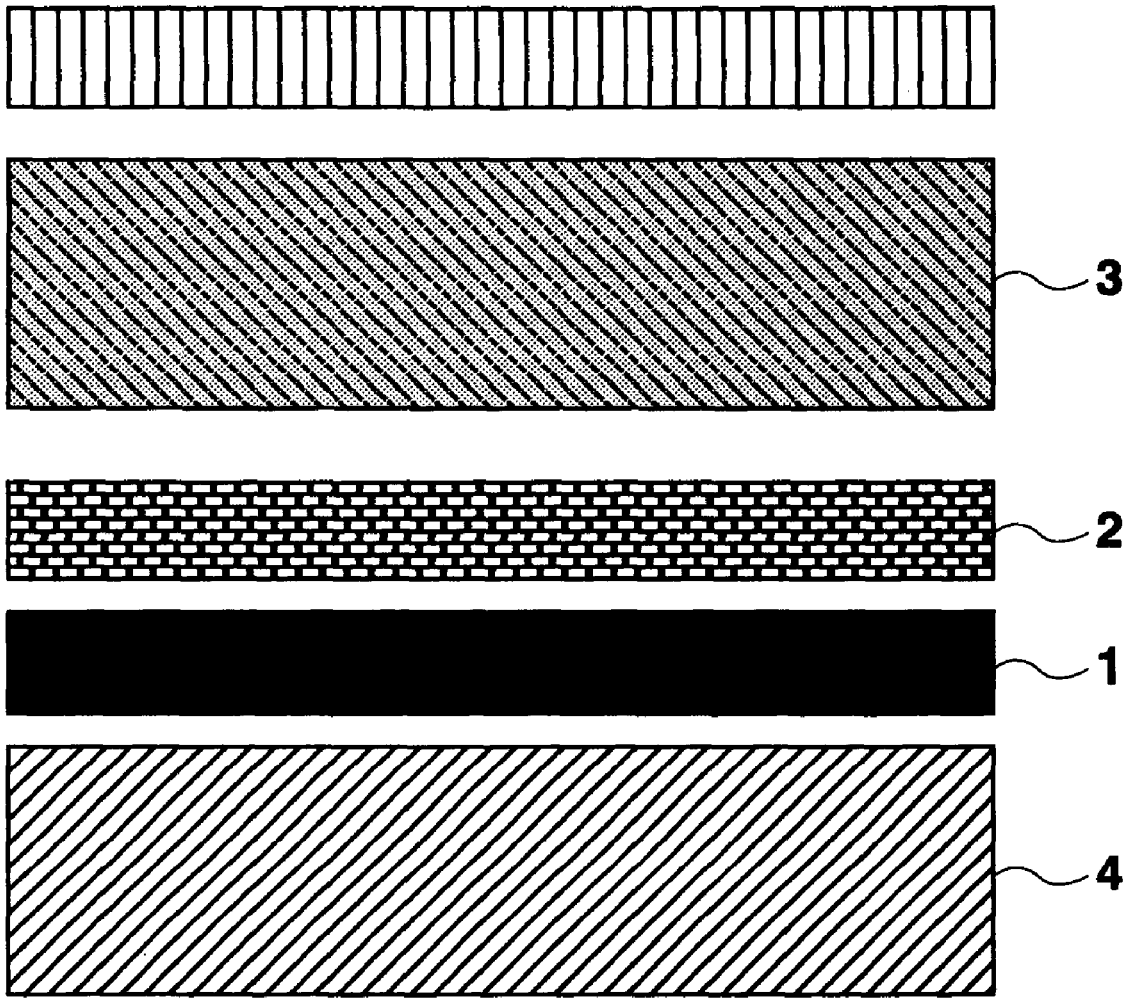
FIG. 2 is an expanded sectional view showing another example of the photosensitive member for use in the present invention.
Figure 3:
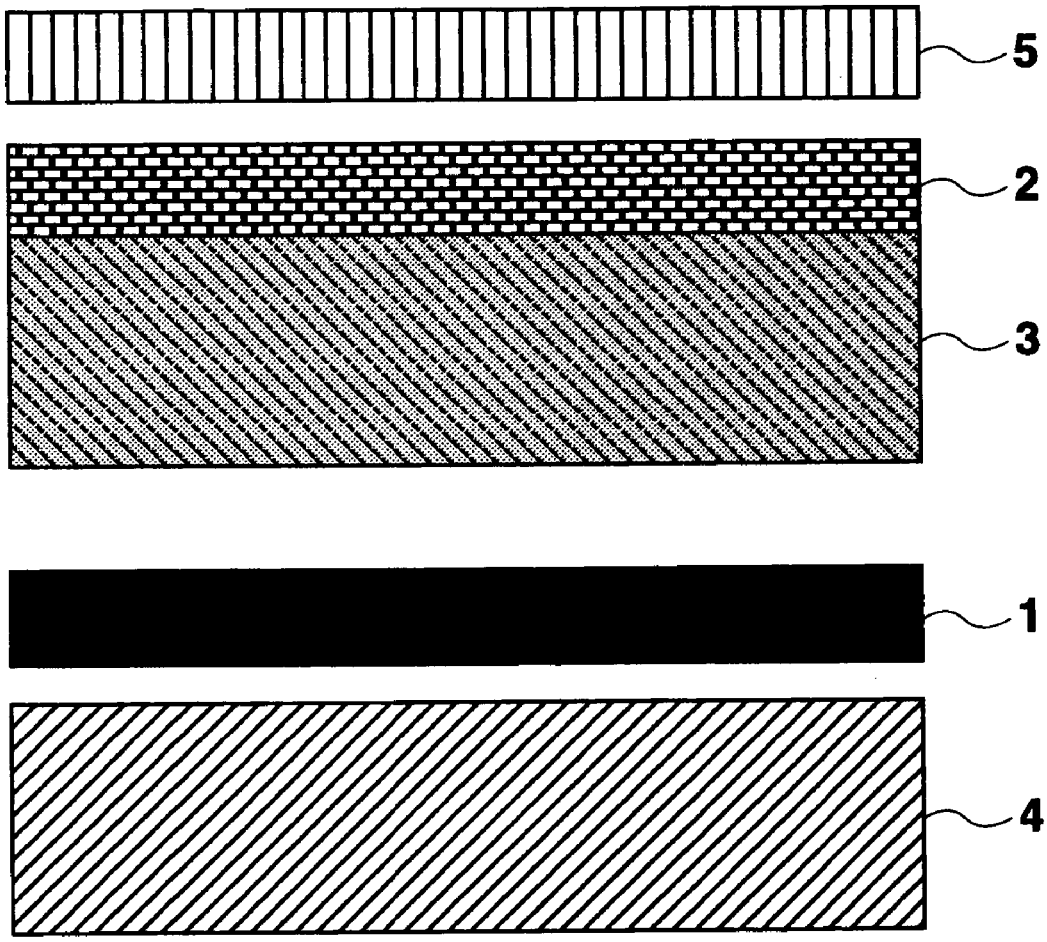
FIG. 3 is an expanded sectional view showing another example of the photosensitive member for use in the present invention.
Figure 4:
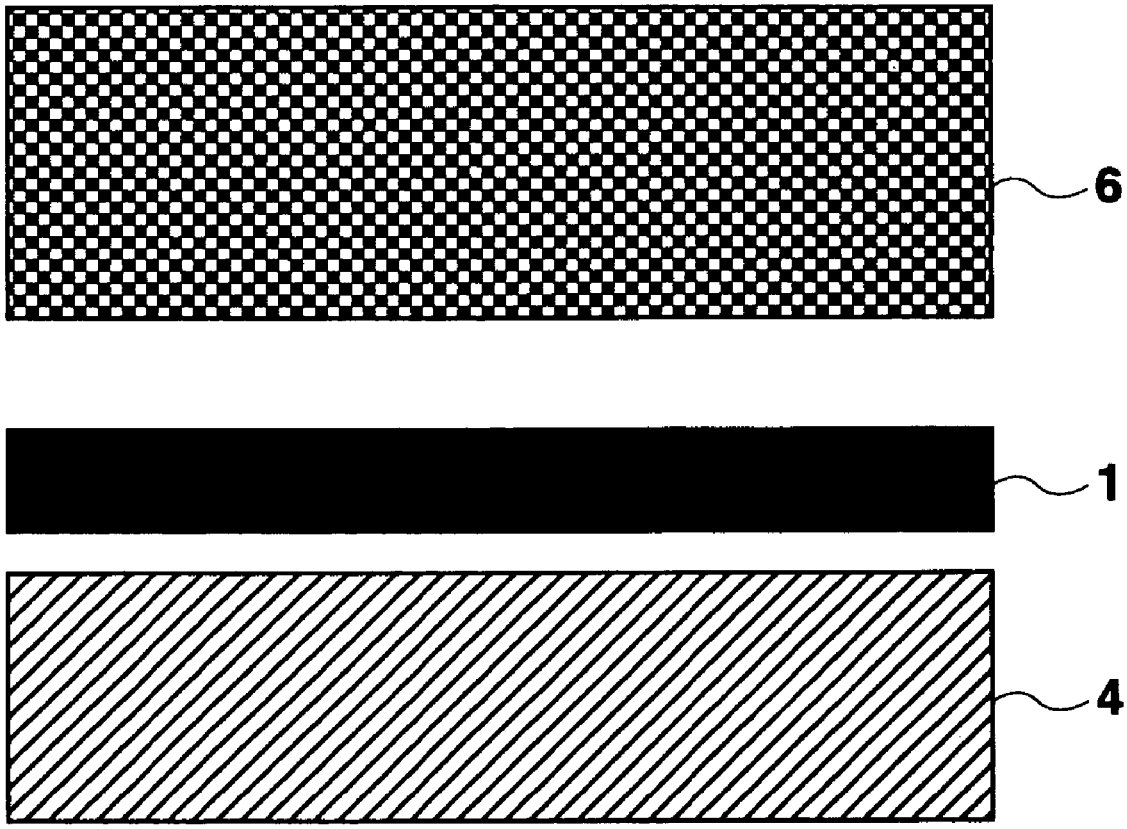
FIG. 4 is an expanded sectional view showing another example of the photosensitive member for use in the present invention.
Figure 5:
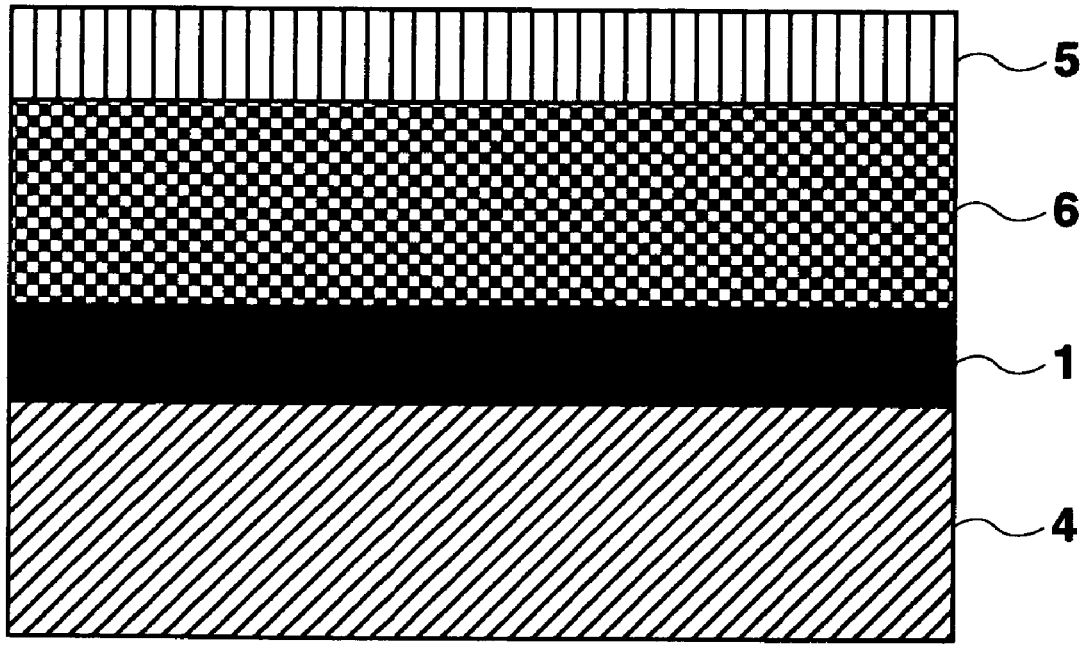
FIG. 5 is an expanded sectional view showing another example of the photosensitive member for use in the present invention.

FIGS. 1 to 5 are schematic diagrams each showing a cross section of the electrophotographic photosensitive member of the present invention. Photosensitive members having photosensitive layers of laminated structures are shown in FIGS. 1 to 3, and photosensitive members having photosensitive layers of single-layer structures are shown in FIGS. 4 and 5. In FIG. 1, an undercoat layer 1 is provided on a conductive substrate 4, and a charge generation layer 2 and a charge transport layer 3 are provided thereon. In FIG. 2, a protective layer 5 is further provided on the surface. In addition, in FIG. 3, the undercoat layer 1 is provided on the conductive substrate 4, the charge transport layer 3 and the charge generation layer 2 are provided thereon, and the protective layer 5 is provided on the surface. In FIGS. 1 to 3, the undercoat layer may or may not be provided. In FIG. 4, the undercoat layer 1 is provided on the conductive substrate 4, and a charge generation/charge transport layer 6 is provided thereon. Furthermore, in FIG. 5, the protective layer 5 is further provided on the surface.

Conductive Substrate:

For the conductive substrate, aluminum is used as the substrate having an appropriate shape such as a drum, sheet or plate shape, but the conductive substrate is not limited thereto.

If the photosensitive drum is used in a laser printer, the surface of the substrate is preferably roughened to have a center line average roughness Ra of 0.04 μm to 0.5 μm in order to prevent an interference pattern occurring when a laser beam is applied. For the method for roughening the surface, wet honing in which an abrasive agent is suspended in water and the suspension is sprayed to the substrate to roughen the surface, or centreless grinding in which the substrate is abutted against a rotating grind stone to carry out grinding processing continuously, are preferable. If the Ra is less than 0.04 μm, the surface becomes closer to a mirror plane, and therefore the interference prevention effect cannot be achieved, and if the Ra is greater than 0.5 μm, image quality is coarsened and is unsatisfactory even if the coating film of the present invention is formed. Use of incoherent light for a light source eliminates the need for roughening of the interference pattern to make it possible to prevent defects resulting from irregularities on the surface of the base material, and is therefore suitable for prolonging the life.

Undercoat Layer:

In addition, an intermediate layer (undercoat layer) may be formed between the base material and the photosensitive layer as desired. Materials for use in the undercoat layer include organic zirconium compounds such as zirconium chelate compounds, zirconium alkoxide compounds and zirconium coupling agents, organic titanium compounds such as titanium chelate compounds, titanium alkoxide compounds and titanate coupling agents, organic aluminum compounds such as aluminum chelate compounds and aluminum coupling agents, and organic metal compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicone alkoxide compounds, aluminum titanium alkoxide compounds and aluminum zirconium alkoxide compounds, and organic zirconium compounds, organic titanium compounds and organic aluminum compounds are especially suitable because they have reduced rest potentials and exhibit excellent electrophotographic characteristics. In addition, a silane coupling agent such as vinyl trichlorosilane, vinyl trimethoxysilane, vinyl triethoxysilane, vinyl tris-2-methoxyethoxysilane, vinyl triacetoxysilane, γ-glycidoxypropyl trimethoxysilane, γ-methacryloxypropyl trimethoxysilane, γ-aminopropyl triethoxysilane, γ-chloropropyl trimethoxysilane, γ-2-aminoethylaminopropyl trimethoxysilane, γ-mercapropropyl trimethoxysilane, γ-ureidepropyl trimethoxy silane or β-3,4-epoxycyclohexyl trimethoxysilane may also be incorporated in the undercoat layer. Furthermore, well known binder resins such as polyvinyl alcohol, polyvinyl methyl ether, poly-N-vinyl imidazole, polyethylene oxide, ethyl cellulose, methyl cellulose, ethylene-acrylic acid copolymers, polyamide, polyimide, casein, gelatin, polyethylene, polyester, phenol resins, vinyl chloride-vinyl acetate copolymers, epoxy resins, polyvinyl pyrolidone, polyvinyl pyridine, polyurethane, polyglutamic acid and polyacrylic acid, which have been used in the undercoat layer, may also be used. The mixing ratio thereof may be selected as appropriate depending on requirements.

In addition, an electron transporting pigment may be mixed with/dispersed in the undercoat layer. Electron transporting pigments include organic pigments such as perylene pigments described in Japanese Patent Laid-Open Publication No. Sho 47-30330, bisbenzimidazole perylene pigments, polycyclic quinone pigments, indigo pigments and quinacridone pigments, organic pigments such as bisazo pigments and phthalocyanine pigments having electron absorbing substituents such as cyano groups, nitro groups, nitroso groups and halogen atoms, and inorganic pigments such as zinc oxide and titanium oxide. Among these pigments, perylene pigments, bisbenzimidazole perylene pigments and polycyclic quinone pigments are suitable for use because of high electron mobility. If the amount of electron transporting pigment is too large, the strength of the undercoat layer is reduced to cause coat defects, and therefore the amount of electron transporting pigment should be 95 wt % or less, preferably 90 wt % or less. For the mixing/dispersion method, a normal method using a ball mill, roller mill, sand mill, attriter, ultrasonic wave or the like. Mixing/dispersion is performed in an organic solvent, and the organic solvent may be any organic solvent as long as it dissolves organic metal compounds and resins, and does not cause gelation and aggregation when the electron transporting pigment is mixed/dispersed in the solvent. For example, usual organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used alone or in a mixture of two or more types thereof. The thickness of the undercoat layer is generally 0.1 to 20 μm, preferably 0.2 to 10 μm. In addition, the coating method employed for providing the undercoat layer is a usual method such as a blade coating method, mayer bar coating method, spray coating method, dip coating method, bead coating method, air knife coating method or curtain coating method. A coated material is dried to obtain the undercoat layer, and usually the drying is carried out to evaporate a solvent at a temperature capable of forming a film. Particularly, abase material subjected to an acid solution treatment or boehmite treatment tends to have an insufficient defect masking capability, and therefore an intermediate layer is preferably formed.

Surface Layer:

The surface layer will now be described. The surface layer has a siloxane based resin having charge transport property and a crosslinked structure. The siloxane based resin having a crosslinked structure is especially suitable in terms of transparency, resistance to electrical breakdown and light stability. The siloxane resin having a crosslinked structure, for use in the present invention, will be described below.

The siloxane based resin having a crosslinked structure is a resin having siloxane, dimethylsiloxane, methylphenylsiloxane, other required components and the like three-dimensionally crosslinked and in the present invention, a siloxane based resin (may be referred to as "compound (I)" hereinafter) having a crosslinked structure including constituents of G and F described below is preferable because it is especially excellent in abrasion resistance, charge transport property and the like in addition to the characteristics described previously:

G: inorganic glassy network subgroup; and

F: charge transporting subunit.

In addition, the following constituent of D can be incorporated between constituents of G and F to link G with F:

D: flexible organic subunit.

Among the substituents of G especially preferable are Si groups, which undergo a crosslinking reaction with one another to form a three-dimensional Si—O—Si bond, namely an inorganic glassy network. Specifically, the constituents of G include a substituted silicon group having a hydrolysable group expressed by $Si(R_1)_{(3-a)}Q_a$ ($R_1$ represents hydrogen, an alkyl group, or substituted or unsubstituted aryl group, and Q represents a hydrolysable group. a represents an integer of 1 to 3.). b is an integer of 1 to 4.

The constituent of D is intended for linking the constituent of F for imparting charge transport property with the three-dimensional inorganic glassy network of G. In addition, the constituent of D also serves a function of imparting an appropriate level of flexibility to the inorganic glassy network that is rigid but fragile, to improve its strength as a film. Specifically, the constituents of D include bivalent hydrocarbon groups expressed by $—C_nH_{2n}—$, $C_nH_{(2n-2)}—$ or $—C_nH_{(2n-4)}—$ (n is an integer of 1 to 15), —COO—, —S—, —O—, $CH_2—C_6H_4—$, —N═CH—, $—(C_6H_4)—(C_6H_4)—$, and groups containing combinations thereof or substituents.

The constituents of F include triarylamine based compounds, benzidine based compounds, arylalkane based compounds, aryl substituted ethylene based compounds, stilbene based compounds, anthracene based compounds, hydrazone based compounds, quinone based compounds, fluorenone based compounds, xanthone compounds, benzophenone based compounds, cyanovinyl based compounds and ethylene based compounds as structures having light carrier transport characteristics. In addition, compounds with F expressed by general formula (II) are especially excellent in positive hole transportability and mechanical properties. $Ar_1$ to $Ar_4$ in general formula (II) each represent independently substituted or unsubstituted aryl groups, and specifically those listed in the Structure Group 1 shown below are preferable.

General Formula (II)

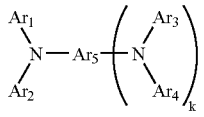

In general formula (II), $Ar_1$ to $Ar_4$ each represent independently substituted or unsubstituted aryl groups, and $Ar_5$ represents a substituted or unsubstituted aryl or arylene group. However, 1 to 4 groups of $Ar_1$ to $Ar_5$ have bonding hands capable of being bonded with bonding groups expressed by the -D-G. k represents 0 or 1.

Structure Group 1

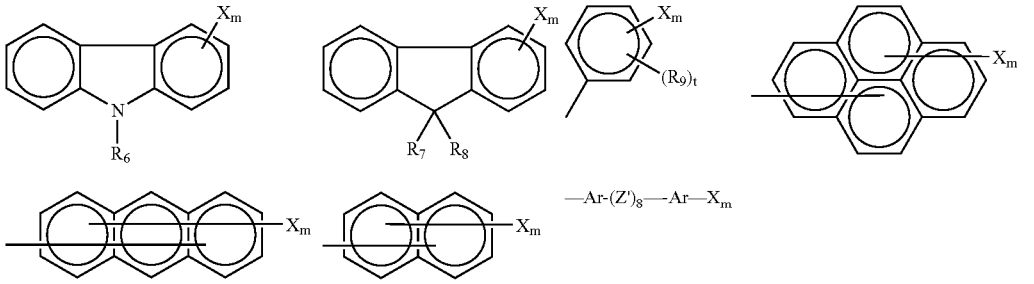

The Ar is preferably one of the groups shown in Structure Group 2 described below.

Structure Group 2

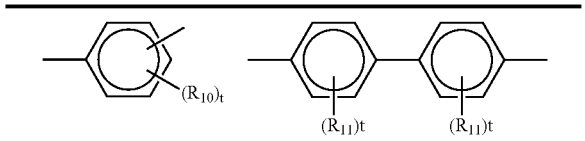

In addition, The Z' is preferably one of the groups shown in Structure Group 3 described below.

Structure Group 3

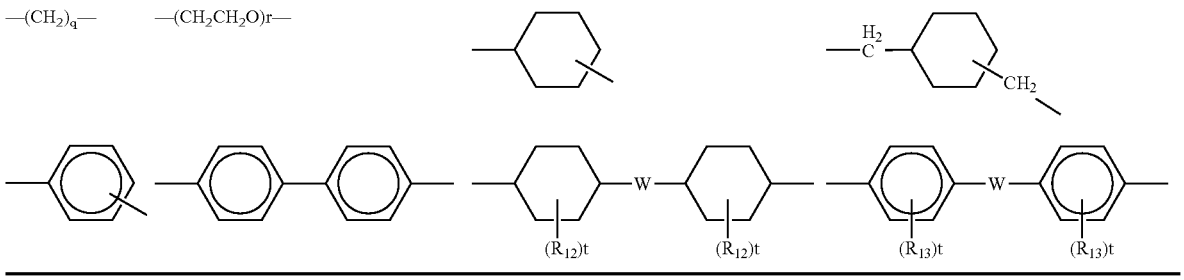

$R_6$ represents hydrogen, an alkyl group having 1 to 4 carbon atoms, a phenyl group substituted with an alkyl group having 1 to 4 carbon atoms or an alkoxy group having 1 to 4 carbon atoms or an unsubstituted phenyl group, or an aralkyl group having 7 to 10 carbon atoms. $R_7$ to $R_{13}$ each represent hydrogen, an alkyl group having 1 to 4 carbon atoms, an alkoxy group having 1 to 4 carbon atoms, a phenyl group substituted with an alkoxy group having 1 to 4 carbon atoms or an unsubstituted phenyl group, an aralkyl group having 7 to 10 carbon atoms, or halogen. m and s each represent independently 0 or 1, q and r each represent independently an integer of 1 to 10, and t and t' each represent independently an integer of 1 to 3. Here, X is the same as -D-A previously shown in the definition of the compound (I).

In addition, the W is preferably one of the groups shown in Structure Group 4 described below.

Structure Group 4

| | | | | |
|---|---|---|---|---|
| —$CH_2$— | —$C(CH_3)_2$— | —O— | —S— | —$C(CF_3)_2$— |
| —$Si(CH_3)_2$— | 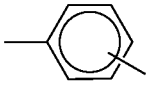 | 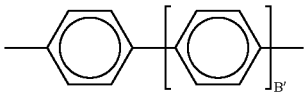 | 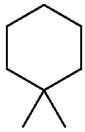 | |

s' represents an integer of 0 to 3.

A specific structure of $Ar_5$ in general formula (II) is a structure of one of $Ar_1$ to $Ar_4$ with m=1 when k equals 0, and is a structure of one of $Ar_1$ to $Ar_4$ with m=0 when k equals 1. Specific examples of the compound (II) are shown in Tables 1 to 55, but the compound (II) is not limited to these examples.

TABLE 1

| COMPOUNDS | k | $Ar^1$ | $Ar^2$ | $Ar^3$ |
|---|---|---|---|---|
| 1 | 0 | 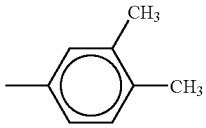 | 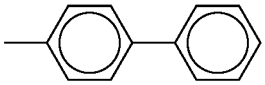 | — |
| 2 | 0 | 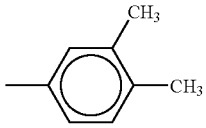 | 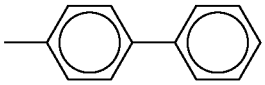 | — |
| 3 | 0 | 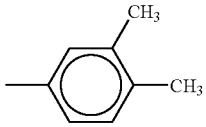 | 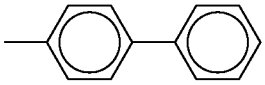 | — |
| 4 | 0 | 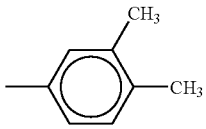 | 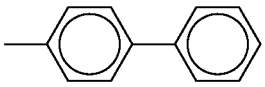 | — |
| 5 | 0 | 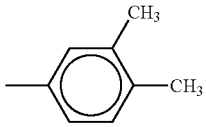 | 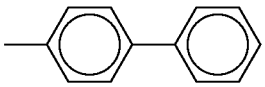 | — |

| COMPOUNDS | $Ar^4$ | $Ar^5$ | X |
|---|---|---|---|
| 1 | — | 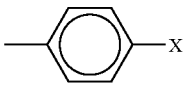 | —CH═$NCH_2$— —$Si(OMe)_2Me$ |
| 2 | — | 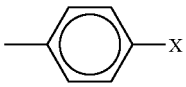 | —CH═$N(CH_2)_3$ —$Si(OMe)_3$ |
| | — | 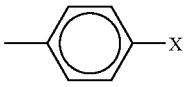 | —CH═$N(CH_2)_3$— —$Si(OEt)_3$ |

TABLE 1-continued
| | | |
|---|---|---|
| | — | 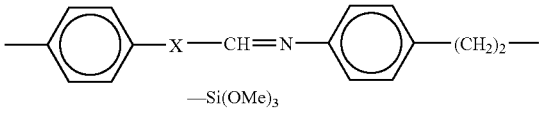 |
| 5 | — | 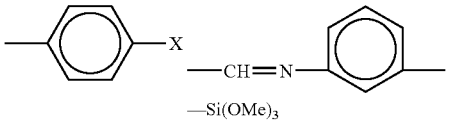 |
TABLE 2
| COM-POUNDS | k | $Ar^1$ | $Ar^2$ | $Ar^3$ | $Ar^4$ | $Ar^5$ | X |
|---|---|---|---|---|---|---|---|
| 6 | 0 | 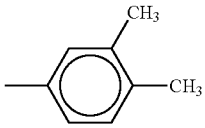 | 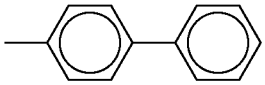 | — | — | 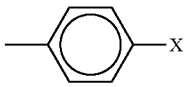 | $—O(CH_2)_3Si(OMe)_3$ |
| 7 | 0 | 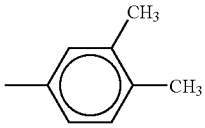 | 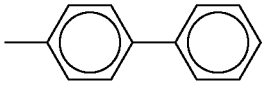 | — | — | 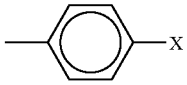 | $—O(CH_2)_3—$ $—SiMe(OMe)_2$ |
| 8 | 0 | 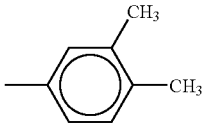 | 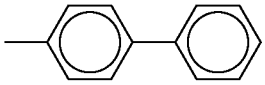 | — | — | 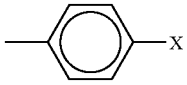 | $—O(CH_2)_3Si(OEt)_3$ |
| 9 | 0 | 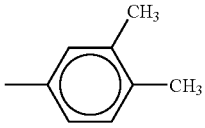 | 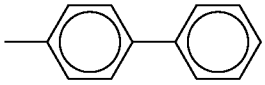 | — | — | 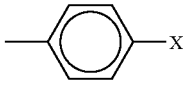 | $—CH_2O(CH_2)_3—$ $—Si(OMe)_3$ |
| 10 | 0 | 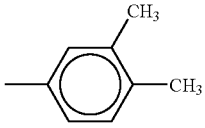 | 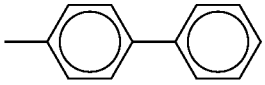 | — | — | 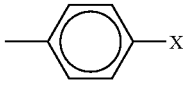 | $—(CH_2)_3O(CH_2)_3—$ $—Si(OMe)_3$ |
TABLE 3
| COM-POUNDS | k | $Ar^1$ | $Ar^2$ | $Ar^3$ | $Ar^4$ | $Ar^5$ | X |
|---|---|---|---|---|---|---|---|
| 11 | 0 | 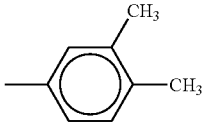 | 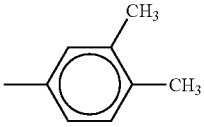 | — | — | 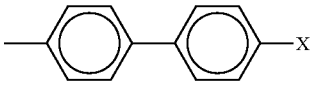 | $—COO(CH_2)_3—$ $—Si(OMe)_3$ |
| 12 | 0 | 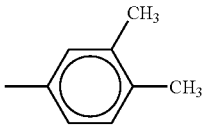 | 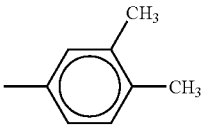 | — | — | 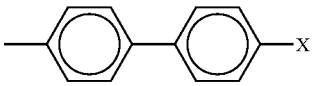 | $—CH_2COO(CH_2)_3—$ $—Si(OMe)_3$ |

TABLE 3-continued
| COM-POUNDS | k | $Ar^1$ | $Ar^2$ | $Ar^3$ | $Ar^4$ | $Ar^5$ | X |
|---|---|---|---|---|---|---|---|
| 13 | 0 | 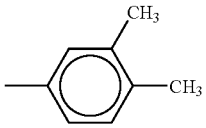 | 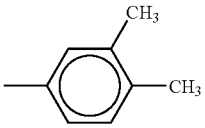 | — | — | 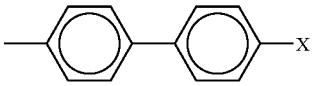 | —$(CH_2)_2COO$— —$(CH_2)_3Si(OMe)_3$ |
| 14 | 0 | 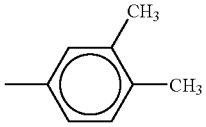 | 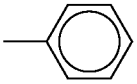 | — | — | 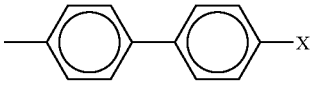 | —$COO(CH_2)_3$— —$Si(OMe)_3$ |
| 15 | 0 | 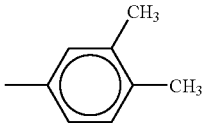 | 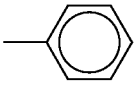 | — | — | 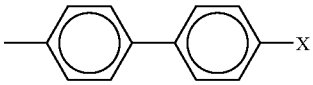 | —$CH_2COO(CH_2)_3$— —$Si(OMe)_3$ |
TABLE 4
| COM-POUNDS | k | $Ar^1$ | $Ar^2$ | $Ar^3$ | $Ar^4$ | $Ar^5$ | X |
|---|---|---|---|---|---|---|---|
| 16 | 0 | 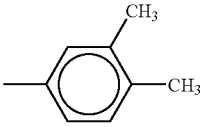 | 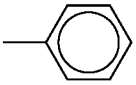 | — | — | 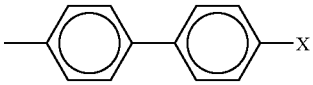 | —$(CH_2)_2COO$— —$(CH_2)_3Si(OMe)_3$ |
| 17 | 0 | 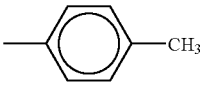 | 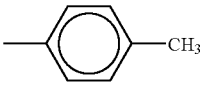 | — | — | 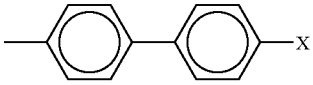 | —$COO(CH_2)_3$— —$Si(OMe)_3$ |
| 18 | 0 | 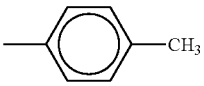 | 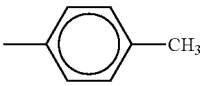 | — | — | 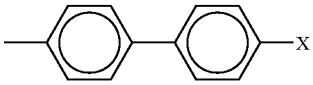 | —$CH_2COO(CH_2)_3$— —$Si(OMe)_3$ |
| 19 | 0 | 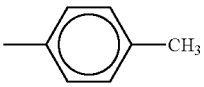 | 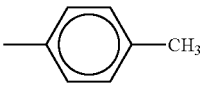 | — | — | 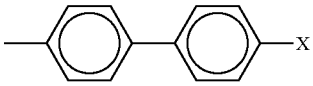 | —$(CH_2)_2COO$— —$(CH_2)_3Si(OMe)_3$ |
| 20 | 0 | 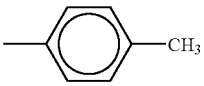 | 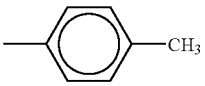 | — | — | 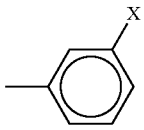 | —$COO(CH_2)_3$— —$Si(OMe)_3$ |
TABLE 5
| COM-POUNDS | k | $Ar^1$ | $Ar^2$ | $Ar^3$ | $Ar^4$ | $Ar^5$ | X |
|---|---|---|---|---|---|---|---|
| 21 | 0 | 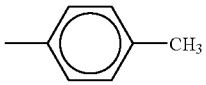 | 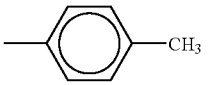 | — | — | 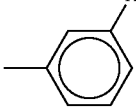 | —$COOCH_2C_6H_4$— —$Si(OMe)_3$ |

TABLE 5-continued
| COM-POUNDS | k | $Ar^1$ | $Ar^2$ | $Ar^3$ | $Ar^4$ | $Ar^5$ | X |
|---|---|---|---|---|---|---|---|
| 22 | 0 | 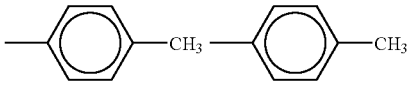 | | — | — | 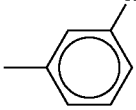 | X —$COOCH_2C_6H_4$— —$(CH_2)_3Si(OMe)_3$ |
| 23 | 0 | 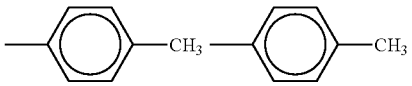 | | — | — | 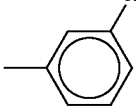 | X —$CH_2COO(CH_2)_3$— —$Si(OMe)_3$ |
| 24 | 0 | 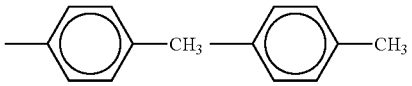 | | — | — | 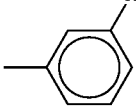 | X —$CH_2COOCH_2$— —$C_6H_4Si(OMe)_3$ |
| 25 | 0 | 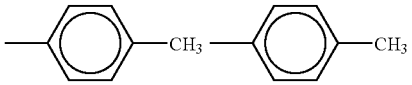 | | — | — | 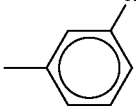 | X —$CH_2COO$— —$CH_2C_6H_4(CH_2)_2$— —$Si(OMe)_3$ |
TABLE 6
| COM-POUNDS | k | $Ar^1$ | $Ar^2$ | $Ar^3$ | $Ar^4$ | $Ar^5$ | X |
|---|---|---|---|---|---|---|---|
| 26 | 0 | 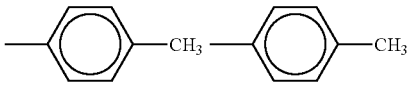 | | — | — | 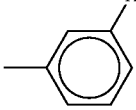 | X —$(CH_2)_2COO$— —$(CH_2)_3Si(OMe)_3$ |
| 27 | 0 | 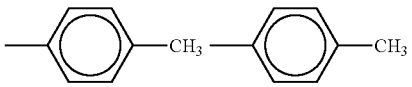 | | — | — | 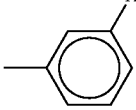 | X —$(CH_2)_2COOCH_2$— —$C_6H_4Si(OMe)_3$ |
| 28 | 0 | 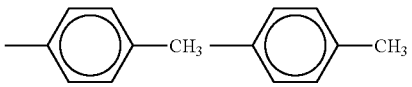 | | — | — | 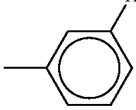 | X —$CH_2COO$— —$CH_2C_6H_4(CH_2)_2$— —$Si(OMe)_3$ |
| 29 | 0 | 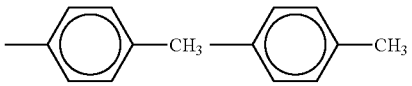 | | — | — | 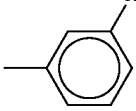 | X —$COO(CH_2)_3$— —$Si(OMe)_3$ |
| 30 | 0 | 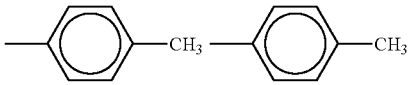 | | — | — | 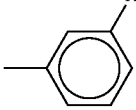 | X —$COOCH_2C_6H_4$— —$(CH_2)_2Si(OMe)_3$ |

TABLE 7
| COM-POUNDS | k | $Ar^1$ | $Ar^2$ | $Ar^3$ | $Ar^4$ | $Ar^5$ | X |
|---|---|---|---|---|---|---|---|
| 31 | 0 | 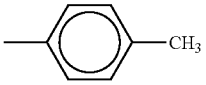 | 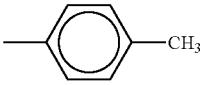 | — | — | 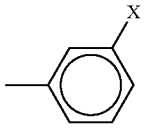 | —$(CH_2)_3COO$—<br>—$(CH_2)_3Si(OMe)_3$ |
| 32 | 0 | 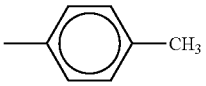 | 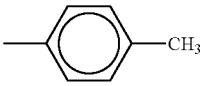 | — | — | 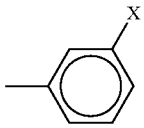 | —$(CH_2)_2COO$—<br>—$CH_2C_6H_4(CH_2)_2$—<br>—$Si(OMe)_3$ |
| 33 | 0 | 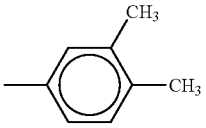 | 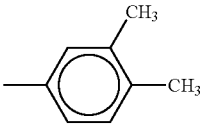 | — | — | 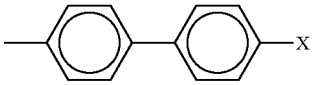 | —$COO(CH_2)_3$—<br>—$Si(OMe)_3$ |
| 34 | 0 | 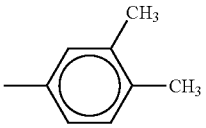 | 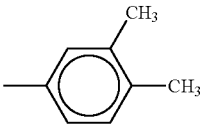 | — | — | 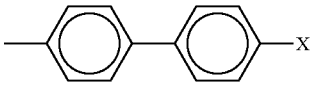 | —$COOCH_2$—<br>—$C_6H_4Si(OMe)_3$ |
| 35 | 0 | 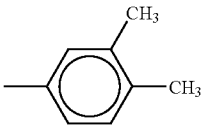 | 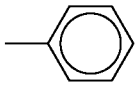 | — | — | 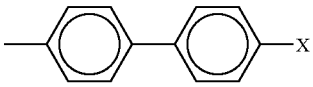 | —$COO(CH_2)_3$—<br>—$Si(OMe)_3$ |
TABLE 8
| COM-POUNDS | k | $Ar^1$ | $Ar^2$ | $Ar^3$ | $Ar^4$ | $Ar^5$ | X |
|---|---|---|---|---|---|---|---|
| 36 | 0 | 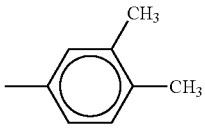 | 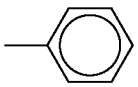 | — | — | 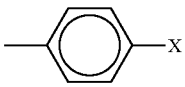 | —$COO(CH_2)_3$—<br>—$Si(OMe)_3$ |
| 37 | 0 | 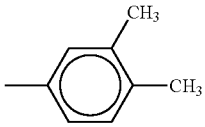 | 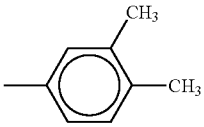 | — | — | 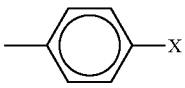 | —$COO(CH_2)_3$—<br>—$Si(OMe)_3$ |
| 38 | 0 | 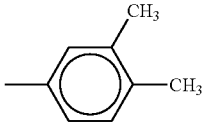 | 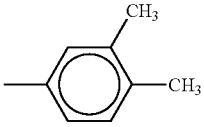 | — | — | 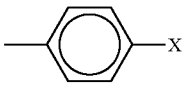 | —$COOCH_2C_6H_4$—<br>—$(CH_2)_2Si(OMe)_3$ |
| 39 | 0 | 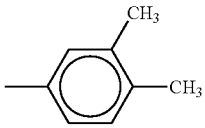 | 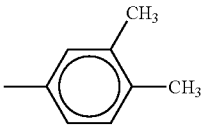 | — | — | 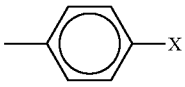 | —$CH_2COO(CH_2)_3$—<br>—$Si(OMe)_3$ |

TABLE 8-continued

| COM-POUNDS | k | $Ar^1$ | $Ar^2$ | $Ar^3$ | $Ar^4$ | $Ar^5$ | X |
|---|---|---|---|---|---|---|---|
| 40 | 0 | 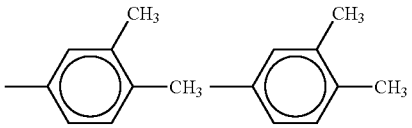 | | — | — | 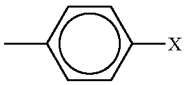 | —$CH_2COO$—<br>—$CH_2C_6H_4(CH_2)_2$—<br>—$Si(OMe)_3$ |

TABLE 9

| COM-POUNDS | k | $Ar^1$ | $Ar^2$ | $Ar^3$ | $Ar^4$ | $Ar^5$ | X |
|---|---|---|---|---|---|---|---|
| 41 | 0 | 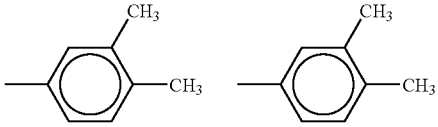 | | — | — | 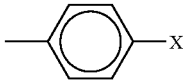 | —$(CH_2)_2COO$—<br>—$(CH_2)_3Si(OMe)_3$ |
| 42 | 0 | 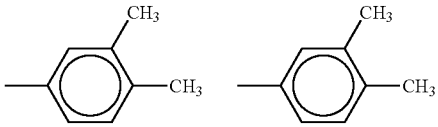 | | — | — | 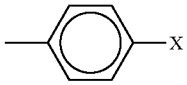 | —$(CH_2)_2COO$—<br>—$CH_2C_6H_4(CH_2)_2$—<br>—$Si(OMe)_3$ |
| 43 | 0 | 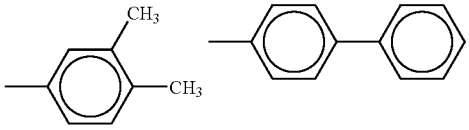 | | — | — | 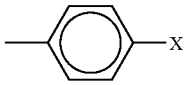 | —$COO(CH_2)_3$—<br>—$Si(OMe)_3$ |
| 44 | 0 | 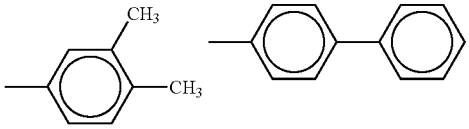 | | — | — | 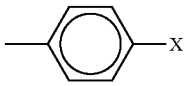 | —$COOCH_2C_6H_4$—<br>—$(CH_2)_2Si(OMe)_3$ |
| 45 | 0 | 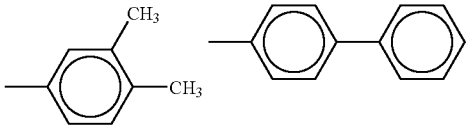 | | — | — | 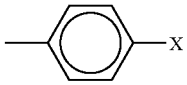 | —$CH_2COO(CH_2)_3$—<br>—$Si(OMe)_3$ |

| COM-POUNDS | k | $Ar^1$ | $Ar^2$ | $Ar^3$ | $Ar^4$ | $Ar^5$ | X |
|---|---|---|---|---|---|---|---|
| 46 | 0 | 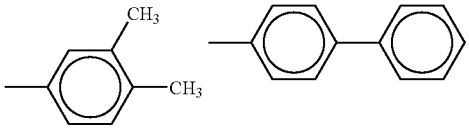 | | — | — | 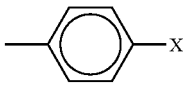 | —$CH_2COO$—<br>—$CH_2C_6H_4(CH_2)_2$—<br>—$Si(OMe)_3$ |
| 47 | 0 | 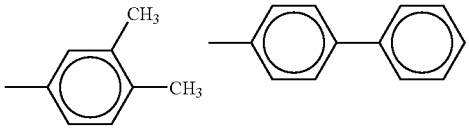 | | — | — | 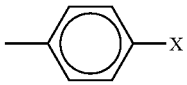 | —$(CH_2)_2COO$—<br>—$(CH_2)_3Si(OMe)_3$ |

-continued
| COMPOUNDS | k | $Ar^1$ | $Ar^2$ | $Ar^3$ | $Ar^4$ | $Ar^5$ | X |
|---|---|---|---|---|---|---|---|
| 48 | 0 | 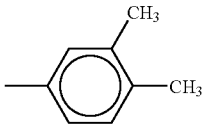 | 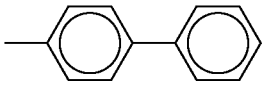 | — | — | 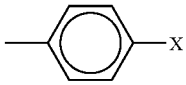 | —$(CH_2)_2COO$— —$CH_2C_6H_4(CH_2)_2$— —$Si(OMe)_3$ |
| 49 | 0 | 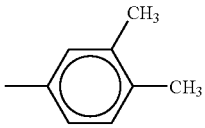 | 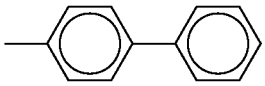 | — | — | 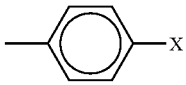 | —CH═CH$Si(OEt)_3$ |
| 50 | 0 | 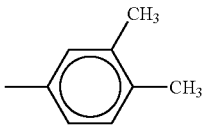 | 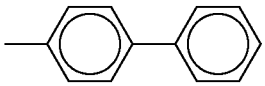 | — | — | 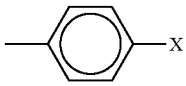 | —CH═$CHCH_2$— —$Si(OEt)_3$ |
TABLE 11
| COMPOUNDS | k | $Ar^1$ | $Ar^2$ | $Ar^3$ | $Ar^4$ | $Ar^5$ | X |
|---|---|---|---|---|---|---|---|
| 51 | 0 | 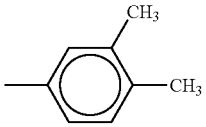 | 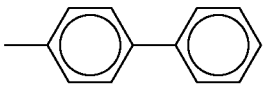 | — | — | 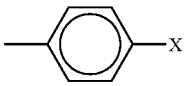 | —CH═$CH(CH_2)_2$— —$Si(OMe)_3$ |
| 52 | 0 | 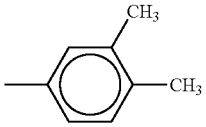 | 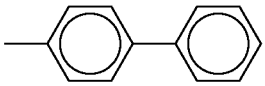 | — | — | 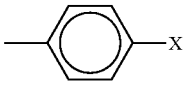 | —CH═$CH(CH_2)_2$— —$SiMe(OMe)_2$ |
| 53 | 0 | 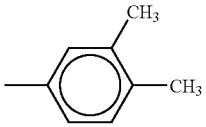 | 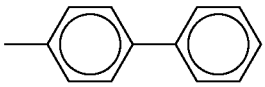 | — | — | 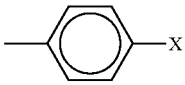 | —CH═$CHCH_2$— —$Si(OMe)_2Me$ |
| 54 | 0 | 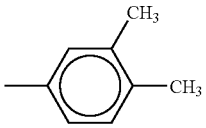 | 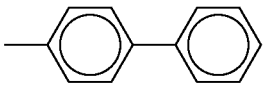 | — | — | 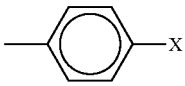 | —CH═$CH(CH_2)_2$— —$Si(OEt)_3$ |
| 55 | 0 | 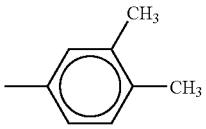 | 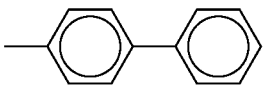 | — | — | 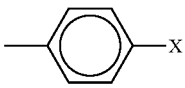 | —CH═$CH(CH_2)_{10}$— —$Si(OMe)_3$ |
TABLE 12
| COMPOUNDS | k | $Ar^1$ | $Ar^2$ | $Ar^3$ | $Ar^4$ | $Ar^5$ | X |
|---|---|---|---|---|---|---|---|
| 56 | 0 | 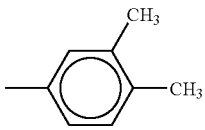 | 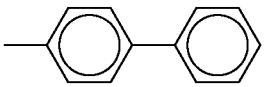 | — | — | 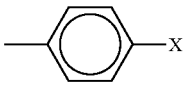 | —CH═$CHC_6H_4$— —$Si(OMe)_3$ |

TABLE 12-continued
| COMPOUNDS | k | $Ar^1$ | $Ar^2$ | $Ar^3$ | $Ar^4$ | $Ar^5$ | X |
|---|---|---|---|---|---|---|---|
| 57 | 0 | 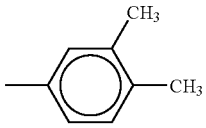 | 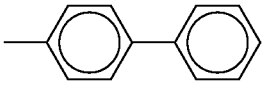 | — | — | 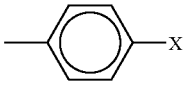 | —CH═CHC$_6$H$_4$— —(CH$_2$)$_2$Si(OMe)$_3$ |
| 58 | 0 | 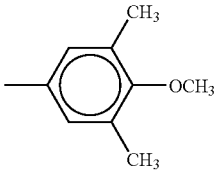 | 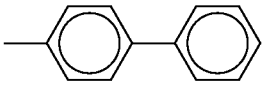 | — | — | 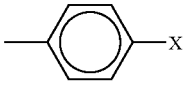 | —CH═CH(CH$_2$)$_2$— —Si(OMe)$_3$ |
| 59 | 0 | 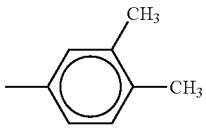 | 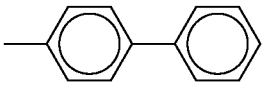 | — | — | 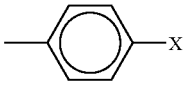 | —(CH$_2$)$_2$Si(OEt)$_3$ |
| 60 | 0 | 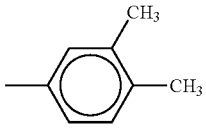 | 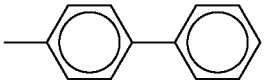 | — | — | 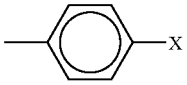 | —(CH$_2$)$_3$Si(OEt)$_3$ |
TABLE 13
| COMPOUNDS | k | $Ar^1$ | $Ar^2$ | $Ar^3$ | $Ar^4$ | $Ar^5$ | X |
|---|---|---|---|---|---|---|---|
| 61 | 0 | 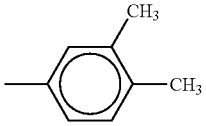 | 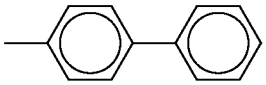 | — | — | 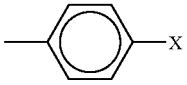 | —(CH$_2$)$_4$Si(OMe)$_3$ |
| 62 | 0 | 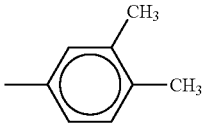 | 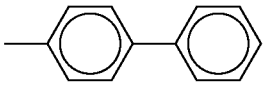 | — | — | 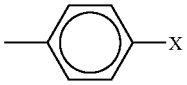 | —(CH$_2$)$_4$— —SiMe(OMe)$_2$ |
| 63 | 0 | 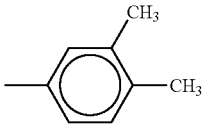 | 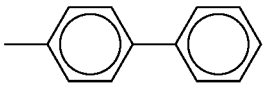 | — | — | 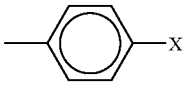 | —(CH$_2$)$_4$— —SiMe$_2$(OMe) |
| 64 | 0 | 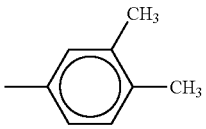 | 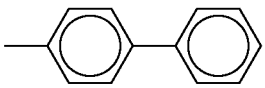 | — | — | 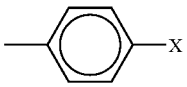 | —(CH$_2$)$_4$Si(OEt)$_3$ |
| 65 | 0 | 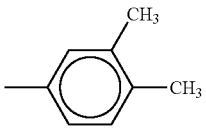 | 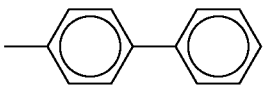 | — | — | 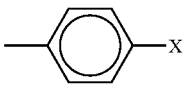 | —(CH$_2$)$_6$SiMe(OEt)$_2$ |

TABLE 14
| COMPOUNDS | k | $Ar^1$ | $Ar^2$ | $Ar^3$ | $Ar^4$ | $Ar^5$ | X |
|---|---|---|---|---|---|---|---|
| 66 | 0 | 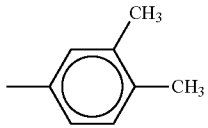 | 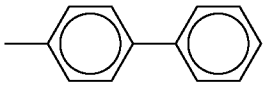 | — | — | 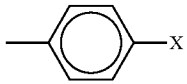 | $—(CH_2)_{12}Si(OMe)_3$ |
| 67 | 0 | 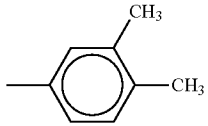 | 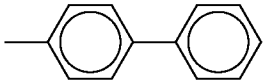 | — | — | 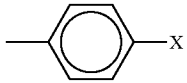 | $—(CH_2)_2C_6H_4—$ $—(CH_2)_2Si(OMe)_3$ |
| 68 | 0 | 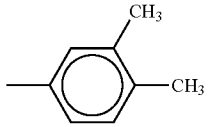 | 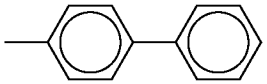 | — | — | 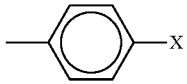 | $—C_2H_4C_4H_6—$ $—Si(OMe)_3$ |
| 69 | 1 | 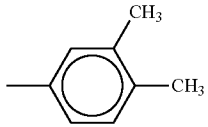 | 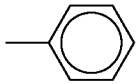 | 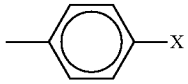 | 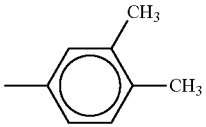 | 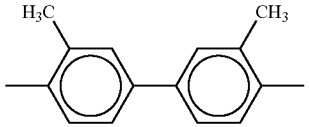 | $—CH{=}N(CH_2)_3—$ $—Si(OMe)_3$ |
| 70 | 1 | 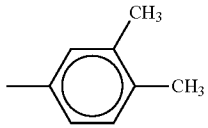 | 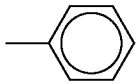 | 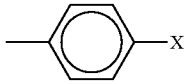 | 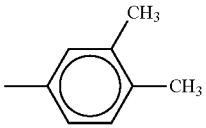 | 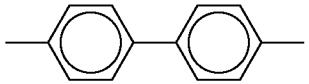 | $—CH{=}N(CH_2)_3—$ $—Si(OMe)_3$ |

TABLE 15
| COMPOUNDS | k | $Ar^1$ | $Ar^2$ | $Ar^3$ | $Ar^4$ | $Ar^5$ | X |
|---|---|---|---|---|---|---|---|
| 71 | 1 | 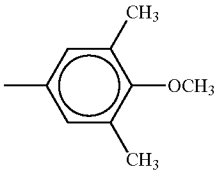 | 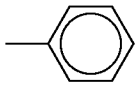 | 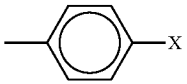 | 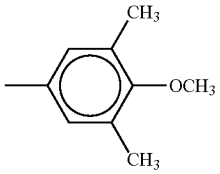 | 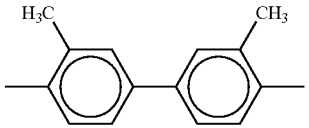 | —CH═N($CH_2$)$_3$— —Si(OMe)$_3$ |
| 72 | 1 | 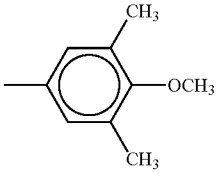 | 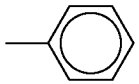 | 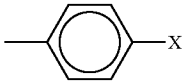 | 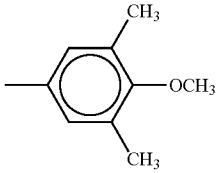 | 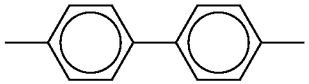 | —CH═N($CH_2$)$_3$— —Si(OMe)$_3$ |
| 73 | 1 | 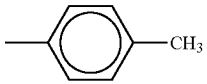 | 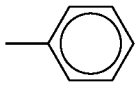 | 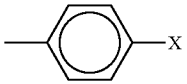 | 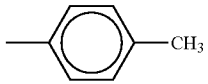 | 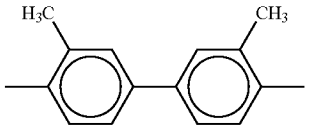 | —CH═N($CH_2$)$_3$— —Si(OMe)$_3$ |
| 74 | 1 | 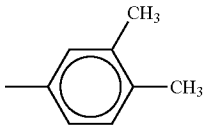 | 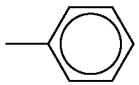 | 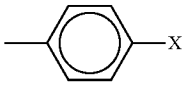 | 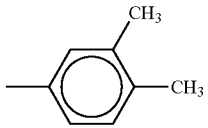 | 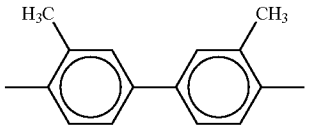 | 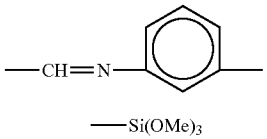 |
| 75 | 1 | 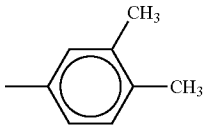 | 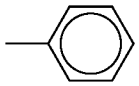 | 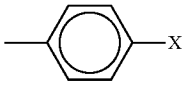 | 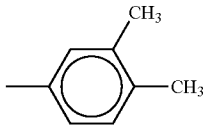 | 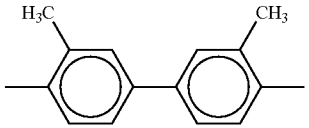 | —O($CH_2$)$_3$Si(OMe)$_3$ |

TABLE 16
| COMPOUNDS | k | $Ar^1$ | $Ar^2$ | $Ar^3$ | $Ar^4$ | $Ar^5$ | X |
|---|---|---|---|---|---|---|---|
| 76 | 1 | 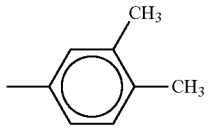 | 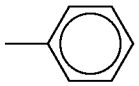 | 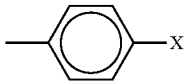 | 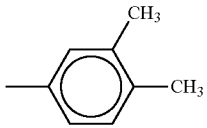 | 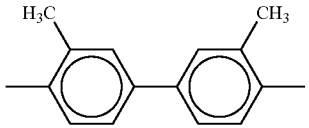 | $—O(CH_2)_3Si(OEt)_3$ |
| 77 | 1 | 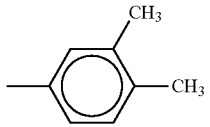 | 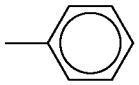 | 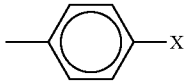 | 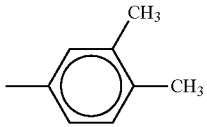 | 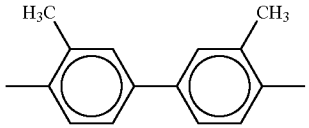 | $—CH_2O(CH_2)_3—$ $—Si(OMe)_3$ |
| 78 | 1 | 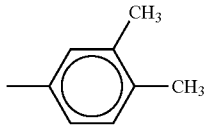 | 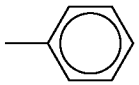 | 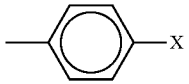 | 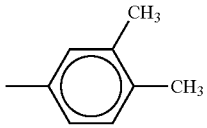 | 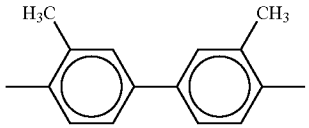 | $—(CH_2)_3O(CH_2)_3—$ $—Si(OMe)_3$ |
| 79 | 1 | 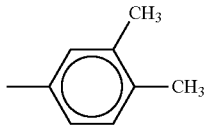 | 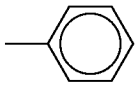 | 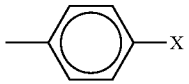 | 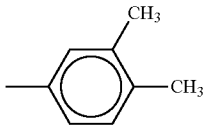 | 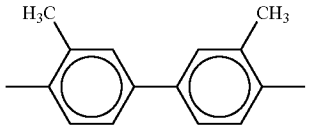 | $—(CH_2)_4Si(OMe)_3$ |
| 80 | 1 | 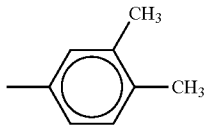 | 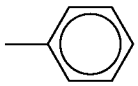 | 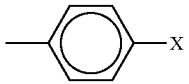 | 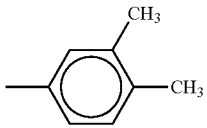 | 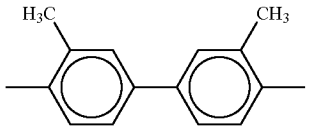 | $—(CH_2)_2C_6H_4—$ $—Si(OMe)_3$ |

TABLE 17
| COMPOUNDS | k | $Ar^1$ | $Ar^2$ | $Ar^3$ | $Ar^4$ | $Ar^5$ | X |
|---|---|---|---|---|---|---|---|
| 81 | 1 | 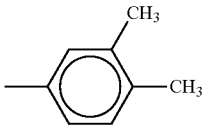 | 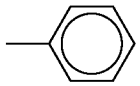 | 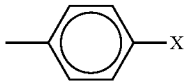 | 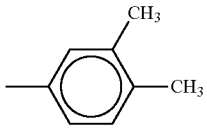 | 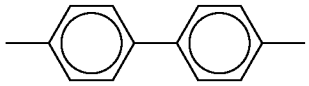 | $—(CH_2)_4Si(OMe)_3$ |
| 82 | 1 | 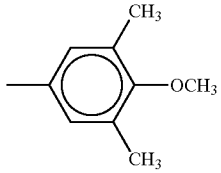 | 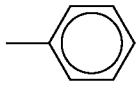 | 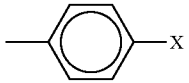 | 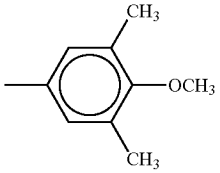 | 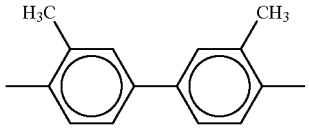 | $—(CH_2)_4Si(OMe)_3$ |
| 83 | 1 | 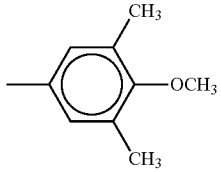 | 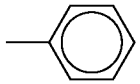 | 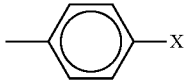 | 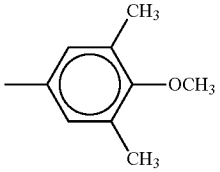 | 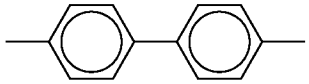 | $—(CH_2)_4Si(OMe)_3$ |
| 84 | 1 | 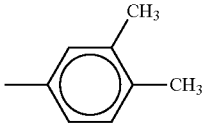 | 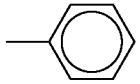 | 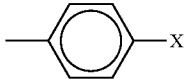 | 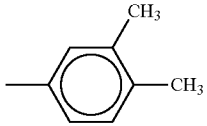 | 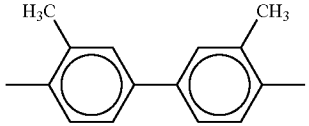 | $—CH{=}CH(CH_2)_2—$ $—Si(OMe)_3$ |
| 85 | 1 | 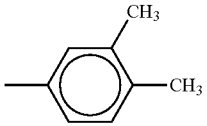 | 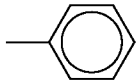 | 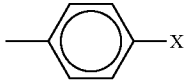 | 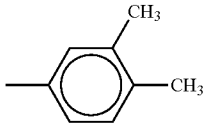 | 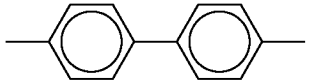 | $—CH{=}CH(CH_2)_2—$ $—Si(OMe)_3$ |

TABLE 18
| COMPOUNDS | k | $Ar^1$ | $Ar^2$ | $Ar^3$ | $Ar^4$ | $Ar^5$ | X |
|---|---|---|---|---|---|---|---|
| 86 | 1 | 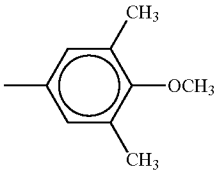 | 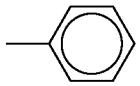 | 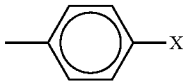 | 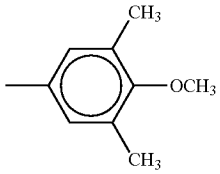 | 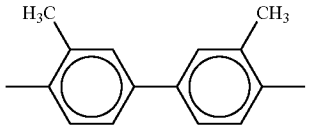 | —CH═CH$(CH_2)_2$— —Si$(OMe)_3$ |
| 87 | 1 | 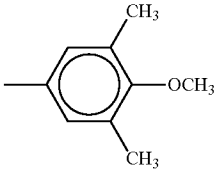 | 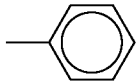 | 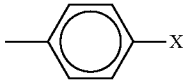 | 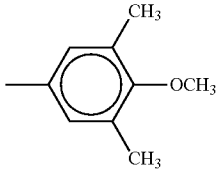 | 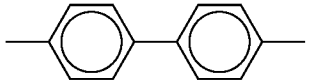 | —CH═CH$(CH_2)_2$— —Si$(OMe)_3$ |
| 88 | 1 | 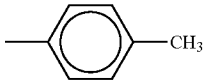 | 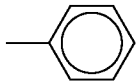 | 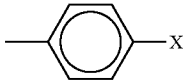 | 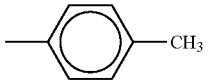 | 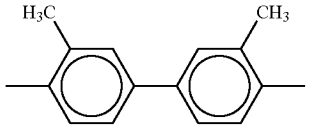 | —CH═CH$(CH_2)_2$— —Si$(OMe)_3$ |
| 89 | 0 | 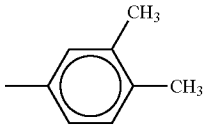 | 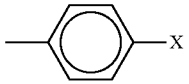 | — | — | 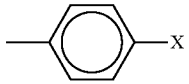 | —$(CH_2)_2$Si$(OEt)_3$ |
| 90 | 0 | 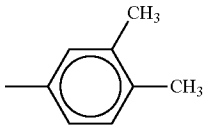 | 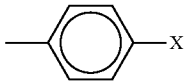 | — | — | 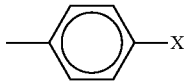 | —$(CH_2)_3$Si$(OEt)_3$ |

TABLE 19
| COMPOUNDS | k | $Ar^1$ | $Ar^2$ | $Ar^3$ | $Ar^4$ | $Ar^5$ | X |
|---|---|---|---|---|---|---|---|
| 91 | 0 | 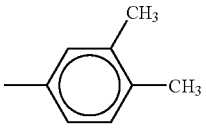 | 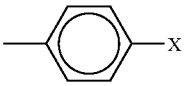 | — | — | 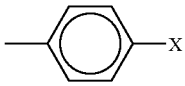 | —$(CH_2)_3$— —$Si(OMe)_2Me$ |
| 92 | 0 | 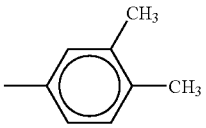 | 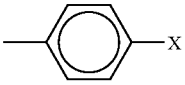 | — | — | 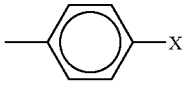 | —$(CH_2)_4Si(OMe)_3$ |
| 93 | 0 | 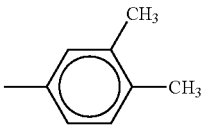 | 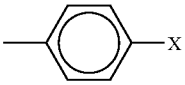 | — | — | 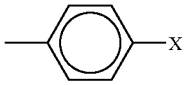 | —$(CH_2)_{12}Si(OMe)_3$ |
| 94 | 0 | 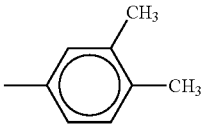 | 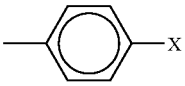 | — | — | 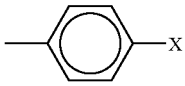 | —$(CH_2)_4Si(OEt)_3$ |
| 95 | 0 | 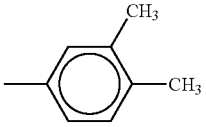 | 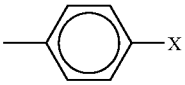 | — | — | 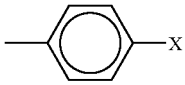 | —$(CH_2)_2C_6H_4$— —$Si(OMe)_3$ |
TABLE 20
| COMPOUNDS | k | $Ar^1$ | $Ar^2$ | $Ar^3$ | $Ar^4$ | $Ar^5$ | X |
|---|---|---|---|---|---|---|---|
| 96 | 0 | 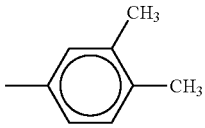 | 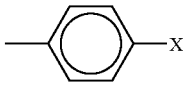 | — | — | 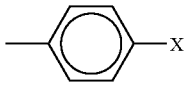 | —$(CH_2)_2C_6H_4$— —$(CH_2)_2Si(OMe)_3$ |
| 97 | 0 | 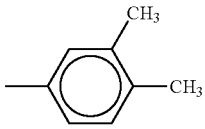 | 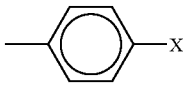 | — | — | 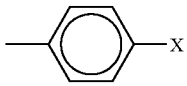 | —$(CH_2)_4Si(OMe)_3$ |
| 98 | 0 | 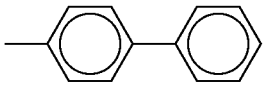 | 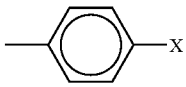 | — | — | 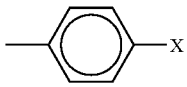 | —$(CH_2)_4Si(OMe)_3$ |
| 99 | 0 | 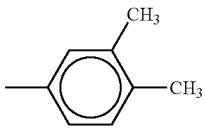 | 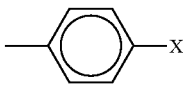 | — | — | 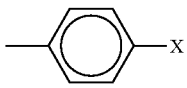 | —CH═CHSi$(OEt)_3$ |
| 100 | 0 | 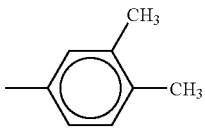 | 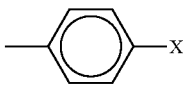 | — | — | 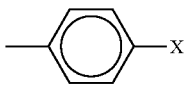 | —CH═$CHCH_2$— —$Si(OMe)_2Me$ |

TABLE 21
| COM-POUNDS | k | $Ar^1$ | $Ar^2$ | $Ar^3$ | $Ar^4$ | $Ar^5$ | X |
|---|---|---|---|---|---|---|---|
| 101 | 0 | 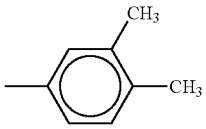 | 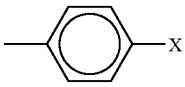 | — | — | 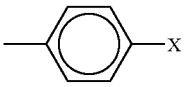 | —CH═CH$(CH_2)_2$— —Si$(OMe)_3$ |
| 102 | 0 | 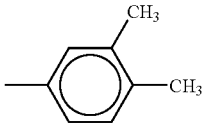 | 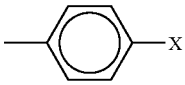 | — | — | 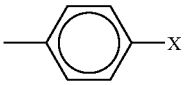 | —CH═CH$(CH_2)_2$— —Si$(OMe)_2$Me |
| 103 | 0 | 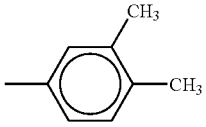 | 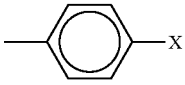 | — | — | 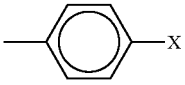 | —CH═CH$(CH_2)_2$— —$SiMe_2$(OMe) |
| 104 | 0 | 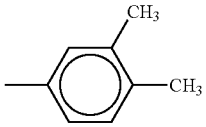 | 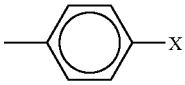 | — | — | 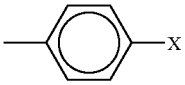 | —CH═CH$(CH_2)_2$— —Si$(OEt)_3$ |
| 105 | 0 | 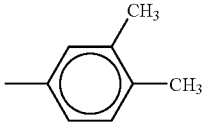 | 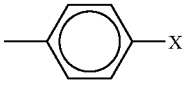 | — | — | 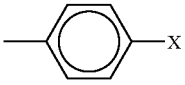 | —CH═CH$(CH_2)_{10}$— —Si$(OMe)_3$ |
TABLE 22
| COM-POUNDS | k | $Ar^1$ | $Ar^2$ | $Ar^3$ | $Ar^4$ | $Ar^5$ | X |
|---|---|---|---|---|---|---|---|
| 106 | 0 | 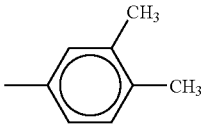 | 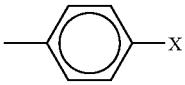 | — | — | 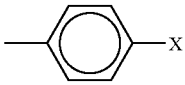 | —CH═CH$C_6H_4$— —Si$(OMe)_3$ |
| 107 | 0 | 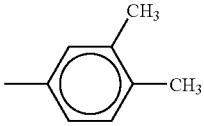 | 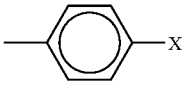 | — | — | 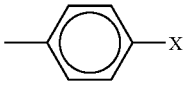 | —CH═CH$C_6H_4$— —$(CH_2)_2$Si$(OMe)_3$ |
| 108 | 0 | 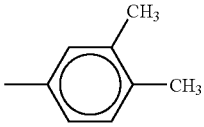 | 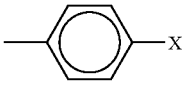 | — | — | 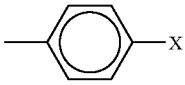 | —CH═CH$(CH_2)_2$— —Si$(OMe)_3$ |
| 109 | 0 | 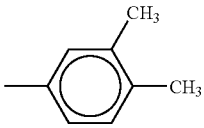 | 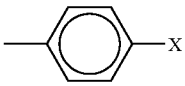 | — | — | 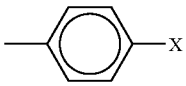 | —CH═N$(CH_2)_3$— —Si$(OMe)_3$ |

TABLE 22-continued
| COM-POUNDS | k | $Ar^1$ | $Ar^2$ | $Ar^3$ | $Ar^4$ | $Ar^5$ | X |
|---|---|---|---|---|---|---|---|
| 110 | 0 | 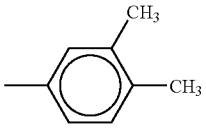 | 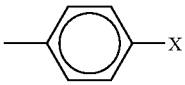 | — | — | 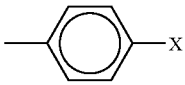 | —CH═N$(CH_2)_3$— —Si$(OEt)_3$ |
TABLE 23
| COM-POUNDS | k | $Ar^1$ | $Ar^2$ | $Ar^3$ | $Ar^4$ | $Ar^5$ | X |
|---|---|---|---|---|---|---|---|
| 111 | 0 | 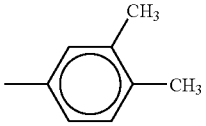 | 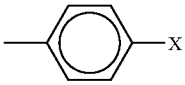 | — | — | 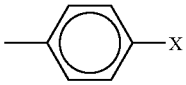 | —CH═$NCH_2$— —Si$(OMe)_2$Me |
| 112 | 0 | 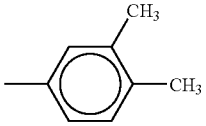 | 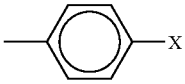 | — | — | 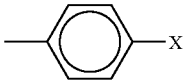 | —CH═$NC_8H_4$— —$(CH_2)_2$Si$(OMe)_3$ |
| 113 | 0 | 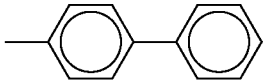 | 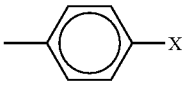 | — | — | 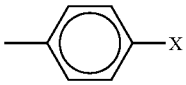 | —CH═$N(CH_2)_3$— —Si$(OMe)_3$) |
| 114 | 0 | 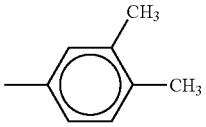 | 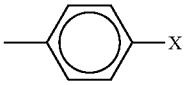 | — | — | 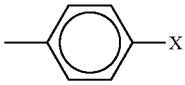 | —O$(CH_2)_3$Si$(OMe)_3$ |
| 115 | 0 | 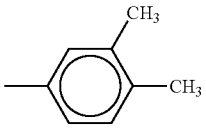 | 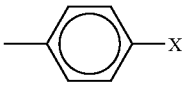 | — | — | 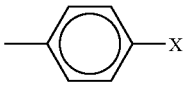 | —O$(CH_2)_3$Si$(OEt)_3$ |
TABLE 24
| COM-POUNDS | k | $Ar^1$ | $Ar^2$ | $Ar^3$ | $Ar^4$ | $Ar^5$ | X |
|---|---|---|---|---|---|---|---|
| 116 | 0 | 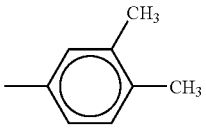 | 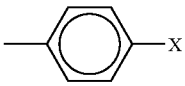 | — | — | 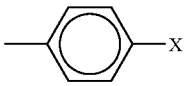 | —$CH_2O(CH_2)_3$— —Si$(OMe)_3$ |
| 117 | 0 | 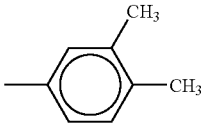 | 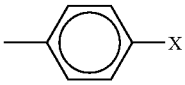 | — | — | 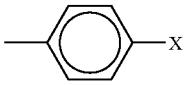 | —$(CH_2)_3O(CH_2)_3$— —Si$(OMe)_3$ |
| 118 | 0 | 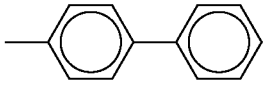 | 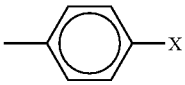 | — | — | 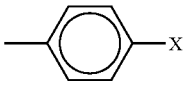 | —$CH_2O(CH_2)_3$— —Si$(OMe)_3$ |

TABLE 24-continued

| COMPOUNDS | k | $Ar^1$ | $Ar^2$ | $Ar^3$ | $Ar^4$ | $Ar^5$ | X |
|---|---|---|---|---|---|---|---|
| 119 | 0 | 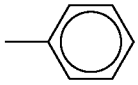 | 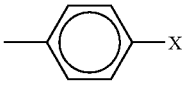 | — | — | 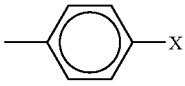 | —$CH_2COO(CH_2)_3$— —$Si(OMe)_3$ |
| 120 | 0 | 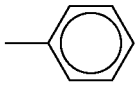 | 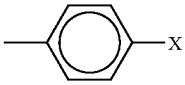 | — | — | 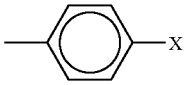 | —$(CH_2)_2COO$— —$(CH_2)_3Si(OMe)_3$ |

TABLE 25

| COMPOUNDS | k | $Ar^1$ | $Ar^2$ | $Ar^3$ | $Ar^4$ | $Ar^5$ | X |
|---|---|---|---|---|---|---|---|
| 121 | 0 | 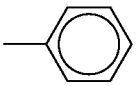 | 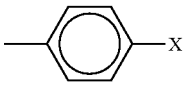 | — | — | 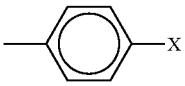 | —$(CH_2)_2COO$— —$CH_2C_6H_4(CH_2)_2$— —$Si(OMe)_3$ |
| 122 | 0 | 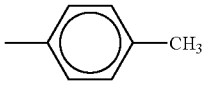 | 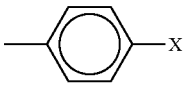 | — | — | 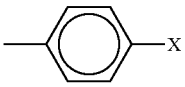 | —$(CH_2)_2COO$— —$CH_2C_6H_4(CH_2)_2$— —$Si(OMe)_3$ |
| 123 | 0 | 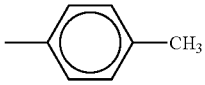 | 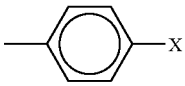 | — | — | 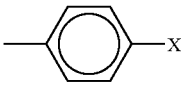 | —$(CH_2)_2COO$— —$(CH_2)_3Si(OMe)_3$ |
| 124 | 0 | 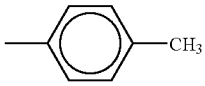 | 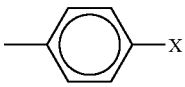 | — | — | 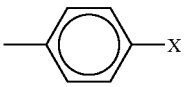 | —$(CH_2)_2COO$— —$CH_2C_6H_4(CH_2)_2$— —$Si(OMe)_3$ |
| 125 | 0 | 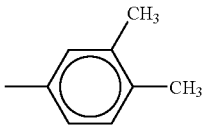 | 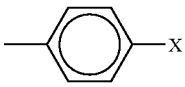 | — | — | 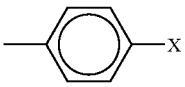 | —$CH_2COO$— —$CH_2C_6H_4(CH_2)_2$— —$Si(OMe)_3$ |

TABLE 26

| COMPOUNDS | k | $Ar^1$ | $Ar^2$ | $Ar^3$ | $Ar^4$ | $Ar^5$ | X |
|---|---|---|---|---|---|---|---|
| 126 | 0 | 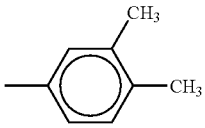 | 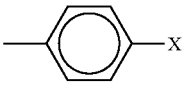 | — | — | 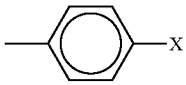 | —$(CH_2)_2COO$— —$(CH_2)_3Si(OMe)_3$ |
| 127 | 0 | 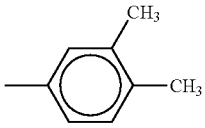 | 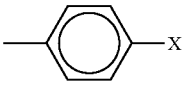 | — | — | 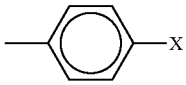 | —$(CH_2)_2COO$— —$CH_2C_6H_4Si(OMe)_3$ |
| 128 | 0 | 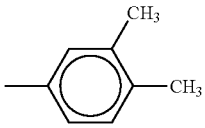 | 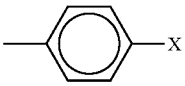 | — | — | 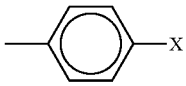 | —$(CH_2)_2COO$— —$CH_2C_6H_4(CH_2)_2$— —$Si(OMe)_3$ |
| 129 | 0 | 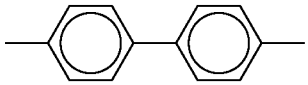 | 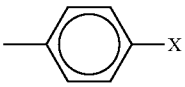 | — | — | 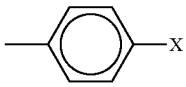 | —$CH_2COO(CH_2)_3$— —$Si(OMe)_3$ |

TABLE 26-continued
| COM-POUNDS | k | $Ar^1$ | $Ar^2$ | $Ar^3$ | $Ar^4$ | $Ar^5$ | X |
|---|---|---|---|---|---|---|---|
| 130 | 0 | 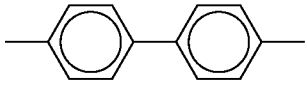 | 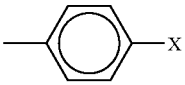 | — | — | 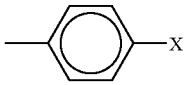 | —$(CH_2)_2COO$— —$(CH_2)_3Si(OMe)_3$ |
TABLE 27
| COM-POUNDS | k | $Ar^1$ | $Ar^2$ | $Ar^3$ |
|---|---|---|---|---|
| 131 | 0 | 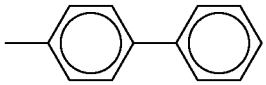 | 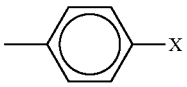 | — |
| 132 | 0 | 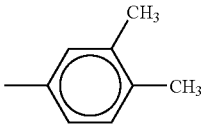 | 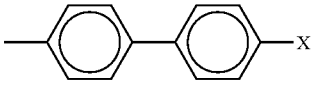 | — |
| 133 | 0 | 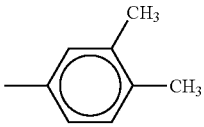 | 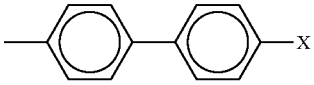 | — |
| 134 | 0 | 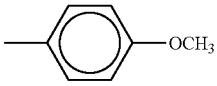 | 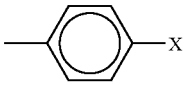 | — |
| 135 | 0 | 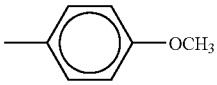 | 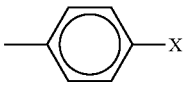 | — |
| COM-POUNDS | $Ar^4$ | $Ar^5$ | X |
|---|---|---|---|
| 131 | — | 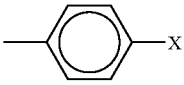 | —$(CH_2)_2COO$— —$CH_2C_6H_4(CH_2)_2$— —$Si(OMe)_3$ |
| 132 | — | 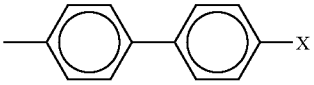 | —$COO(CH_2)_3$— —$Si(OMe)_3$ |
| 133 | — | 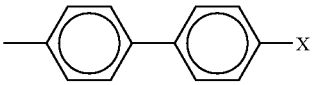 | —$COOCH_2C_6H_4$— —$(CH_2)_2Si(OMe)_3$ |
| 134 | — | 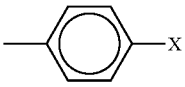 | —$CH_2COO$— —$CH_2C_6H_4(CH_2)_2$— —$Si(OMe)_3$ |
| 135 | — | 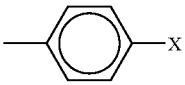 | —$(CH_2)_2COO$— —$(CH_2)_3Si(OMe)_3$ |

TABLE 28
| COMPOUNDS | k | $Ar^1$ | $Ar^2$ | $Ar^3$ | $Ar^4$ | $Ar^5$ | X |
|---|---|---|---|---|---|---|---|
| 136 | 0 | 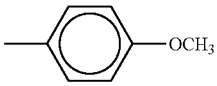 | 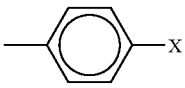 | — | — | 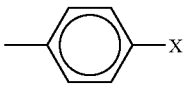 | —$(CH_2)_2COO$—<br>—$CH_2C_6H_4(CH_2)_2$—<br>—$Si(OMe)_3$ |
| 137 | 0 | 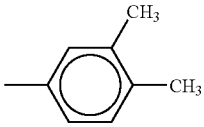 | 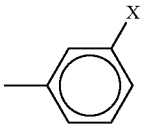 | — | — | 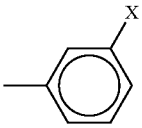 | —$(CH_2)_2COO$—<br>—$(CH_2)_3Si(OMe)_3$ |
| 138 | 0 | 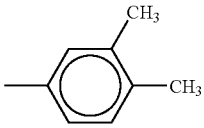 | 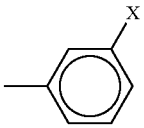 | — | — | 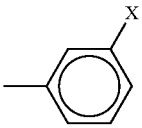 | —$(CH_2)_2COO$—<br>—$CH_2C_6H_4Si(OMe)_3$ |
| 139 | 0 | 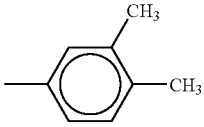 | 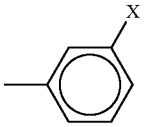 | — | — | 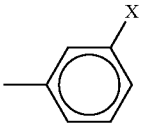 | —$(CH_2)_2COO$—<br>—$CH_2C_6H_4(CH_2)_2$—<br>—$Si(OMe)_3$ |
| 140 | 0 | 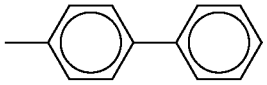 | 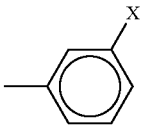 | — | — | 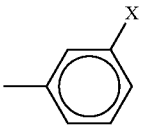 | —$CH_2COO(CH_2)_3$—<br>—$Si(OMe)_3$ |
TABLE 29
| COMPOUNDS | k | $Ar^1$ | $Ar^2$ | $Ar^3$ |
|---|---|---|---|---|
| 141 | 0 | 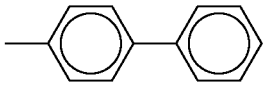 | 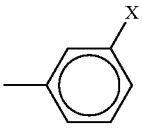 | — |
| 142 | 0 | 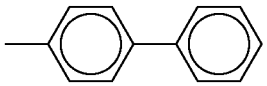 | 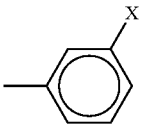 | — |
| 143 | 1 | 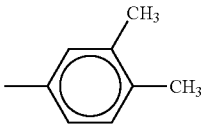 | 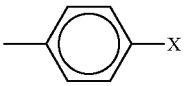 | 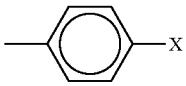 |
| 144 | 1 | 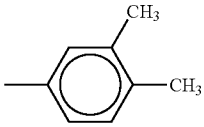 | 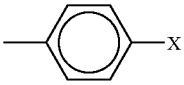 | 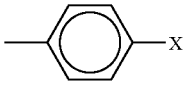 |
| 145 | 1 | 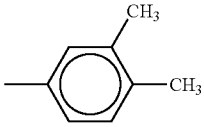 | 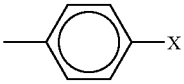 | 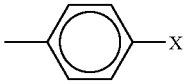 |

TABLE 29-continued
| COM-POUNDS | $Ar^4$ | $Ar^5$ | X |
|---|---|---|---|
| 141 | — | 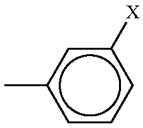 | —$(CH_2)_2COO$— —$(CH_2)_3Si(OMe)_3$ |
| 142 | — | 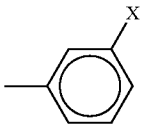 | —$(CH_2)_2COO$— —$CH_2C_6H_4(CH_2)_2$— —$Si(OMe)_3$ |
| 143 | 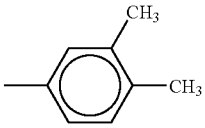 | 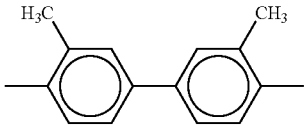 | —$(CH_2)_2Si(OEt)_3$ |
| 144 | 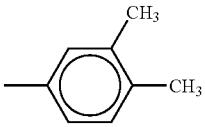 | 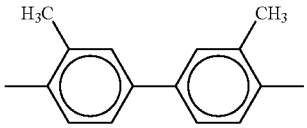 | —$(CH_2)_3Si(OEt)_3$ |
| 145 | 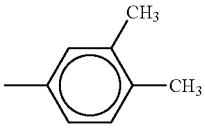 | 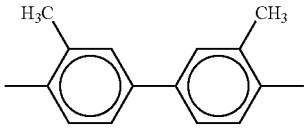 | —$(CH_2)_4Si(OMe)_3$ |
TABLE 30
| COM-POUNDS | k | $Ar^1$ | $Ar^2$ | $Ar^3$ | $Ar^4$ |
|---|---|---|---|---|---|
| 146 | 1 | 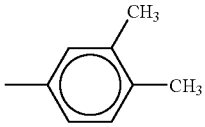 | 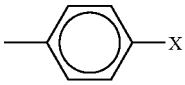 | 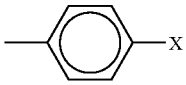 | 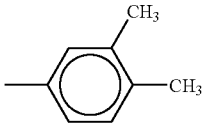 |
| 147 | 1 | 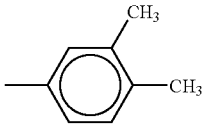 | 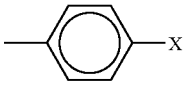 | 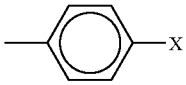 | 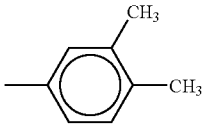 |
| 148 | 1 | 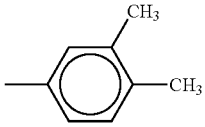 | 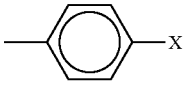 | 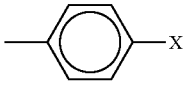 | 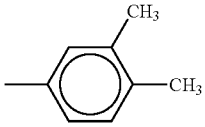 |
| 149 | 1 | 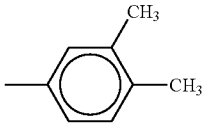 | 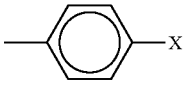 | 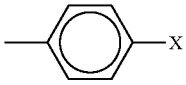 | 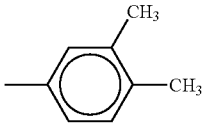 |

TABLE 30-continued
| | | | | |
|---|---|---|---|---|
| 150 | 1 | 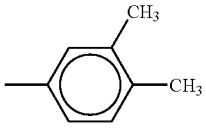 | 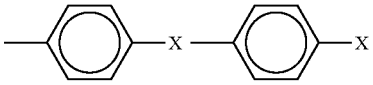 | 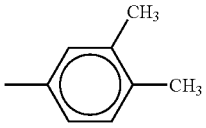 |
| COMPOUNDS | $Ar^5$ | X |
|---|---|---|
| 146 | 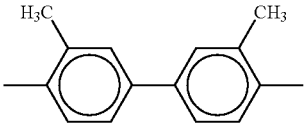 | —$(CH_2)_4$— —$SiMe(OMe)_2$ |
| 147 | 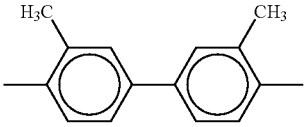 | —$(CH_2)_4$— —$SiMe_2(OMe)$ |
| 148 | 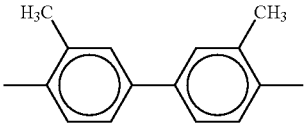 | —$(CH_2)_4Si(OEt)_3$ |
| 149 | 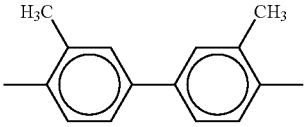 | —$(CH_2)_2C_6H_4$ — —$Si(OMe)_3$ |
| 150 | 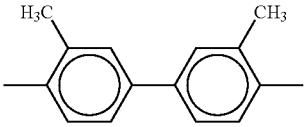 | —$(CH_2)_2C_6H_4$ — —$(CH_2)_2Si(OMe)_3$ |

TABLE 31
| COMPOUNDS | k | $Ar^1$ | $Ar^2$ | $Ar^3$ | $Ar^4$ | $Ar^5$ | X |
|---|---|---|---|---|---|---|---|
| 151 | 1 | 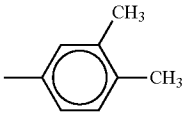 | 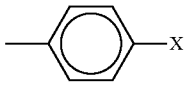 | 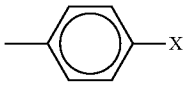 | 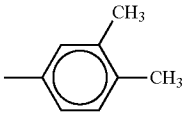 | 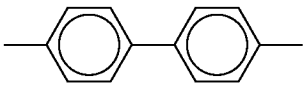 | —$(CH_2)_3$—<br>—$Si(OMe)_2Me$ |
| 152 | 1 | 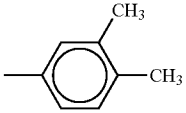 | 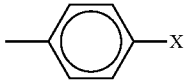 | 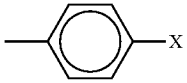 | 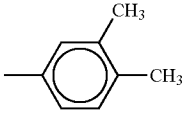 | 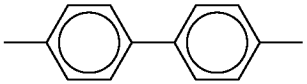 | —$(CH_2)_4Si(OMe)_3$ |
| 153 | 1 | 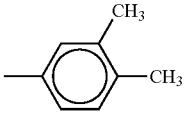 | 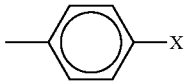 | 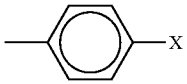 | 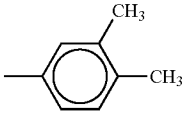 | 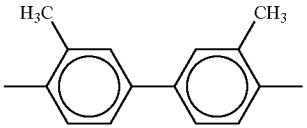 | —CH═$CHSi(OEt)_3$ |
| 154 | 1 | 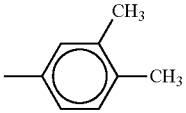 | 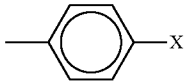 | 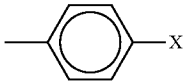 | 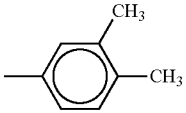 | 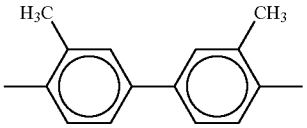 | —CH═$CHCH_2$—<br>—$Si(OMe)_2Me$ |
| 155 | 1 | 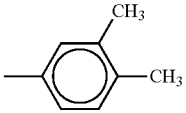 | 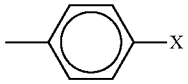 | 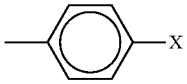 | 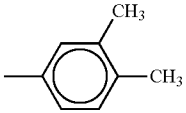 | 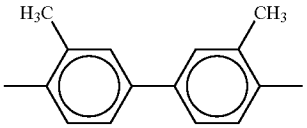 | —CH═$CH(CH_2)_2$—<br>—$Si(OMe)_2$ |

TABLE 32
| COMPOUNDS | k | $Ar^1$ | $Ar^2$ | $Ar^3$ | $Ar^4$ | $Ar^5$ | X |
|---|---|---|---|---|---|---|---|
| 156 | 1 | 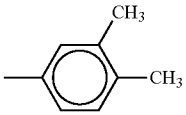 | 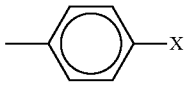 | 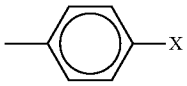 | 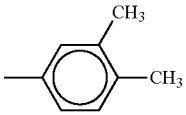 | 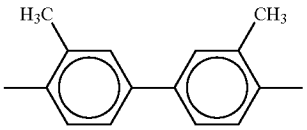 | —CH═CH$(CH_2)_2$— —SiMe$(OMe)_2$ |
| 157 | 1 | 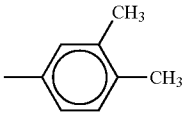 | 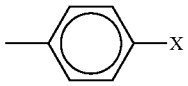 | 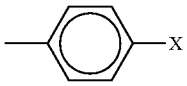 | 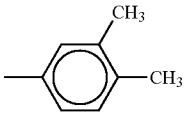 | 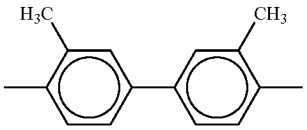 | —CH═CH$(CH_2)_2$— —$SiMe_2$(OMe) |
| 158 | 1 | 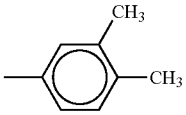 | 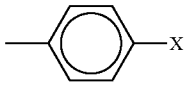 | 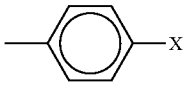 | 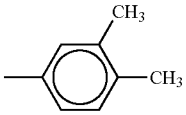 | 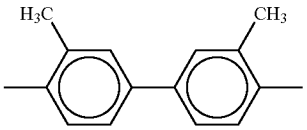 | —CH═CH$(CH_2)_2$— —Si$(OEt)_3$ |
| 159 | 1 | 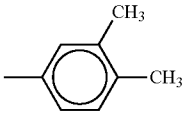 | 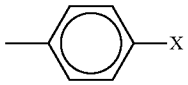 | 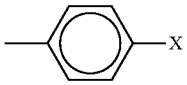 | 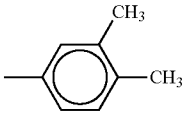 | 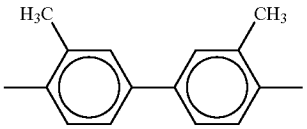 | —CH═$CHC_6H_4$— —Si$(OMe)_3$ |
| 160 | 0 | 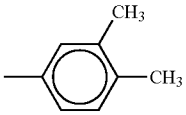 | 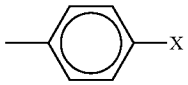 | 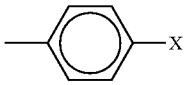 | 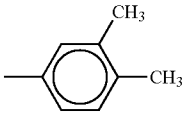 | 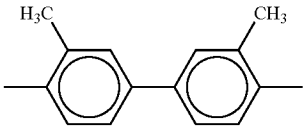 | —CH═$CHC_6H_4$— —$(CH_2)_2$Si$(OMe)_3$ |

TABLE 33
| COMPOUNDS | k | $Ar^1$ | $Ar^2$ | $Ar^3$ | $Ar^4$ | $Ar^5$ | X |
|---|---|---|---|---|---|---|---|
| 161 | 1 | 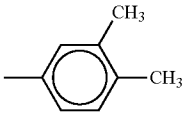 | 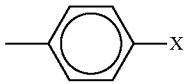 | 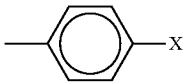 | 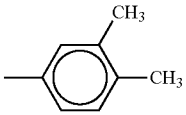 | 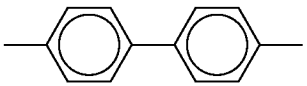 | —CH═CHCH$_2$— —Si(OMe)$_2$Me |
| 162 | 1 | 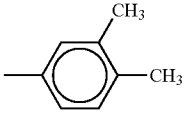 | 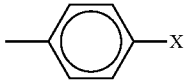 | 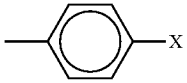 | 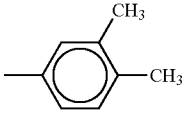 | 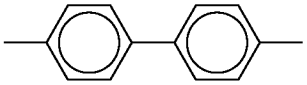 | —CH═CH(CH$_2$)$_2$— —Si(OMe)$_3$ |
| 163 | 1 | 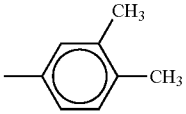 | 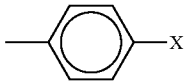 | 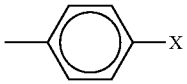 | 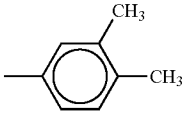 | 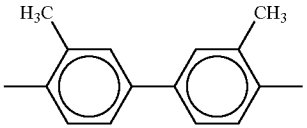 | —CH═NCH$_2$— —Si(OMe)$_2$Me |
| 164 | 1 | 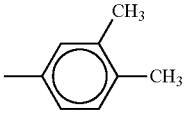 | 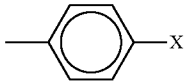 | 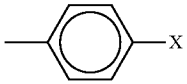 | 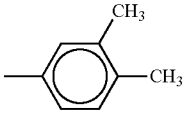 | 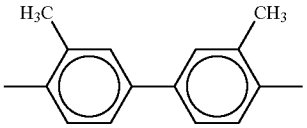 | —CH═N(CH$_2$)$_2$— —Si(OEt)$_3$ |
| 165 | 1 | 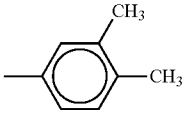 | 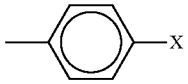 | 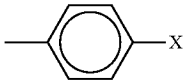 | 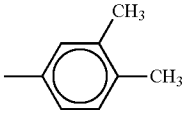 | 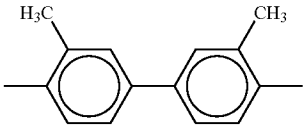 | —CH═N(CH$_2$)$_3$— —Si(OMe)$_3$ |

TABLE 34
| COMPOUNDS | k | $Ar^1$ | $Ar^2$ | $Ar^3$ | $Ar^4$ | $Ar^5$ | X |
|---|---|---|---|---|---|---|---|
| 166 | 1 | 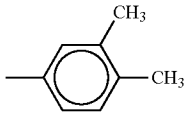 | 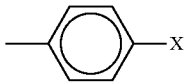 | 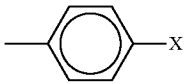 | 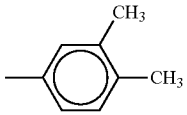 | 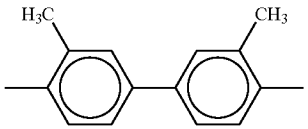 | 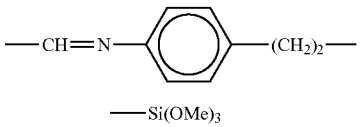 |
| 167 | 1 | 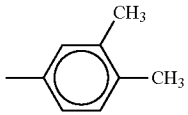 | 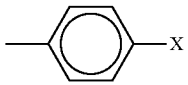 | 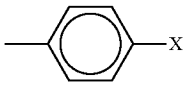 | 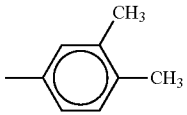 | 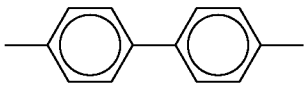 | —CH═NCH$_2$— —Si(OMe)$_2$Me |
| 168 | 1 | 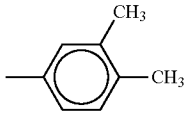 | 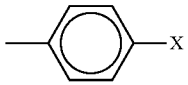 | 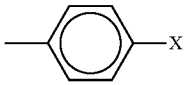 | 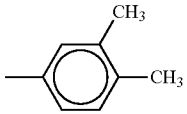 | 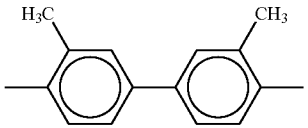 | —O(CH$_2$)$_3$Si(OMe)$_3$ |
| 169 | 1 | 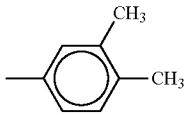 | 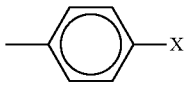 | 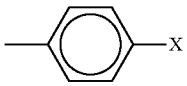 | 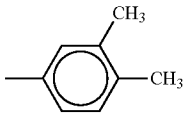 | 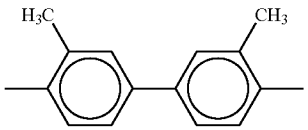 | —O(CH$_2$)$_3$— —SiMe(OMe)$_2$ |
| 170 | 1 | 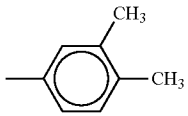 | 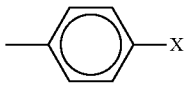 | 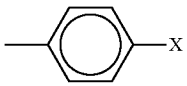 | 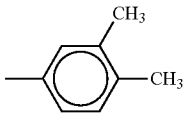 | 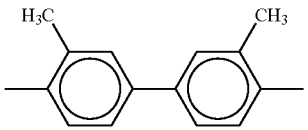 | —O(CH$_2$)$_3$Si(OEt)$_3$ |

TABLE 35
| COMPOUNDS | k | $Ar^1$ | $Ar^2$ | $Ar^3$ | $Ar^4$ | $Ar^5$ | X |
|---|---|---|---|---|---|---|---|
| 171 | 1 | 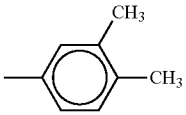 | 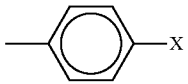 | 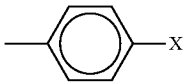 | 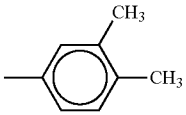 | 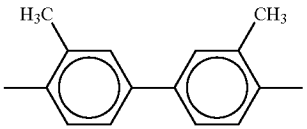 | —$CH_2O(CH_2)_3$—<br>—$Si(OMe)_3$ |
| 172 | 1 | 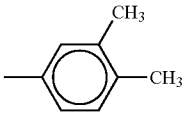 | 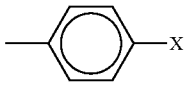 | 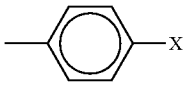 | 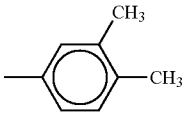 | 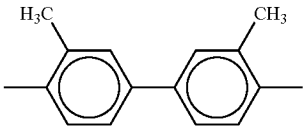 | —$(CH_2)_3O(CH_2)_3$—<br>—$Si(OMe)_3$ |
| 173 | 1 | 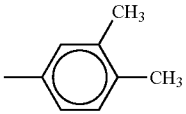 | 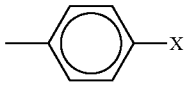 | 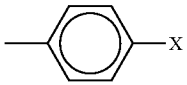 | 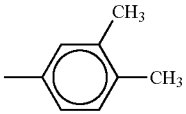 | 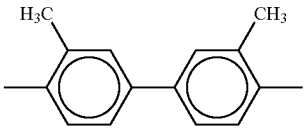 | —$COO(CH_2)_3$—<br>—$Si(OMe)_3$ |
| 174 | 1 | 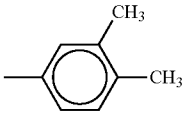 | 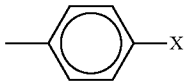 | 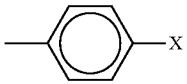 | 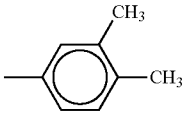 | 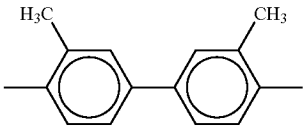 | —$COOCH_2C_6H_4$—<br>—$(CH_2)_2Si(OMe)_3$ |
| 175 | 1 | 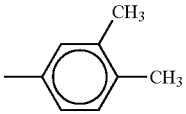 | 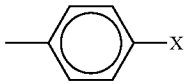 | 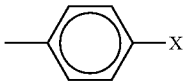 | 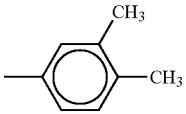 | 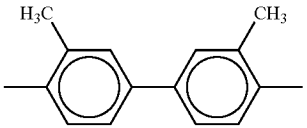 | —$CH_2COO(CH_2)_3$—<br>—$Si(OMe)_3$ |

TABLE 36
| COMPOUNDS | k | $Ar^1$ | $Ar^2$ | $Ar^3$ | $Ar^4$ | $Ar^5$ | X |
|---|---|---|---|---|---|---|---|
| 176 | 1 | 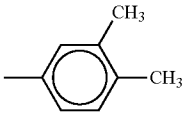 | 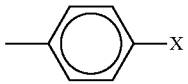 | 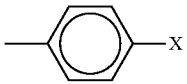 | 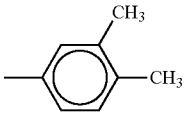 | 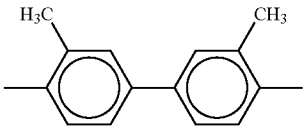 | —$CH_2COO$—<br>—$CH_2C_6H_4(CH_2)_2$—<br>—$Si(OMe)_3$ |
| 177 | 1 | 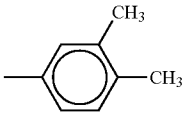 | 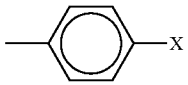 | 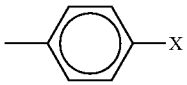 | 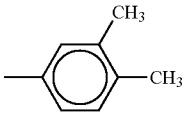 | 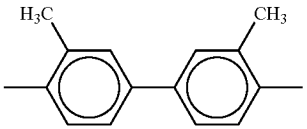 | —$(CH_2)_2COO$—<br>—$(CH_2)_3Si(OMe)_3$ |
| 178 | 1 | 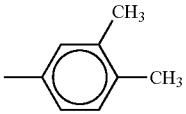 | 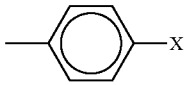 | 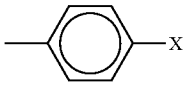 | 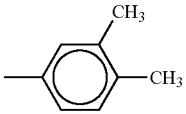 | 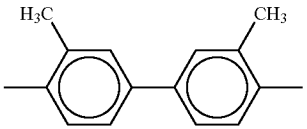 | —$(CH_2)_2COO$—<br>—$CH_2C_6H_4(CH_2)_2$—<br>—$Si(OMe)_3$ |
| 179 | 1 | 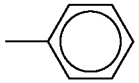 | 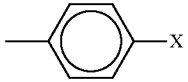 | 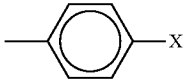 | 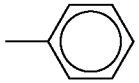 | 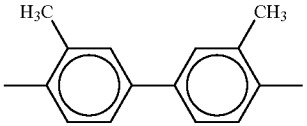 | —$COOCH_2C_6H_4$—<br>—$(CH_2)_2Si(OMe)_3$ |
| 180 | 1 | 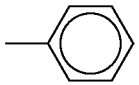 | 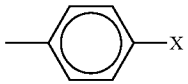 | 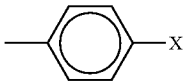 | 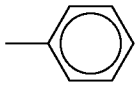 | 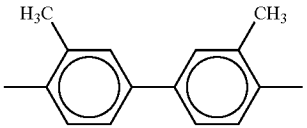 | —$CH_2COO(CH_2)_3$—<br>—$Si(OMe)_3$ |

TABLE 37
| COMPOUNDS | k | $Ar^1$ | $Ar^2$ | $Ar^3$ | $Ar^4$ | $Ar^5$ | X |
|---|---|---|---|---|---|---|---|
| 181 | 1 | 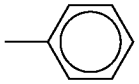 | 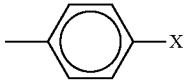 | 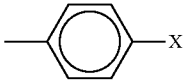 | 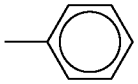 | 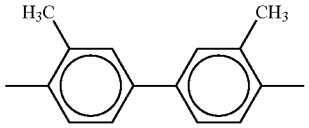 | —$CH_2COOCH_2$—<br>—$C_6H_4Si(OMe)_3$ |
| 182 | 1 | 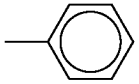 | 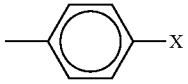 | 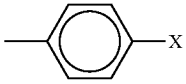 | 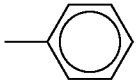 | 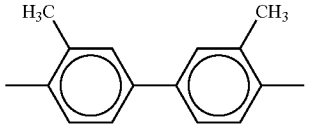 | —$CH_2COO$—<br>—$CH_2C_6H_4(CH_2)_2$—<br>—$Si(OMe)_3$ |
| 183 | 1 | 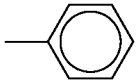 | 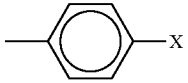 | 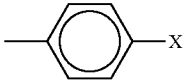 | 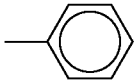 | 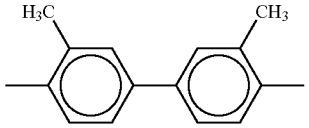 | —$(CH_2)_2COO$—<br>—$(CH_2)_3Si(OMe)_3$ |
| 184 | 1 | 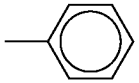 | 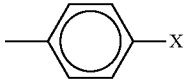 | 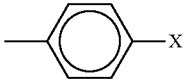 | 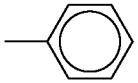 | 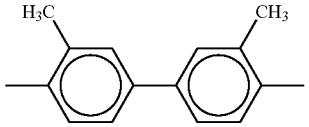 | —$(CH_2)_2COO$—<br>—$CH_2C_6H_4(CH_2)_2$—<br>—$Si(OMe)_3$ |
| 185 | 1 | 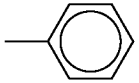 | 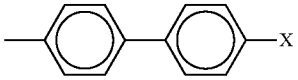 | 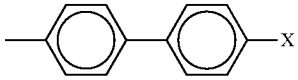 | 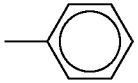 | 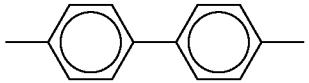 | —$COO(CH_2)_3$—<br>—$Si(OMe)_3$ |

TABLE 38
| COM-POUNDS | k | $Ar^1$ | $Ar^2$ | $Ar^3$ | $Ar^4$ | $Ar^5$ | X |
|---|---|---|---|---|---|---|---|
| 186 | 1 | 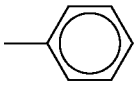 | 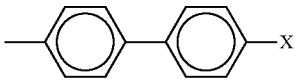 | 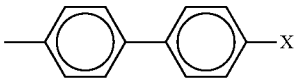 | 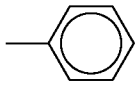 | 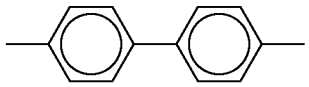 | —$COOCH_2C_6H_4$— —$Si(OMe)_3$ |
| 187 | 1 | 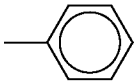 | 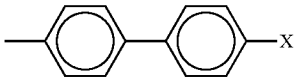 | 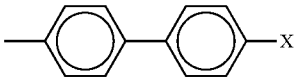 | 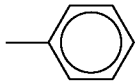 | 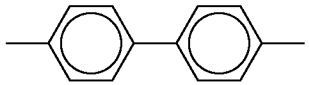 | —$COOCH_2C_6H_4$— —$(CH_2)_2Si(OMe)_3$ |
| 188 | 1 | 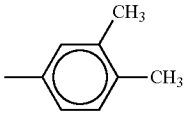 | 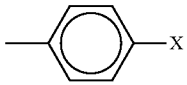 | 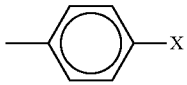 | 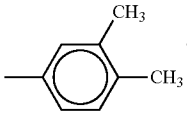 | 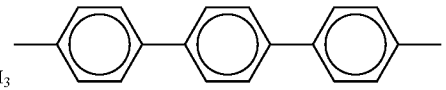 | —$COO(CH_2)_3$— —$Si(OMe)_3$ |
| 189 | 1 | 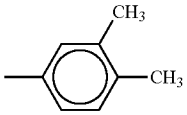 | 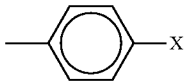 | 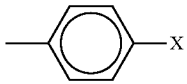 | 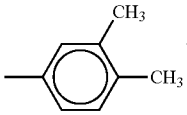 | 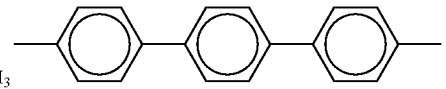 | —$COOCH_2C_6H_4$— —$Si(OMe)_3$ |
| 190 | 1 | 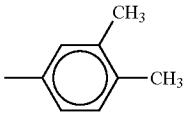 | 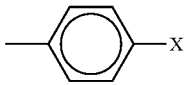 | 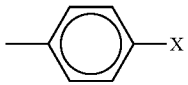 | 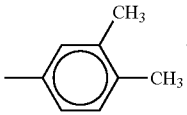 | 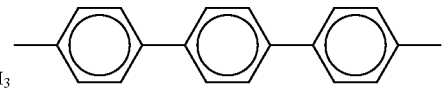 | —$COOCH_2C_6H_4$— —$(CH_2)_2Si(OMe)_3$ |

TABLE 39
| COMPOUNDS | k | $Ar^1$ | $Ar^2$ | $Ar^3$ | $Ar^4$ | $Ar^5$ | X |
|---|---|---|---|---|---|---|---|
| 191 | 1 | 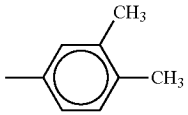 | 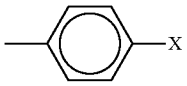 | 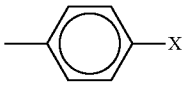 | 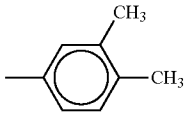 | 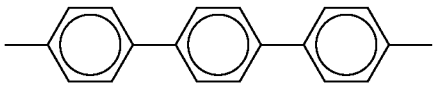 | —$CH_2COO(CH_2)_3$— —$Si(OMe)_3$ |
| 192 | 1 | 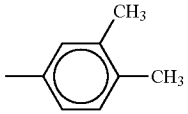 | 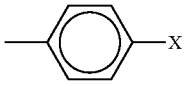 | 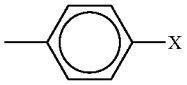 | 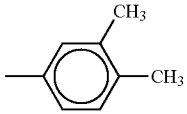 | 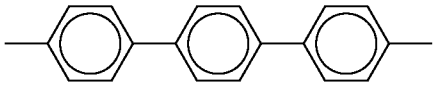 | —$(CH_2)_2COO$— —$(CH_2)_3Si(OMe)_3$ |
| 193 | 1 | 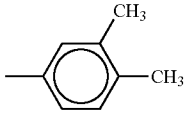 | 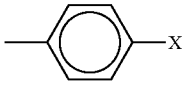 | 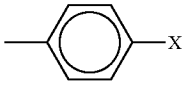 | 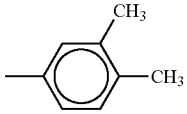 | 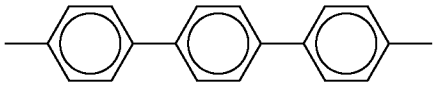 | —$(CH_2)_2COO$— —$CH_2C_6H_4(CH_2)_2$— —$Si(OMe)_3$ |
| 194 | 0 | 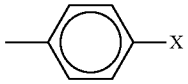 | 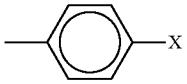 | — | — | 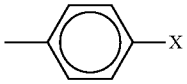 | —$(CH_2)_3$— —$Si(OMe)_2Me$ |
| 195 | 0 | 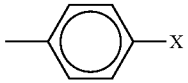 | 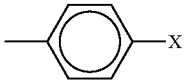 | — | — | 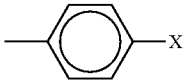 | —$(CH_2)_3Si(OEt)_3$ |

TABLE 40
| COMPOUNDS | k | $Ar^1$ | $Ar^2$ | $Ar^3$ | $Ar^4$ | $Ar^5$ | X |
|---|---|---|---|---|---|---|---|
| 196 | 0 | 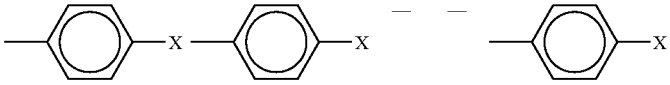 | | — | — | | $—(CH_2)_4Si(OMe)_3$ |
| 197 | 0 | 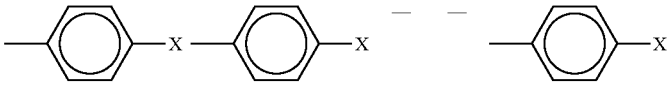 | | — | — | | $—(CH_2)_4—$ $—Si(OMe)_2Me$ |
| 198 | 0 | 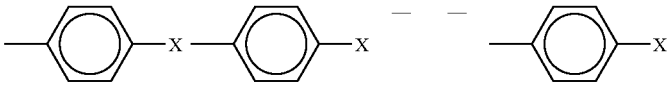 | | — | — | | $—(CH_2)_4SiMe_2(OMe)$ |
| 199 | 0 | 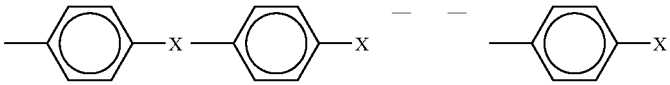 | | — | — | | $—(CH_2)_4Si(OEt)_3$ |
| 200 | 0 | 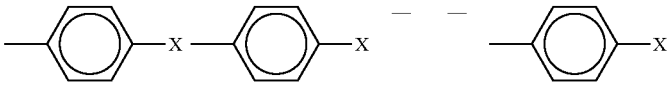 | | — | — | | $—(CH_2)_{12}Si(OMe)_3$ |
TABLE 41
| COM-POUNDS | k | $Ar^1$ | $Ar^2$ | $Ar^3$ | $Ar^4$ | $Ar^5$ | X |
|---|---|---|---|---|---|---|---|
| 201 | 0 | 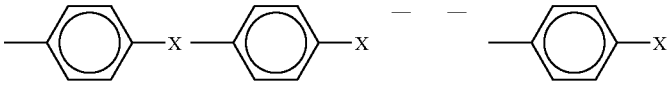 | | — | — | | $—(CH_2)_2C_6H_4—$ $—Si(OMe)_3$ |
| 202 | 0 | 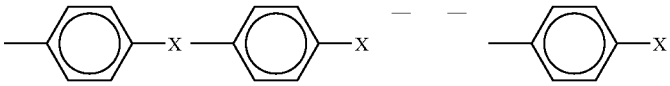 | | — | — | | $—(CH_2)_2C_6H_4—$ $—(CH_2)_2Si(OMe)_3$ |
| 203 | 0 | 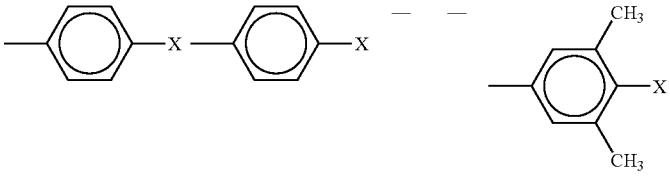 | | — | — | | $—(CH_2)_4Si(OMe)_3$ |
| 204 | 0 | 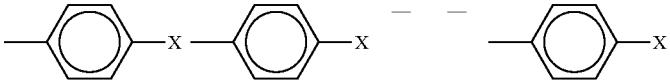 | | — | — | | $—CH═CHSi(OMe)_3$ |
| 205 | 0 | 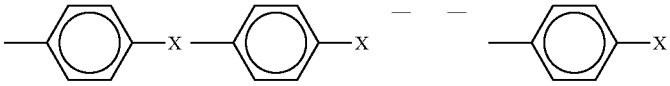 | | — | — | | $—CH═CHCH_2—$ $—Si(OMe)_2Me$ |
TABLE 42
| COM-POUNDS | k | $Ar^1$ | $Ar^2$ | $Ar^3$ | $Ar^4$ | $Ar^5$ | X |
|---|---|---|---|---|---|---|---|
| 206 | 0 | 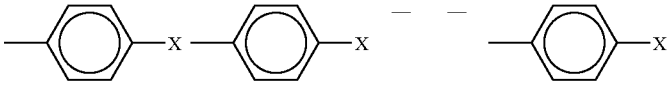 | | — | — | | $—CH═CH(CH_2)_2—$ $—Si(OMe)_3$ |
| 207 | 0 | 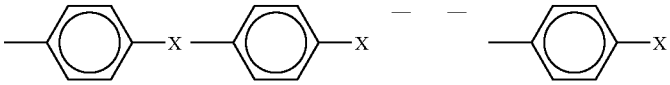 | | — | — | | $—CH═CH(CH_2)_2—$ $—SiMe(OMe)_2$ |

TABLE 42-continued

| COM-POUNDS | k | $Ar^1$ | $Ar^2$ | $Ar^3$ | $Ar^4$ | $Ar^5$ | X |
|---|---|---|---|---|---|---|---|
| 208 | 0 | 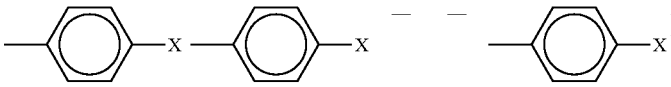 | | — | — | | —CH═CH$(CH_2)_2$— —$SiMe_2$(OMe) |
| 209 | 0 | 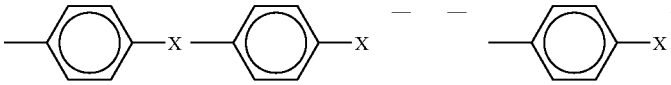 | | — | — | | —CH═CH$(CH_2)_2$— —Si$(OEt)_3$ |
| 210 | 0 | 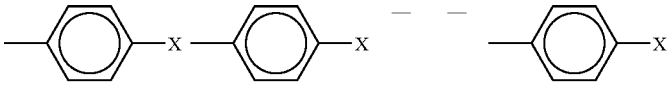 | | — | — | | —CH═CH$(CH_2)_{10}$— —Si$(OMe)_3$ |

TABLE 43

| COM-POUNDS | k | $Ar^1$ | $Ar^2$ | $Ar^3$ | $Ar^4$ | $Ar^5$ | X |
|---|---|---|---|---|---|---|---|
| 211 | 0 | 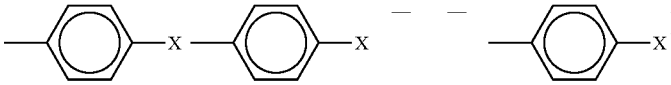 | | — | — | | —CH═CH$C_6H_4$— —Si$(OMe)_3$ |
| 212 | 0 | 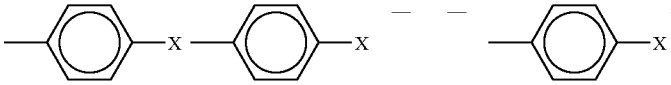 | | — | — | | —CH═CH$C_6H_4$— —$(CH_2)_2$Si$(OMe)_3$ |
| 213 | 0 | 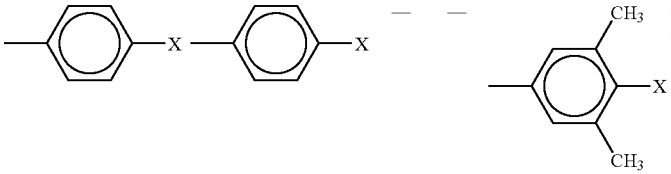 | | — | — | | —CH═CH$(CH_2)_2$— —Si$(OMe)_3$ |
| 214 | 0 | 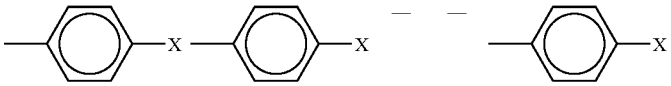 | | — | — | | —CH═N$(CH_2)_3$— —Si$(OMe)_3$ |
| 215 | 0 | 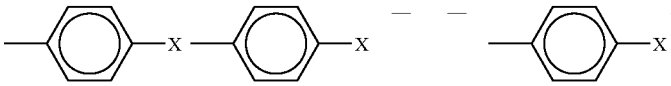 | | — | — | | —CH═N$(CH_2)_3$— —Si$(OEt)_3$ |

TABLE 44

| COM-POUNDS | k | $Ar^1$ | $Ar^2$ | $Ar^3$ | $Ar^4$ | $Ar^5$ | X |
|---|---|---|---|---|---|---|---|
| 216 | 0 | 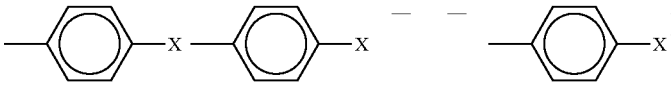 | | — | — | | —CH═N$CH_2$— —Si$(OMe)_2$Me |
| 217 | 0 | 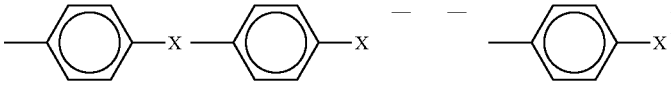 | | — | — | | —CH═N$C_6H_4$— —$(CH_2)_2$Si$(OMe)_3$ |
| 218 | 0 | 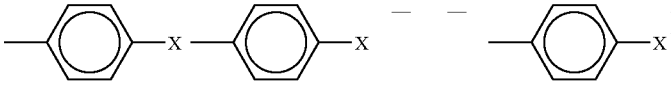 | | — | — | | —CH═N$(CH_2)_2$— —Si$(OMe)_3$ |

TABLE 44-continued
| COM-POUNDS | k | $Ar^1$ | $Ar^2$ | $Ar^3$ | $Ar^4$ | $Ar^5$ | X |
|---|---|---|---|---|---|---|---|
| 219 | 0 | 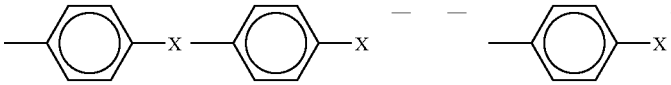 | | — | — | | —$O(CH_2)_3Si(OMe)_3$ |
| 220 | 0 | 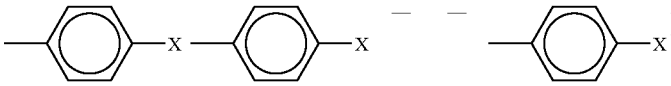 | | — | — | | —$O(CH_2)_3$—<br>—$Si(OMe)_2Me$ |
TABLE 45
| COM-POUNDS | k | $Ar^1$ | $Ar^2$ | $Ar^3$ |
|---|---|---|---|---|
| 221 | 0 | 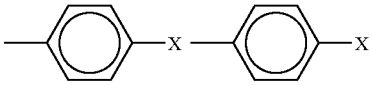 | | — |
| 222 | 0 | 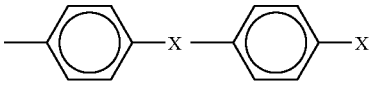 | | — |
| 223 | 0 | 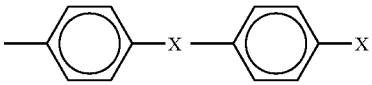 | | — |
| 224 | 1 | 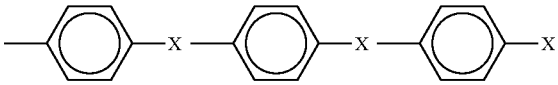 | | |
| 225 | 1 | 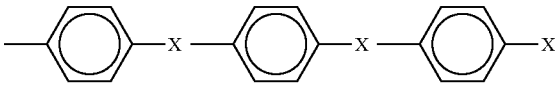 | | |
| COM-POUNDS | $Ar^4$ | $Ar^5$ | X |
|---|---|---|---|
| 221 | — | 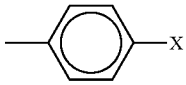 | —$O(CH_2)_3Si(OEt)_3$ |
| 222 | — | 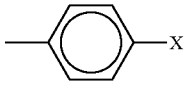 | —$CH_2O(CH_2)_3$—<br>—$Si(OMe)_3$ |
| 223 | — | 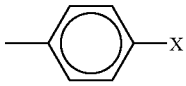 | —$(CH_2)_3O(CH_2)_3$—<br>—$Si(OMe)_2Me$ |
| 224 | 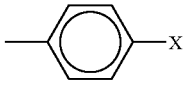 | 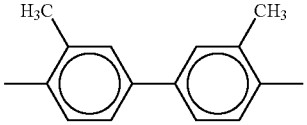 | —$(CH_2)_4Si(OMe)_3$ |
| 225 | 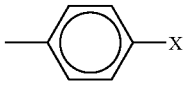 | 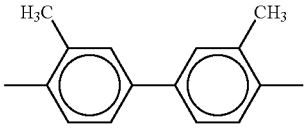 | —$(CH_2)_3Si(OEt)_3$ |

TABLE 58
| COMPOUNDS NO. | $R_{14}$ | $Ar_6$ | $Ar_7$ |
|---|---|---|---|
| 49<br>50 | 4-$CH_3$<br>3,4-$CH_3$ | 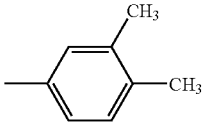 | 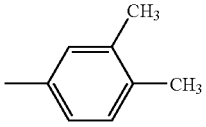 |
| 51<br>52 | 4-$CH_3$<br>3,4-$CH_3$ | 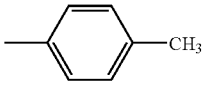 | 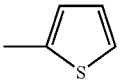 |
| 53<br>54 | 4-$CH_3$<br>3,4-$CH_3$ | 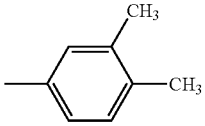 | 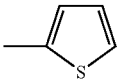 |
| 55<br>56 | 4-$CH_3$<br>3,4-$CH_3$ | 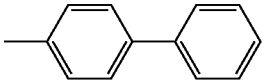 | 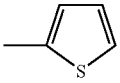 |
| 57<br>58 | 4-$CH_3$<br>3,4-$CH_3$ | 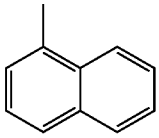 | 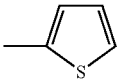 |
| 59<br>60 | 4-$CH_3$<br>3,4-$CH_3$ | 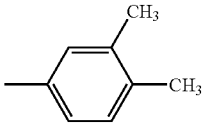 | 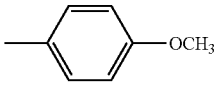 |
| 61<br>62 | 4-$CH_3$<br>3,4-$CH_3$ | 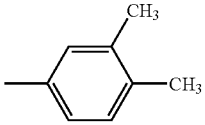 | 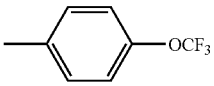 |
TABLE 46
| COM-POUNDS | k | $Ar^1$ | $Ar^2$ | $Ar^3$ |
|---|---|---|---|---|
| 226 | 1 | 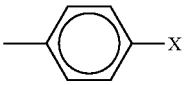 | 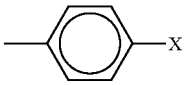 | 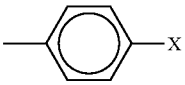 |
| 227 | 1 | 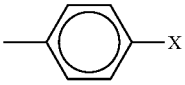 | 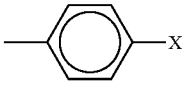 | 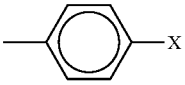 |
| 228 | 1 | 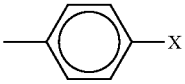 | 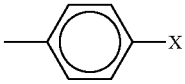 | 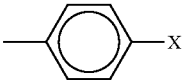 |
| 229 | 1 | 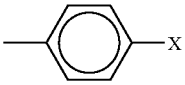 | 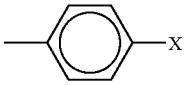 | 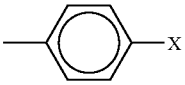 |
| 230 | 1 | 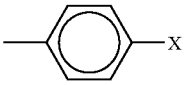 | 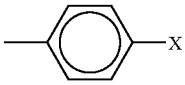 | 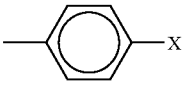 |

TABLE 46-continued
| COM-POUNDS | $Ar^4$ | $Ar^5$ | X |
|---|---|---|---|
| 226 | 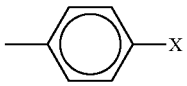 | 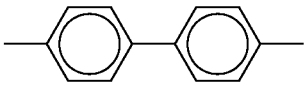 | —$CH_2CH_2$—$(CH_2)_2$— —$Si(OMe)_3$ |
| 227 | 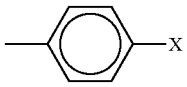 | 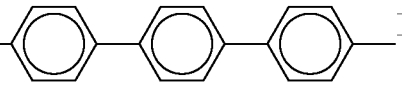 | —$CH_2CH_2$—$(CH_2)_2$— —$Si(OMe)_3$ |
| 228 | 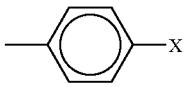 | 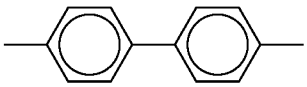 | —$CH_2CH_2$—$CH_2$— —$Si(OMe)_2Me$ |
| 229 | 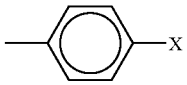 | 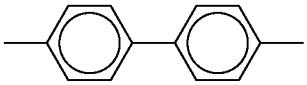 | —$CH_2CH_2$—$C_6H_4$— —$Si(OMe)_2Me$ |
| 230 | 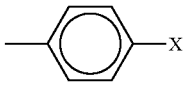 | 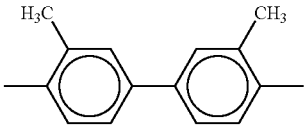 | —CH═CH$(CH_2)_2$— —$Si(OMe)_3$ |
TABLE 47
| COM-POUNDS | k | $Ar^1$ | $Ar^2$ | $Ar^3$ | $Ar^4$ |
|---|---|---|---|---|---|
| 231 | 1 | 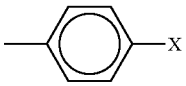 | 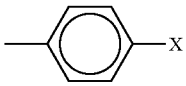 | 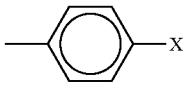 | 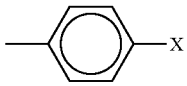 |
| 232 | 1 | 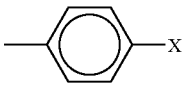 | 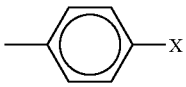 | 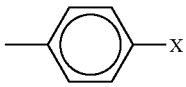 | 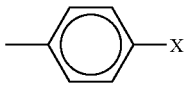 |
| 233 | 1 | 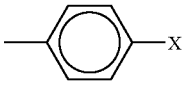 | 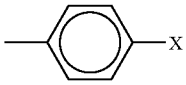 | 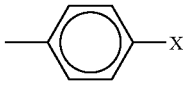 | 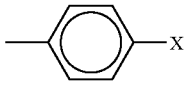 |
| 234 | 1 | 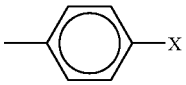 | 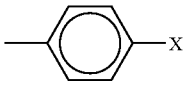 | 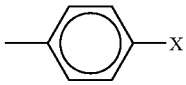 | 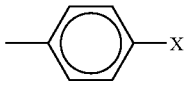 |
| 235 | 1 | 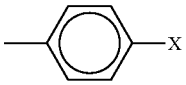 | 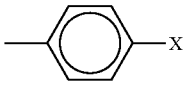 | 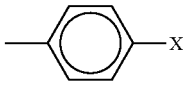 | 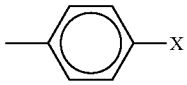 |
| COM-POUNDS | $Ar^5$ | X |
|---|---|---|
| 231 | 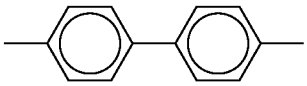 | —CH═CH$(CH_2)_2$— —$Si(OMe)_3$ |
| 232 | 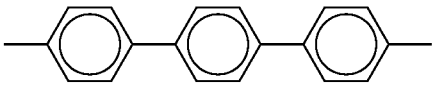 | —CH═CH$(CH_2)_2$— —$Si(OMe)_3$ |
| 233 | 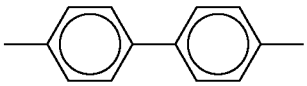 | —CH═$CHCH_2$— —$Si(OMe)_2Me$ |

TABLE 47-continued

| | | |
|---|---|---|
| 234 | | —CH═CHC$_6$H$_4$—<br>—Si(OMe)$_3$ |
| 235 | H$_3$C CH$_3$ | —CH═N(CH$_2$)$_3$—<br>—Si(OMe)$_3$ |

TABLE 48

| COM-POUNDS | k | Ar$^1$ | Ar$^2$ | Ar$^3$ | Ar$^4$ |
|---|---|---|---|---|---|
| 236 | 1 | X | X | X | X |
| 237 | 1 | X | X | X | X |
| 238 | 1 | X | X | X | X |
| 239 | 1 | X | X | X | X |
| 240 | 1 | X | X | X | X |

| COM-POUNDS | Ar$^5$ | X |
|---|---|---|
| 236 | | —CH═N(CH$_2$)$_3$—<br>—Si(OMe)$_3$ |
| 237 | | —CH═N(CH$_2$)$_3$—<br>—Si(OMe)$_3$ |
| 238 | | —CH═NCH$_2$—<br>—Si(OMe)$_2$Me |
| 239 | | —CH═NC$_6$H$_4$—<br>—(CH$_2$)$_2$Si(OMe)$_3$ |
| 240 | H$_3$C CH$_3$ | —O(CH$_2$)$_3$Si(OMe)$_3$ |

TABLE 49
| COM-POUNDS | k | $Ar^1$ | $Ar^2$ | $Ar^3$ |
|---|---|---|---|---|
| 241 | 1 | 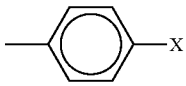 | 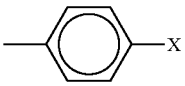 | 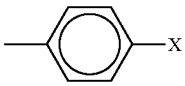 |
| 242 | 1 | 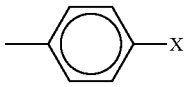 | 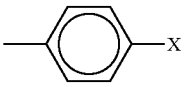 | 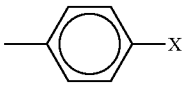 |
| 243 | 1 | 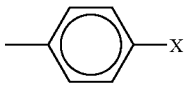 | 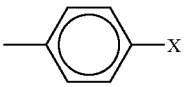 | 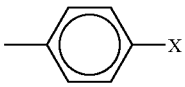 |
| 244 | 1 | 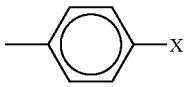 | 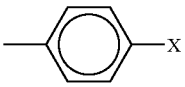 | 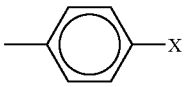 |
| 245 | 0 | 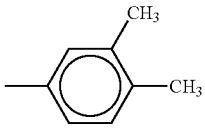 | 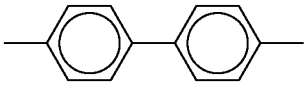 | — |
| COM-POUNDS | $Ar^4$ | $Ar^5$ | X |
|---|---|---|---|
| 241 | 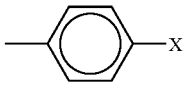 | 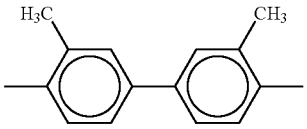 | —$O(CH_2)_3Si(OEt)_3$ |
| 242 | 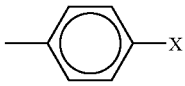 | 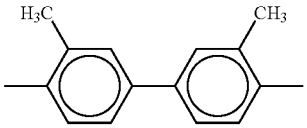 | —$CH_2O(CH_2)_3$—<br>—$Si(OMe)_3$ |
| 243 | 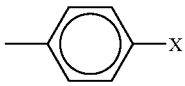 | 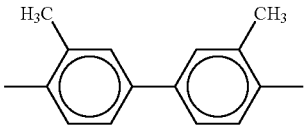 | —$CH_2O(CH_2)_3$—<br>—$Si(OEt)_3$ |
| 244 | 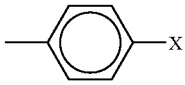 | 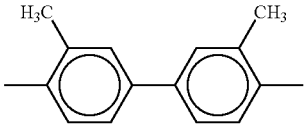 | —$(CH_2)_3O(CH_2)_3$—<br>—$Si(OMe)_3$ |
| 245 | — | 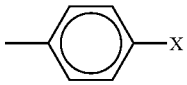 | —$COO(CH_2)_3$—<br>—$Si(O\text{-}i\text{-}Pr)_3$ |
TABLE 50
| COM-POUNDS | k | $Ar^1$ | $Ar^2$ | $Ar^3$ | $Ar^4$ | $Ar^5$ | X |
|---|---|---|---|---|---|---|---|
| 246 | 0 | 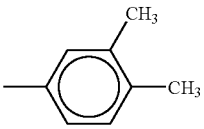 | 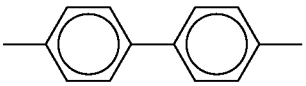 | — | — | 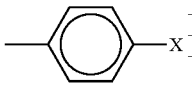 | —$COOCH_2C_6H_4$—<br>—$(CH_2)_2$—<br>—$Si(O\text{-}i\text{-}Pr)_3$ |

TABLE 50-continued
| COM-POUNDS | k | $Ar^1$ | $Ar^2$ | $Ar^3$ | $Ar^4$ | $Ar^5$ | X |
|---|---|---|---|---|---|---|---|
| 247 | 0 | 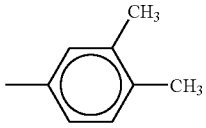 | 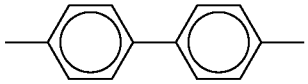 | — | — | 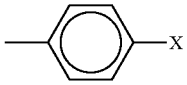 | —$CH_2COO(CH_2)_3$—<br>—Si(O-i-Pr)$_3$ |
| 248 | 0 | 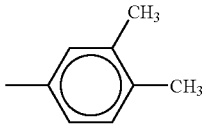 | 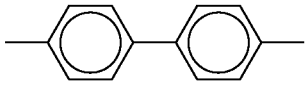 | — | — | 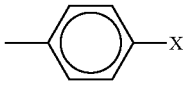 | —$CH_2COOCH_2$—<br>—$C_6H_4(CH_2)_2$—<br>—Si(O-i-Pr)$_3$ |
| 249 | 0 | 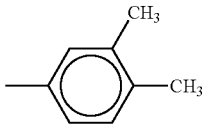 | 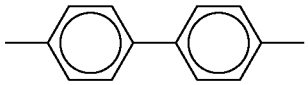 | — | — | 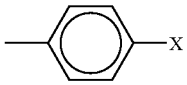 | —$(CH_2)_2COO$—<br>—$(CH_2)_3$—<br>—Si(O-i-Pr)$_3$ |
| 250 | 0 | 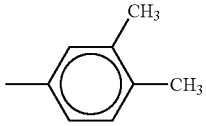 | 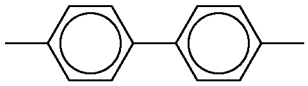 | — | — | 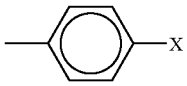 | —$(CH_2)_2COOCH_2$—<br>—$C_6H_4(CH_2)_2$—<br>—Si(O-i-Pr)$_3$ |

TABLE 51
| COMPOUNDS | k | $Ar^1$ | $Ar^2$ | $Ar^3$ | $Ar^4$ | $Ar^5$ | X |
|---|---|---|---|---|---|---|---|
| 251 | 1 | 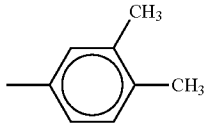 | 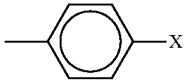 | 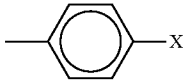 | 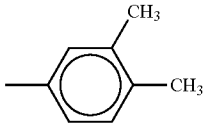 | 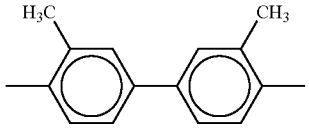 | —COO(CH$_2$)$_3$—<br>—Si(O-i-Pr)$_3$ |
| 252 | 1 | 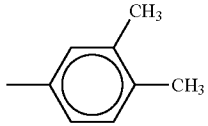 | 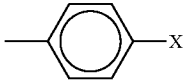 | 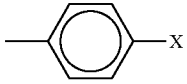 | 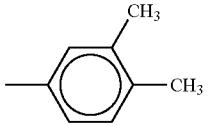 | 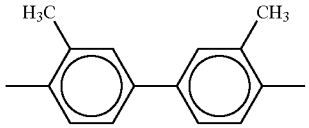 | —COOCH$_2$C$_6$H$_4$—<br>—(CH$_2$)$_2$—<br>—Si(O-i-Pr)$_3$ |
| 253 | 1 | 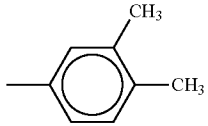 | 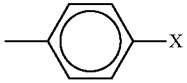 | 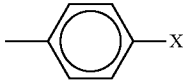 | 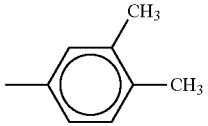 | 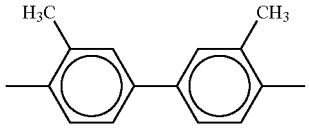 | —CH$_2$COO(CH$_2$)$_3$—<br>—Si(O-i-Pr)$_3$ |
| 254 | 1 | 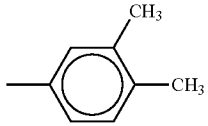 | 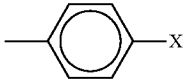 | 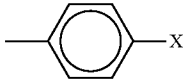 | 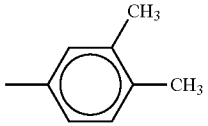 | 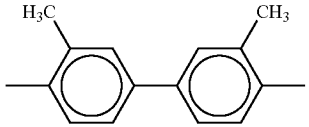 | —CH$_2$COOCH$_2$—<br>—C$_6$H$_4$(CH$_2$)$_2$—<br>—Si(O-i-Pr)$_3$ |
| 255 | 1 | 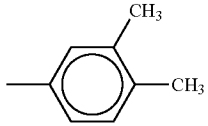 | 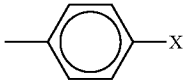 | 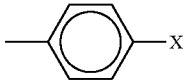 | 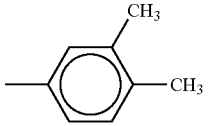 | 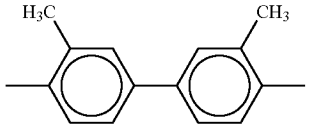 | —(CH$_2$)$_2$COO—<br>—(CH$_2$)$_3$—<br>—Si(O-i-Pr)$_3$ |

TABLE 52
| COMPOUNDS | k | $Ar^1$ | $Ar^2$ | $Ar^3$ | $Ar^4$ | $Ar^5$ | X |
|---|---|---|---|---|---|---|---|
| 256 | 1 | 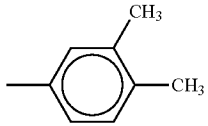 | 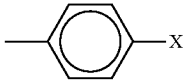 | 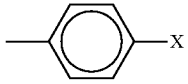 | 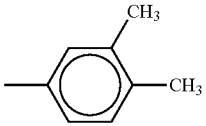 | 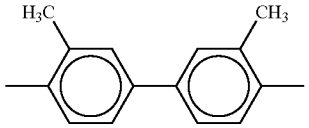 | —$(CH_2)_2COOCH_2$— —$C_6H_4(CH_2)_2$— —Si(O-i-Pr)$_3$ |
| 257 | 0 | 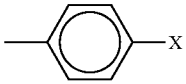 | 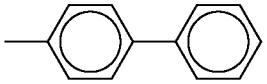 | — | — | 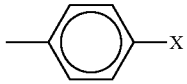 | —$COO(CH_2)_3$— Si(O-i-Pr)$_3$ |
| 258 | 0 | 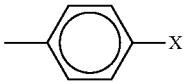 | 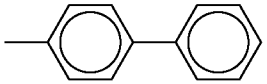 | — | — | 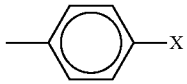 | —$COOCH_2C_6H_4$— —$(CH_2)_2$— —Si(O-i-Pr)$_3$ |
| 259 | 0 | 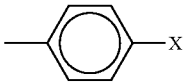 | 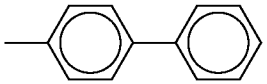 | — | — | 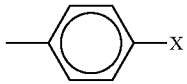 | —$CH_2COO(CH_2)_3$— —Si(O-i-Pr)$_3$ |
| 260 | 0 | 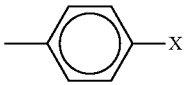 | 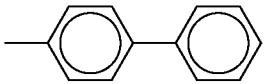 | — | — | 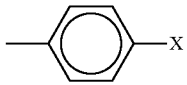 | —$CH_2COOCH_2$— —$C_6H_4(CH_2)_2$— —Si(O-i-Pr)$_3$ |

TABLE 53
| COMPOUNDS | k | $Ar^1$ | $Ar^2$ | $Ar^3$ | $Ar^4$ | $Ar^5$ | X |
|---|---|---|---|---|---|---|---|
| 261 | 0 | 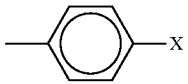 | 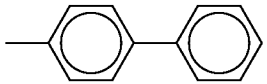 | — | — | 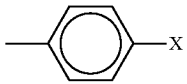 | —$(CH_2)_2COO$—<br>—$(CH_2)_3$—<br>—$Si(O\text{-}i\text{-}Pr)_3$ |
| 262 | 0 | 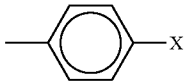 | 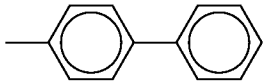 | — | — | 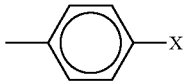 | —$(CH_2)_2COOCH_2$—<br>—$C_6H_4(CH_2)_2$—<br>—$Si(O\text{-}i\text{-}Pr)_3$ |
| 263 | 1 | 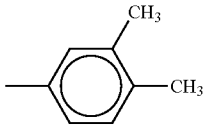 | 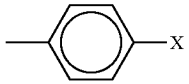 | 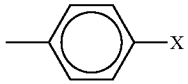 | 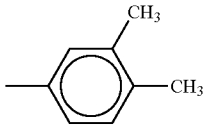 | 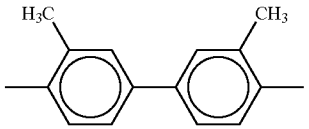 | —$COO(CH_2)_3$—<br>—$SiMe(O\text{-}i\text{-}Pr)_2$ |
| 264 | 1 | 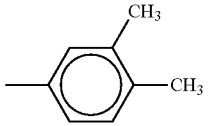 | 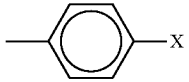 | 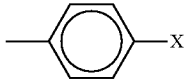 | 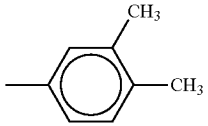 | 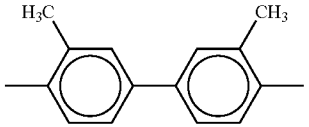 | —$COOCH_2C_6H_4$—<br>—$(CH_2)_2$—<br>—$SiMe(O\text{-}i\text{-}Pr)_2$ |
| 265 | 1 | 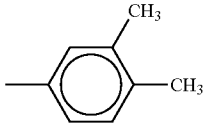 | 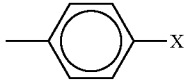 | 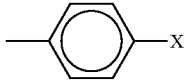 | 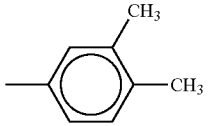 | 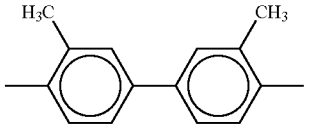 | —$CH_2COO(CH_2)_3$—<br>—$SiMe(O\text{-}i\text{-}Pr)_2$ |

TABLE 54
| COMPOUNDS | k | $Ar^1$ | $Ar^2$ | $Ar^3$ | $Ar^4$ | $Ar^5$ | X |
|---|---|---|---|---|---|---|---|
| 266 | 1 | 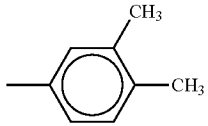 | 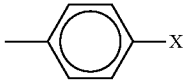 | 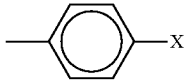 | 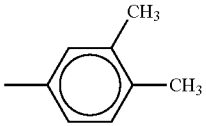 | 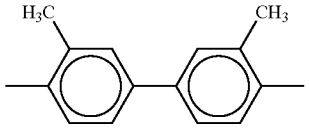 | —$CH_2COOCH_2$—<br>—$C_6H_4(CH_2)_2$—<br>—$SiMe(O\text{-}i\text{-}Pr)_2$ |
| 267 | 1 | 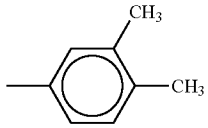 | 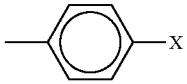 | 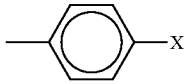 | 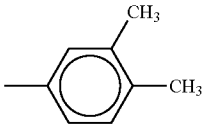 | 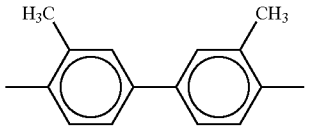 | —$(CH_2)_2COO$—<br>—$(CH_2)_3$—<br>—$SiMe(O\text{-}i\text{-}Pr)_2$ |
| 268 | 1 | 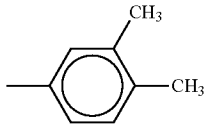 | 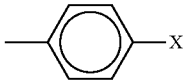 | 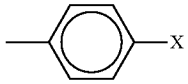 | 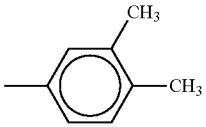 | 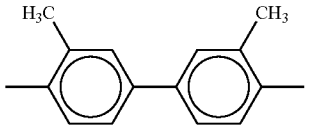 | —$(CH_2)_2COOCH_2$—<br>—$C_6H_4(CH_2)_2$—<br>—$SiMe(O\text{-}i\text{-}Pr)_2$ |
| 269 | 0 | 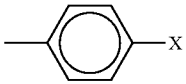 | 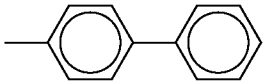 | — | — | 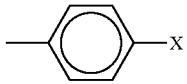 | —$COO(CH_2)_3$—<br>—$SiMe(O\text{-}i\text{-}Pr)_2$ |
| 270 | 0 | 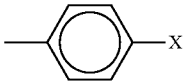 | 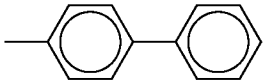 | — | — | 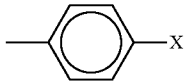 | —$COOCH_2C_6H_4$—<br>—$(CH_2)_2$—<br>—$SiMe(O\text{-}i\text{-}Pr)_2$ |

TABLE 55

| COMPOUNDS | k | $Ar^1$ | $Ar^2$ | $Ar^3$ | $Ar^4$ | $Ar^5$ | X |
|---|---|---|---|---|---|---|---|
| 271 | 0 | 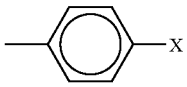 | 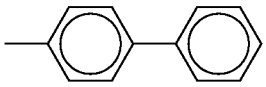 | — | — | 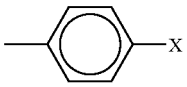 | —$CH_2COO(CH_2)_3$— —SiMe(O-i-Pr)$_2$ |
| 272 | 0 | 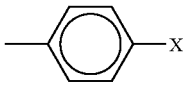 | 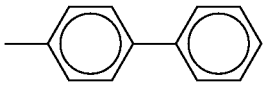 | — | — | 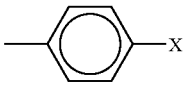 | —$CH_2COOCH_2$— $C_6H_4(CH_2)_2$— —SiMe(O-i-Pr)$_2$ |
| 273 | 0 | 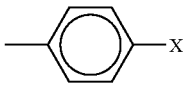 | 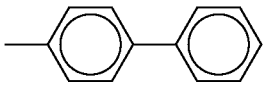 | — | — | 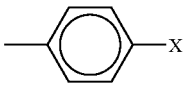 | —$(CH_2)_2COO$— —$(CH_2)_3$— —SiMe(O-i-Pr)$_2$ |
| 274 | 0 | 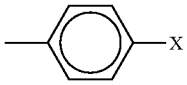 | 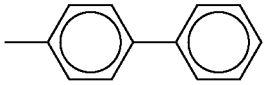 | — | — | 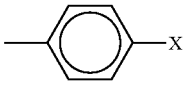 | —$(CH_2)_2COOCH_2$— —$C_6H_4(CH_2)_2$— —SiMe(O-i-Pr)$_2$ |

The compound (I) may be used alone or in a combination of two or more types. When the surface layer is formed, at least one type of compound having a group capable of being bonded with the compound (I) is preferably added for the purpose of further improving the mechanical strength of a cured film.

The group capable of being bonded with the compound (I) means a group capable of being bonded with a silanol group produced when the compound (I) is hydrolyzed, and specifically refers to a group expressed by —$Si(R_1)_{(3-a)}Q_a$, epoxy group, isocyanate group, carboxyl group, hydroxyl group, halogen or the like. Among them, a compound having a hydrolysable group expressed by —Si $(R_1)_{(3-a)}Q_a$, epoxy group or isocyanate group is preferable because such a compound has stronger mechanical strength. Furthermore, for the compound having a group capable of being bonded with the compound (I), a compound having two or more of such groups per molecule is preferable because the compound forms the crosslinked structure of the cured film into a three-dimensional structure to impart higher mechanical strength to the film. Among them, examples of most preferable compounds include compounds expressed by general formula (III).

General Formula (III)

$$B\text{-}[A']_n$$

In general formula (III), A' is a substituted silicon group having a hydrolysable group expressed by —$Si(R_1)_{(3-a)}Q_a$, B is constituted by at least one group selected from hydrocarbon groups of n-valence that may be branched, phenyl groups of n-valence, —NH— and —O—Si— or combinations thereof. a represents an integer of 1 to 3, and n represents an integer of 2 or greater.

The compound expressed by general formula (III) is a compound having two or more substituted silicon groups A' each having a hydrolysable group expressed by —$Si(R_1)_{(3-a)}Q_a$. A part of the Si group included in A' reacts with the compound (I) or compound (III) itself to form Si—O—Si bonds to form a three-dimensional crosslinked cured film. While the compound (I) has a similar Si group, and is therefore capable of forming a cured film by itself, it can be considered that the compound (III) has two or more groups A', and therefore the crosslinked structure of the cured film forms into a three-dimensional structure so that it has higher mechanical strength. In addition, as in the case of the D part in the compound (I), the compound (III) also serves a function of imparting an appropriate level of flexibility to the crosslinked cured film. The compound (III) has more preferably one of the structures shown in Structure Group 5 described below.

Structure Group 5

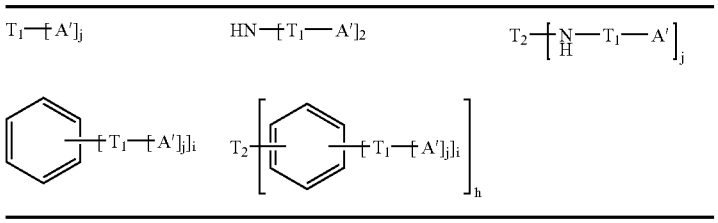

In the above formula, $T_1$ and $T_2$ each represent independently a bivalent or trivalent hydrocarbon group that may be branched, and A' represents one of the substituted groups described above. h, i and j are each an integer of 1 to 3, and are selected so that the number of groups A' is 2 or larger.

Specific examples of compounds of general formula (III) expressed by these formulae are shown below, but the compound (III) is not limited thereto.

III-1 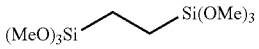

III-2 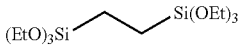

III-3 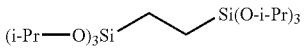

III-4 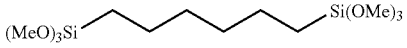

III-5 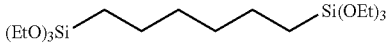

III-6 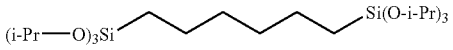

III-7 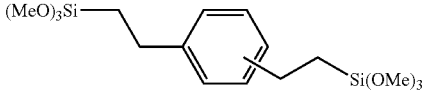

III-8 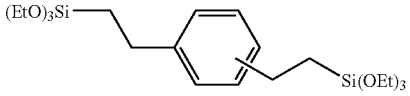

III-9 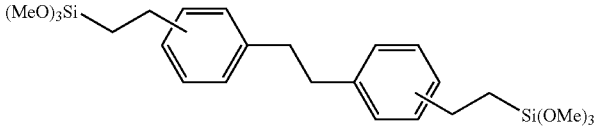

III-10 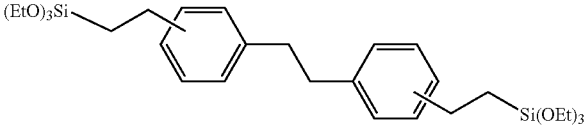

III-11 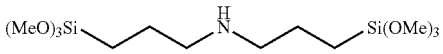

III-12 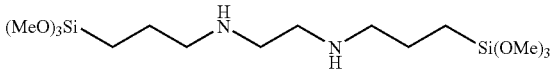

III-13 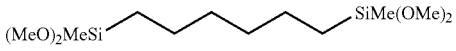

III-14 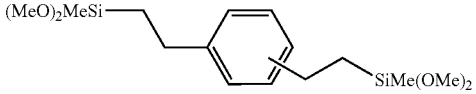

III-15 $(MeO)_3SiC_3H_6—O—CH_2CH\{—O—C_3H_6Si(OMe)_3\}—CH_2\{—O—C_3H_6Si(OMe)_3\}$

The compound (I) may be used alone, or mixed with the compound expressed by general formula (III), other coupling agents, fluorine compounds and the like for the purpose of adjusting the formability and flexibility of the film. For such compounds, various kinds of silane coupling agents and commercially available silicone based hard coating agents may be used.

For the silane coupling agent described above, vinyl trichlorosilane, vinyl trimethoxysilane, vinyl triethoxysilane, γ-glycidoxypropylmethyl diethoxysilane, γ-glycidoxypropyl trimethoxysilane, γ-glycidoxypropyl trimethoxysilane, γ-aminopropyl triethoxysilane, γ-aminopropyl trimethoxysilane, γ-aminopropylmethyl dimethoxysilane, N-β(aminoethyl) γ-aminopropyl triethoxysilane, tetramethoxysilane, methyl trimethoxysilane, dimethyl dimethoxysilane and the like maybe used. For the commercially available silicone based hardcoating agent, KP-85, X-40-9740 and X-40-2239 (manufactured by Shin-Etsu Silicone Co., Ltd.), AY42-440, AY42-441 and AY49-208 (manufactured by Toray Dow Corning Co., Ltd.) and the like may be used. In addition, for imparting water repellency and the like, a fluorine compound such as (tridecafluoro-1,1,2,2-tetrahydrooctyl)-triethoxysilane, (3,3,3-trifluoropropyl)-trimethoxysilane, 3-(heptafluoroisopropoxy)-propyltriethoxysilane, 1H,1H,2H,2H-perfluoroalkyl triethoxysilane, 1H,1H,2H,2H-perfluorodecyl triethoxysilane or 1H,1H,2H,2H-perfluorooctyl triethoxysilane may be added.

While the silane coupling agent may be used in any amount, the amount of fluorine compound is desirably 25 wt % or smaller based on the amount of compounds containing no fluorine. If the amount is greater than 25 wt %, formability of the crosslinked film may be degraded.

In addition, if the crosslinked film is formed as a surface protective layer, an organic metal compound or curable matrix is preferably added.

Organic metal compounds include organic zirconium compounds such as zirconium chelate compounds, zirconium alkoxide compounds and zirconium coupling agents, organic titanium compounds such as titanium chelate compounds, titanium alkoxide compounds and titanate coupling agents, organic aluminum compounds such as aluminum chelate compounds and aluminum coupling agents, and organic metal compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicone alkoxide compounds, aluminum titanium alkoxide compounds and aluminum zirconium alkoxide compounds, and organic zirconium compounds, organic titanium compounds and organic aluminum compounds are preferable because they have low rest potentials and thus provide excellent electrophotographic characteristics.

For the curable matrix, silane coupling agents such as vinyl trichlorosilane, vinyl trimethoxysilane, vinyl triethoxysilane, vinyl tris-2-methoxyethoxysilane, vinyl triacetoxysilane, γ-glycidoxypropyl trimethoxysilane, γ-methacryloxypropyl trimethoxysilane, γ-aminopropyl triethoxysilane, γ-chloropropyl trimethoxysilane, γ-2-aminoethylaminopropyl trimethoxysilane, γ-mercapropropyl trimethoxysilane, γ-ureidepropyl trimethoxy silane and β-3,4-epoxycyclohexyl trimethoxysilane may be used.

These coating solutions may be prepared using no solvents, or alcohols such as methanol, ethanol, propanol and butanol, ketones such as acetone, methyl ethyl ketone, ethers such as tetrahydrofuran, diethyl ether and dioxane may be used as necessary, but a solvent having a boiling point of 100° C. or higher is preferable, and these solvents may be freely mixed. The amount of solvent may be arbitrarily selected, but if the amount is too small, the compound (I) tends to be precipitated, and thus the amount of solvent to be used is 0.5 to 30 parts by weight, preferably 1 to 20 parts by weight based on one part by weight of compound (I).

In preparation of the coating solution, the compound (I), and other compounds as necessary are made to contact a solid catalyst to undergo a reaction, but the reaction temperature and time vary depending on the type of raw material, and the reaction temperature is usually 0 to 100° C., more preferably 0 to 70° C., and especially preferably 10 to 35° C. The reaction time is not specifically limited, but if the reaction time is increased, gelation tends to occur, and thus the reaction is preferably completed in 10 minutes to 100 hours.

In the case where a polymer has a group capable of being bonded to the compound (I), gelation is considerably promoted, thus making it difficult to perform coating if a solid catalyst and the polymer exist at the same time, and therefore it is preferable that the polymer is added after the solid catalyst is removed. The solid catalyst is not specifically limited as long as the components of the catalyst are soluble in none of the solution of compound (I), other compounds, the solvent and the like. As the solid catalyst insoluble in the system, the following systems may be used to perform hydrolysis in advance:

- cation-exchange resins: amberlite™ 15, amberlite 200C and amberlist 15 (manufactured by Rohm & Haas Co.); DOWEX MWC-1-H, DOWEX 88 and DOWEX HCR-W2 (manufactured by Dow Chemical Company); LEWATIT SPC-108 and LEWATIT SPC-118 (manufactured by Bayer Chemicals); DIAION® RCP-150H (manufactured by Mitsubishi Chemical Corporation); Sumika Ion KC-470, Duolite C26-C, Duolite C-433 and Duolite-464 (manufactured by Sumitomo Chemical Co., Ltd.); Nafion®-H (manufactured by E.I. du Pont de Namours and Company), etc;
- anion-exchange resins: amberlite IRA-400 and amberlite IRA-45 (manufactured by Rohm & Haas Co.), etc;
- inorganic solids having bonded on the surface a group containing a proton acid group: $Zr(O_3PCH_2CH_2SO_3H)_2$, $Th(O_3PCH_2CH_2COOH)_2$, etc;
- polyorganosiloxane containing a proton acid group: polyorganosiloxane having a sulfonic group, etc;
- heteropolyacids: cobalttungustic acid, phosphomolybdic acid, etc;
- isopolyacids: niobic acid, tantalumic acid, molybdic acid, etc;
- single metal oxides: silica gel, alumina, chromia, zirconia, CaO, MgO, etc;
- multi metal oxides: silica-alumina, silica-magnesia, silica-zirconia, zeolites, etc;
- clay minerals: acid clay, activated clay, montmorillonite, kaolinite, etc;
- metal sulfates: $LiSO_4$, $MgSO_4$, etc;
- metal phosphates: zirconium phosphate, lanthanum phosphate, etc;
- metal nitrate: $LiNO_3$, $Mn(NO_3)_2$, etc;
- inorganic solids having on the surface bonded a group containing an amino group: solid obtained by making aminopropyl triethoxysilane undergo a reaction on silica gel, etc; and
- polyorganosiloxane containing an amino group: amino modified silicone resin, etc.

At least one type of these catalysts is used to carry out a hydrolysis condensation reaction. These catalysts may be placed on a fixed bed to carry out a reaction in a flow system or in a batch system. The amount of catalyst is not specifically limited, but is preferably 0.1 to 20 wt % based on the total amount of material containing hydrolysable silicon substituted groups.

The amount of water to be added for performing hydrolysis condensation is not specifically limited, but is preferably in the range of 30 to 500%, more preferably 50 to 300% with respect to the theoretical amount required for hydrolyzing all the hydrolysable groups of the compound (I) because the amount of water has influences on storage stability of the product and inhibition of gelation when the product is polymerized. If the amount of water is greater than 500%, the storage stability of the product is compromised, and components are easily precipitated. On the other hand, if the amount of water is less than 30%, the amount of unreacted matter increases to cause phase separation when the coating solution is coated and cured, and the coating film tends to decrease in strength.

Furthermore, curing catalysts include proton acids such as hydrochloric acid, acetic acid, phosphoric acid and sulfuric acid; bases such as ammonia and triethylamine; organic tin compounds such as dibutyl tin diacetate, dibutyl tin dioctoate and tin ocate; organic titanium compounds such as tetra-n-butyl titanate and tetraisopropyl titanate; organic aluminum compounds such as aluminum tributoxide and aluminum triacetyl acetonate; and iron salts, manganese salts, cobalt salts, zinc salts and zirconium salts of organic carboxylic acid, but metal compounds are preferable in terms of storage stability, and metal acetyl acetonates or acetyl acetates are particularly preferable.

The amount of curing catalyst may be freely selected, but it is preferably 0.1 to 20 wt %, more preferably 0.3 to 10 wt % based on the total amount of material containing hydrolysable silicon substituted groups in terms of storage stability, characteristics, strength and the like.

The curing temperature may be freely selected, but it is set to 60° C. or higher, more preferably 80° C. or higher for obtaining a desired level of strength. The curing time may be selected as required, but it is preferably 10 minutes to 5 hours. It is also effective to keep the reacted material at a high humidity after a curing reaction to improve the stability of characteristics. Furthermore, in some applications, hexamethyl disilane, trimethyl chlorosilane or the like can be used to treat the surface to impart a hydrophobic nature.

An anti-oxidizing agent is preferably added to the surface-crosslinked cured film of the photosensitive member for the purpose of preventing degradation caused by oxidizing gases such as ozone produced in a charging device. If the mechanical strength of the surface of the photosensitive member is enhanced to prolong the life of the photosensitive member, the photosensitive member inevitably contacts the oxidizing gas for a long time, and therefore the photosensitive member is required to have higher oxidization resistance than ever.

For the anti-oxidizing agent, a hindered phenol based or hindered amine based agent is desirable, and a well known anti-oxidizing agent such as an organic sulfur based anti-oxidizing agent, phosphate based anti-oxidizing agent, dithiocarbamate based anti-oxidizing agent, thiourea based anti-oxidizing agent or benzimidazole based anti-oxidizing agent may be used. The amount of anti-oxidizing agent added is desirably 15 wt % or less, more desirably 10 wt % or less based on the total amount of cured film.

Hindered phenol based anti-oxidizing agents include 2,6-di-t-butyl-4-methylphenol, 2,5-di-t-butylhydroquinone, N,N'-hexamethylene bis(3,5-di-t-butyl-4-hydroxyhydrocinamide), diethyl 3,5-di-t-butyl-4-hydroxy-benzylphosphonate, 2,4-bis[(octylthio)methyl]-o-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenyl acrylate and 4,4'-butylidene bis(3-methyl-6-t-butylphenol).

Since a siloxane based resin having charge transport property and having a crosslinked structure is excellent in mechanical strength and has adequate photoelectric characteristics, the siloxane based resin may be used directly as a charge transport layer of the stacked photosensitive member.

For the coating method, a usual method such as a blade coating method, mayer bar coating method, spray coating method, dip coating method, bead coating method, air knife coating method or curtain coating method may be used. However, if a required thickness cannot be obtained with one application of coating, coating can be applied several times on a wet-on-wet basis to obtain a required thickness. If coating is applied several times on a wet-on-wet basis, a heat treatment may be carried out for each coating, or may be carried out after coating is applied several times.

The degree of crosslinking of the surface layer can be known from the hardness of the surface layer, and the hardness can be determined as a degree of hardness of the photosensitive member. The degree of hardness is preferably 15 to 35 mN/μm$^2$ in dynamic hardness. Furthermore, the dynamic hardness can be measured by Shimadzu Dynamic Hardness Meter DUH-201.

The single layer-type photosensitive layer contains the charge generating material and the binder resin. For the binder resin, a resin similar to the binder resin for use in the charge generation layer and the charge transport layer may be used. The content of charge generating material in the single layer-type photosensitive layer is about 10 to 85 wt %, preferably 20 to 50 wt %. A charge transporting material or polymeric charge transporting material may be added to the single layer-type photosensitive layer for the purpose of improving the photoelectric characteristics and so on. The amount of the material added is preferably 5 to 50 wt %. Also, the compound (I) may be added. The solvent for use in coating and the coating method may be same as those described above. The thickness is preferably about 5 to 50 μm, more preferably 10 to 40 μm.

Charge Generation Layer:

The charge generation layer will now be described.

For the charge generating material, all known materials such as azo pigments such as bisazo and trisazo, condensation ring aromatic pigments such as dibromoanthanthrone, perylene pigments, pyrrolopyrrole pigments and phthalocyanine pigments may be used, but particularly metal and nonmetal phtalocyanine pigments, are preferable. Among them, hydroxygallium phthalocyanine, chlorogallium phthalocyanine, dichlorotin phthalocyanine and titanyl phthalocyanine having specific crystals are especially preferable. Chlorogallium phthalocyanine for use in the present invention can be produced by mechanically dry-grinding chlorogallium phthalocyanine crystals produced by a known method using an automatic mortar, planetary mill, vibrating mill, CF mill, roller mill, sand mill, kneader mill or the like, or wet-grinding the crystals together with a solvent using a ball mill, mortar, sand mill, kneader or the like after they are dry-ground, as disclosed in Japanese Patent Laid-Open Publication No. Hei 5-98181. Solvents for use in the treatment described above include aromatic compounds (toluene, chlorobenzene, etc.), amides (dimethylformamide, N-methylpyrrolidone, etc.), aliphatic alcohols (methanol, ethanol, butanol, etc.), aliphatic polyvalent alcohols (ethylene glycol, glycerin, polyethylene glycol, etc.), aromatic alcohols (benzyl alcohol, phenethyl alcohol, etc.), esters (acetate, butyl acetate, etc.), ketones (acetone, methyl ethyl ketone, etc.), dimethylsulfoxide, ethers (diethyl ether, tetrahydrofuran, etc.), mixtures of several types thereof, and mixtures of water and these solvents. The amount of solvent used is 1 to 200 parts, preferably 10 to 100 parts based on the amount of chlorogallium phthalocyanine. The treatment temperature is 0° C. to a temperature equal to or lower than the boiling point of the solvent, preferably 10 to 60° C. A grinding aid such as sodium chloride or Glauber's salt (mirabilite) may also be used at the time of grinding. The ratio of the grinding agent to the pigment is 0.5:1 to 20:1, preferably 1:1 to 10:1.

Dichlorotin phthalocyanine can be obtained by grinding and solvent-treating dichlorotin phthalocyanine crystals produced by a well known method as in the case of the chlorogallium phthalocyanine described previously as disclosed in Japanese Patent Laid-Open Publication No. Hei 5-140472 and Japanese Patent Laid-Open Publication No. Hei 5-140473.

Hydroxygallium phthalocyanine can be produced by subjecting chlorogallium phthalocyanine crystals produced by a well known method to hydrolysis in an acidic or alkaline solution or acid-pasting to synthesize hydroxygalluim phthalocyanine crystals, and solvent-treating the hydroxygallium phthalocyanine crystals directly, or wet-grinding the hydroxygallium phthalocyanine crystals obtained by the synthesis together with a solvent using a ball mill, mortar, sand mill, kneader or the like, or solvent-treating the crystals without using a solvent after dry-grinding the crystals, as disclosed in Japanese Patent Laid-Open Publication No. Hei 5-263007 and Japanese Patent Laid-Open Publication No. Hei 5-279591. Solvents for use in the treatment described above include aromatic compounds (toluene, chlorobenzene, etc.), amides (dimethylformamide, N-methylpyrolidone, etc.), aliphatic alcohols (methanol, ethanol, butanol, etc.), aliphatic polyvalent alcohols (ethylene glycol, glycerin, polyethylene glycol, etc.), aromatic alcohols (benzyl alcohol, phenethyl alcohol, etc.), esters (acetate, butyl acetate, etc.), ketones (acetone, methyl ethyl ketone, etc.), dimethylsulfoxide, ethers (diethyl ether, tetrahydrofuran, etc.), mixtures of several types thereof, and mixtures of water and these solvents. The amount of solvent used is 1 to 200 parts, preferably 10 to 100 parts based on the amount of hydroxygallium phthalocyanine. The treatment temperature is 0 to 150° C., preferably room temperature to 100° C. In addition, a grinding aid such as sodium chloride and Glauber's salt (mirabilite) may be used at the time of grinding. The ratio of the grinding aid to the pigment is 0.5:1 to 20:1, preferably 1:1 to 10:1.

Oxytitanyl phthalocyanine can be produced by acid-pasting oxytitanyl phthalocyanine crystals produced by a well known method, or saly-milling the oxytitanyl phthalocyanine crystals together with an inorganic salt using a ball mill, mortar, sand mill, kneader or the like to form oxytitanyl phthalocyanine crystals of relatively low crystallinity having a peak at 27.2 in the X-ray diffraction spectrum, followed by solvent-treating the crystals directly, or wet-grinding the crystals together with a solvent using a ball mill, mortar, sand mill, kneader or the like as described in Japanese Patent Laid-Open Publication No. Hei 4-189873 and Japanese Patent Laid-Open Publication No. Hei 5-43813. The acid for use in acid pasting is preferably sulfuric acid, its concentration is 70 to 100%, preferably 95 to 100%, and the crystals are dissolved at a temperature of −20 to 100° C., preferably temperature of 0 to 60° C. The ratio of concentrated sulfuric acid to oxytitanyl phthalocyanine is 1:1 to 100:1, preferably 3:1 to 50:1. For the solvent for precipitating the crystals, water, or a mixed solvent of water and an organic solvent is used in any amount, and a mixed solvent of water and an alcohol solvent such as methanol or ethanol, or a mixed solvent of water and an aromatic solvent such as benzene or toluene is especially preferable. The temperature at which the crystals are precipitated is not specifically limited, but the solvent is preferably cooled on ice or the like to prevent heat generation. The ratio of oxytitanyl phthalocyanine crystals to the inorganic salt is 1/0.1 to 1/20, preferably 1/0.5 to 1/5 by weight. Solvents for use in the solvent treatment described above include aromatic compounds (toluene, chlorobenzene, etc.), aliphatic alcohols (methanol, ethanol, butanol, etc.), halogen based hydrocarbons (dichloromethane, chloroform, trichloroethane, etc.), mixtures of several types thereof, and mixtures of water and these solvents. The amount of solvent used is 1 to 100 parts, preferably 5 to 50 parts based on the amount of oxytitanyl phthalocyanine. The treatment temperature is room temperature to 100° C., preferably 50 to 100° C. In addition, a grinding aid such as sodium chloride and soda may be used at the time of grinding. The ratio of the grinding aid to the pigment is 0.5:1 to 20:1, preferably 1:1 to 10:1.

The binder resin may be selected from a wide range of insulating resins. The binder resin may also be selected from organic photoconductive polymers such as poly-N-vinyl carbazole, polyvinyl anthracene, polyvinyl pyrene and polysilane. Preferable binder resins include, but are not limited to, insulating resins such as polyvinyl butyral resins, polyacrylate resins (polycondensates of bisphenol A and phthalic acid, etc.), polycarbonate resins, polyester resins, phenoxy resins, vinyl chloride-vinyl acetate copolymers, polyamide resins, acryl resins, polyacrylamide resins, polyvinyl pyridine resins, cellulose resins, urethane resins, epoxy resins, casein, polyvinyl alcohol resins and polyvinyl pyrolidone resins. These binder resins may be used alone or in a combination of two or more types.

The ratio (by weight) of the charge generating material to the binder resin is preferably 10:1 to 1:10. For the method for dispersing the charge generating material and the binder resin, a usual method such as a ball mill dispersion method, atto-lighter dispersion method or sand mill dispersion method may be used, but in this case, conditions such that the crystal type is not changed after dispersion are required. In this regard, it has been shown that the crystal type is not changed before and after dispersion for any of the dispersion methods described above. Furthermore, it is effective to reduce the size of particles to 0.5 μm or smaller, preferably 0.3 μm, more preferably 0.15 μm in this dispersion. In addition, for the solvent for use in this dispersion, usual organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used alone or in combination of two or more types.

In addition, the thickness of the charge generation layer for use in the present invention is generally 0.1 to 5 μm, preferably 0.2 to 2.0 μm. For the method for use in formation of the charge generation layer, a usual method such as a blade coating method, mayer bar coating method, spray coating method, dip coating method, bead coating method, air knife coating method or curtain coating method may be used. Furthermore, for improvement of dispersion stability of the pigment, enhancement of photosensitivity or stabilization of electric characteristics, the compound (I) may be used to treat the pigment, or the compound (I) may be added to a dispersion of pigment.

Charge Transport Layer:

The charge transport layer in the photosensitive member of the present invention may be formed by a well known technique. The charge transport layer contains a charge transporting material and a binder resin, or contains a polymeric charge transporting material.

Charge transporting materials include electron transport compounds such as quinone based compounds such as p-benzoquinone, chloranil, bromanil and antraquinone, tetracyanoquinodimethane based compounds, furolenone compounds such as 2,4,7-trinitrofurolenone, xanthene based compounds, benzophenone based compounds, cyanovinyl based compounds and ethylene based compounds, and positive hole transport compounds such as triarylamine based compounds, benzidine based compounds, arylalkane based compounds, aryl substituted ethylene based compounds, stilbene based compounds, anthracene based compounds and hydrazone based compounds. These charge transporting materials may be used alone or in combination of two or more types, but the charge transporting material is not limited to the compounds described above. In addition, these charge transporting materials may be used alone or in combination of two or more types. Among charge transporting materials, triphenyl amine based compounds expressed by the structural formula (IV) and benzidine based compounds expressed by the structural formula (V) may be especially suitable for use because they have a high level of charge (positive hole) transportability and are excellent in stability.

(IV)

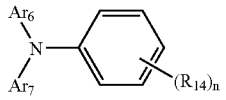

In the above formula, $R_{14}$ represents a hydrogen atom or a methyl group. n represents 1 or 2. $Ar_6$ and $Ar_7$ each represent a substituted or unsubstituted aryl group, and the substituted group is a substituted amino group substituted with a halogen atom, alkyl group having 1 to 5 carbon atoms, alkoxy group having 1 to 5 carbon atoms or alkyl group having 1 to 3 carbon atoms.

(V)

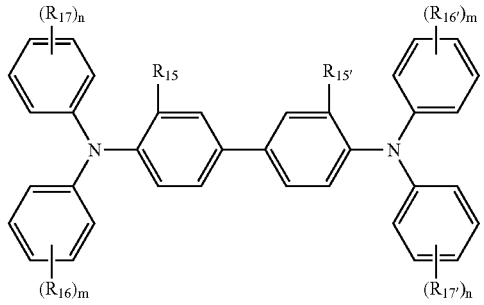

In the above formula, $R_{15}$ and $R_{15'}$ may be identical or different, and each represents a hydrogen atom, halogen atom, alkyl group having 1 to 5 carbon atoms or alkoxy group having 1 to 5 carbon atoms. $R_{16}$ and $R_{16'}$, and $R_{17}$ and $R_{17'}$ may be identical or different, and each represents a hydrogen atom, halogen atom, alkyl group having 1 to 5 carbon atoms, alkoxy group having 1 to 5 carbon atoms, or amino group substituted with an alkyl group having 1 to 2 carbon atoms, and m and n are each an integer of 0 to 2.

Examples of the compounds are shown in Tables 56 to 61.

TABLE 56

| COMPOUNDS NO. | $R_{14}$ | $Ar_6$ | $Ar_7$ |
|---|---|---|---|
| 1 | 4-$CH_3$ | 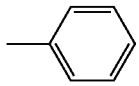 | 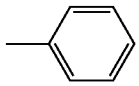 |
| 2 | 3,4-$CH_3$ | | |
| 3 | 4-$CH_3$ | 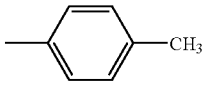 | 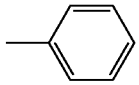 |
| 4 | 3,4-$CH_3$ | | |
| 5 | 4-$CH_3$ | 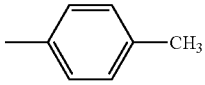 | 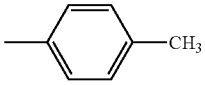 |
| 6 | 3,4-$CH_3$ | | |
| 7 | 4-$CH_3$ | 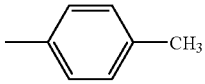 | 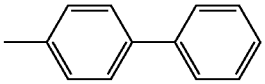 |
| 8 | 3,4-$CH_3$ | | |
| 9 | 4-$CH_3$ | 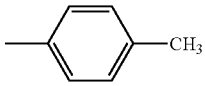 | 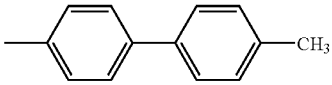 |
| 10 | 3,4-$CH_3$ | | |
| 11 | 4-$CH_3$ | 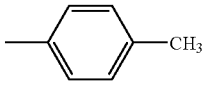 | 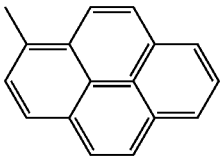 |
| 12 | 3,4-$CH_3$ | | |
| 13 | 4-$CH_3$ | 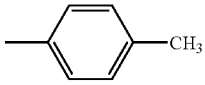 | 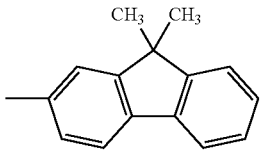 |
| 14 | 3,4-$CH_3$ | | |

TABLE 56-continued
| COMPOUNDS NO. | $R_{14}$ | $Ar_6$ | $Ar_7$ |
|---|---|---|---|
| 15<br>16 | 4-$CH_3$<br>3,4-$CH_3$ | 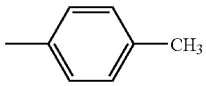 | 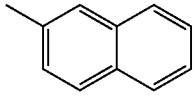 |
| 17<br>18 | 4-$CH_3$<br>3,4-$CH_3$ | 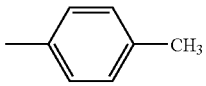 | 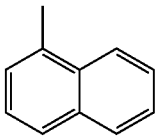 |
| 19<br>20 | 4-$CH_3$<br>3,4-$CH_3$ | 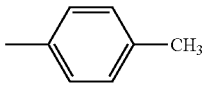 | 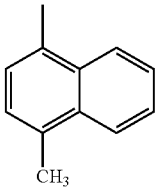 |
| 21<br>22 | 4-$CH_3$<br>3,4-$CH_3$ | 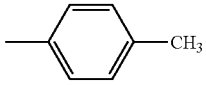 | 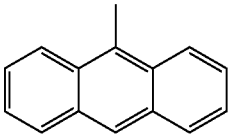 |
| 23<br>24 | 4-$CH_3$<br>3,4-$CH_3$ | 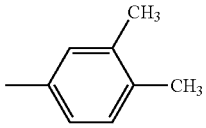 | 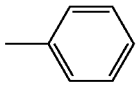 |
TABLE 57
| COMPOUNDS NO. | $R_{14}$ | $Ar_6$ | $Ar_7$ |
|---|---|---|---|
| 25<br>26 | 4-$CH_3$<br>3,4-$CH_3$ | 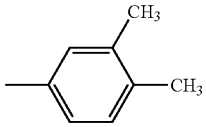 | 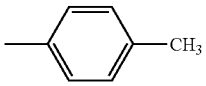 |
| 27<br>28 | 4-$CH_3$<br>3,4-$CH_3$ | 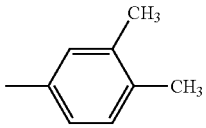 | 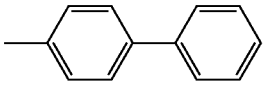 |
| 29<br>30 | 4-$CH_3$<br>3,4-$CH_3$ | 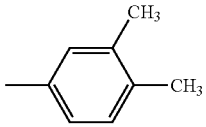 | 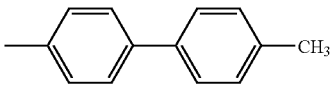 |
| 31<br>32 | 4-$CH_3$<br>3,4-$CH_3$ | 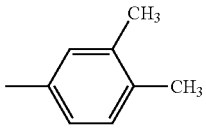 | 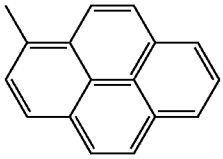 |

TABLE 57-continued

| COMPOUNDS NO. | $R_{14}$ | $Ar_6$ | $Ar_7$ |
|---|---|---|---|
| 33<br>34 | 4-$CH_3$<br>3,4-$CH_3$ | 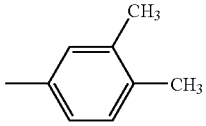 | 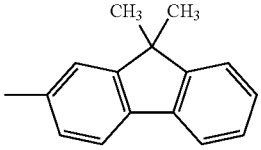 |
| 35<br>36 | 4-$CH_3$<br>3,4-$CH_3$ | 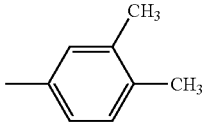 | 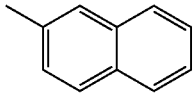 |
| 37<br>38 | 4-$CH_3$<br>3,4-$CH_3$ | 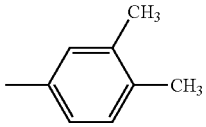 | 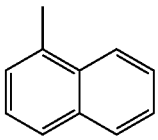 |
| 39<br>40 | 4-$CH_3$<br>3,4-$CH_3$ | 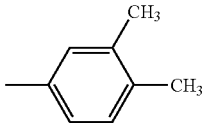 | 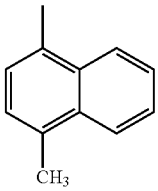 |
| 41<br>42 | 4-$CH_3$<br>3,4-$CH_3$ | 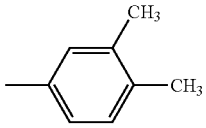 | 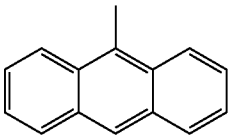 |
| 43<br>44 | 4-$CH_3$<br>3,4-$CH_3$ | 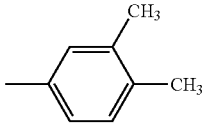 | 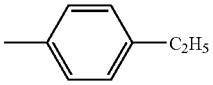 |
| 45<br>46 | 4-$CH_3$<br>3,4-$CH_3$ | 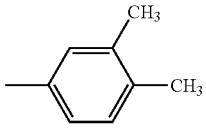 | 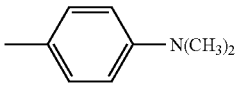 |
| 47<br>48 | 4-$CH_3$<br>3,4-$CH_3$ | 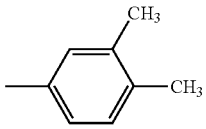 | 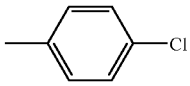 |

TABLE 59

| COMPOUNDS NO. | $R_{15}$, $R_{15'}$ | $(R_{16})_m$, $(R_{16'})_m$ | $(R_{17})_n$, $(R_{17'})_n$ |
|---|---|---|---|
| 1 | $CH_3$ | H | H |
| 2 | $CH_3$ | 2-$CH_3$ | H |
| 3 | $CH_3$ | 3-$CH_3$ | H |
| 4 | $CH_3$ | 4-$CH_3$ | H |
| 5 | $CH_3$ | 4-$CH_3$ | 2-$CH_3$ |
| 6 | $CH_3$ | 4-$CH_3$ | 3-$CH_3$ |
| 7 | $CH_3$ | 4-$CH_3$ | 4-$CH_3$ |
| 8 | $CH_3$ | 3,4-$CH_3$ | H |

TABLE 59-continued

| COMPOUNDS NO. | $R_{15}$, $R_{15'}$ | $(R_{16})_m$, $(R_{16'})_m$ | $(R_{17})_n$, $(R_{17'})_n$ |
|---|---|---|---|
| 9 | $CH_3$ | 3,4-$CH_3$ | 3,4-$CH_3$ |
| 10 | $CH_3$ | 4-$C_2H_5$ | H |
| 11 | $CH_3$ | 4-$C_3H_7$ | H |
| 12 | $CH_3$ | 4-$C_4H_9$ | H |
| 13 | $CH_3$ | 4-$C_2H_5$ | 2-$CH_3$ |
| 14 | $CH_3$ | 4-$C_2H_5$ | 3-$CH_3$ |
| 15 | $CH_3$ | 4-$C_2H_5$ | 4-$CH_3$ |
| 16 | $CH_3$ | 4-$C_2H_5$ | 3,4-$CH_3$ |

TABLE 59-continued

| COMPOUNDS NO. | $R_{15}$, $R_{15'}$ | $(R_{16})_m$, $(R_{16'})_m$ | $(R_{17})_n$, $(R_{17'})_n$ |
|---|---|---|---|
| 17 | $CH_3$ | 4-$C_3H_7$ | 3-$CH_3$ |
| 18 | $CH_3$ | 4-$C_3H_7$ | 4-$CH_3$ |
| 19 | $CH_3$ | 4-$C_4H_9$ | 3-$CH_3$ |
| 20 | $CH_3$ | 4-$C_4H_9$ | 4-$CH_3$ |

TABLE 60

| COMPOUNDS NO. | $R_{15}$, $R_{15'}$ | $(R_{16})_m$, $(R_{16'})_m$ | $(R_{17})_n$, $(R_{17'})_n$ |
|---|---|---|---|
| 21 | $CH_3$ | 4-$C_2H_5$ | 4-$C_2H_5$ |
| 22 | $CH_3$ | 4-$C_2H_5$ | 4-$OCH_3$ |
| 23 | $CH_3$ | 4-$C_3H_7$ | 4-$C_3H_7$ |
| 24 | $CH_3$ | 4-$C_3H_7$ | 4-$OCH_3$ |
| 25 | $CH_3$ | 4-$C_4H_9$ | 4-$C_4H_9$ |
| 26 | $CH_3$ | 4-$C_4H_9$ | 4-$OCH_3$ |
| 27 | H | 3-$CH_3$ | H |
| 28 | Cl | H | H |
| 29 | Cl | 2-$CH_3$ | H |
| 30 | Cl | 3-$CH_3$ | H |
| 31 | Cl | 4-$CH_3$ | H |
| 32 | Cl | 4-$CH_3$ | 2-$CH_3$ |
| 33 | Cl | 4-$CH_3$ | 3-$CH_3$ |
| 34 | Cl | 4-$CH_3$ | 4-$CH_3$ |
| 35 | $C_2H_5$ | H | H |
| 36 | $C_2H_5$ | 2-$CH_3$ | H |
| 37 | $C_2H_5$ | 3-$CH_3$ | H |
| 38 | $C_2H_5$ | 4-$CH_3$ | H |
| 39 | $C_2H_5$ | 4-$CH_3$ | 4-$CH_3$ |
| 40 | $C_2H_5$ | 4-$C_2H_5$ | 4-$CH_3$ |

TABLE 61

| COMPOUNDS NO. | $R_{15}$, $R_{15'}$ | $(R_{16})_m$, $(R_{16'})_m$ | $(R_{17})_n$, $(R_{17'})_n$ |
|---|---|---|---|
| 41 | $C_2H_5$ | 4-$C_3H_7$ | 4-$CH_3$ |
| 42 | $C_2H_5$ | 4-$C_4H_9$ | 4-$CH_3$ |
| 43 | $OCH_3$ | H | H |
| 44 | $OCH_3$ | 2-$CH_3$ | H |
| 45 | $OCH_3$ | 3-$CH_3$ | H |
| 46 | $OCH_3$ | 4-$CH_3$ | H |
| 47 | $OCH_3$ | 4-$CH_3$ | 4-$CH_3$ |
| 48 | $OCH_3$ | 4-$C_2H_5$ | 4-$CH_3$ |
| 49 | $OCH_3$ | 4-$C_3H_7$ | 4-$CH_3$ |
| 50 | $OCH_3$ | 4-$C_4H_9$ | 4-$CH_3$ |
| 51 | $CH_3$ | 2-$N(CH_3)_2$ | H |
| 52 | $CH_3$ | 3-$N(CH_3)_2$ | H |
| 53 | $CH_3$ | 4-$N(CH_3)_2$ | H |
| 54 | $CH_3$ | 4-Cl | H |

These compounds may be used alone or in combination of two or more types. A polymeric charge transporting material may also be used. For the polymeric charge transporting material, a well known material such as poly-N-vinyl carbazole or polysilane may be used. Particularly, the polyester based polymeric charge transporting materials described in Japanese Patent Laid-Open Publication No. Hei 8-176293 and Japanese Patent Laid-Open Publication No. Hei 8-208820 have a high level of charge transport property and are thus especially preferable. The polymeric charge transporting material is capable of forming a film by itself, but may be mixed with the binder resin to form a film.

Furthermore, for the binder resin for use in the charge transport layer, polycarbonate resins, polyester resins, methacryl resins, acryl resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicon resins, silicon-alkyd resins, phenol-formaldehyde resins, styrene-alkyd resins, and polymeric charge transporting materials such as poly-N-vinyl carbazole, polysilane, and polyester based polymeric charge transporting materials described in Japanese Patent Laid-Open Publication No. Hei 8-176293 and Japanese Patent Laid-Open Publication No. Hei 8-208820 may be used. Furthermore, organic zirconium compounds such as zirconium chelate compounds, zirconium alkoxide compounds and zirconium coupling agents, organic titanium compounds such as titanium chelate compounds, titanium alkoxide compounds and titanate coupling agents, organic aluminum compounds such as aluminum chelate compounds and aluminum coupling agents, and organic metal compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicone alkoxide compounds, aluminum titanium alkoxide compounds and aluminum zirconium alkoxide compounds are used, and organic zirconium compounds, organic titanium compounds and organic aluminum compounds are especially suitable for use because they have reduced rest potentials and exhibit excellent electrophotographic characteristics. In addition, silane coupling agents such as vinyl trichlorosilane, vinyl trimethoxysilane, vinyl triethoxysilane, vinyl tris-2-methoxyethoxysilane, vinyl triacetoxysilane, γ-glycidoxypropyl trimethoxysilane, γ-methacryloxypropyl trimethoxysilane, γ-aminopropyl triethoxysilane, γ-chloropropyl trimethoxysilane, γ-2-aminoethylaminopropyl trimethoxysilane, γ-mercapropropyl trimethoxysilane, γ-ureidepropyl trimethoxy silane and β-3,4-epoxycyclohexyl trimethoxysilane, or curable matrixes such as photo-curable resins may be used, and charge transporting agents of, for example, compound (I) capable of being cured with the above compounds may be used. These binder resins may be used alone or in combination of two or more types. The ratio (by weight) of the charge transporting material to the binder resin is preferably 10:1 to 1:5.

The thickness of the charge transport layer for use in the present invention is generally 5 to 50 μm, preferably 10 to 30 μm. For the coating method, a usual method such as a blade coating method, mayer bar coating method, spray coating method, dip coating method, bead coating method, air knife coating method or curtain coating method may be used.

Furthermore, for the solvent for use in formation of the charge transport layer, usual organic solvents such as aromatic hydrocarbons such as benzene, toluene, xylene and chlorobenzene, ketones such as acetone and 2-butanone, halogenated aliphatic hydrocarbons such as methylene chloride, chloroform and ethylene chloride, tetrahydrofuran, and cyclic or straight-chain ethers such as ethyl ether may be used alone or in a combination of two or more types.

In addition, additives such as an anti-oxidizing agent, a light stabilizer and a heat stabilizer may be added in the photosensitive layer for the purpose of preventing degradation of the photosensitive member caused by ozone and oxidizing gases produced in an image forming apparatus, or light and heat. Anti-oxidizing agents include, for example, hindered phenol, hindered amine, paraphenylenediamine, arylalkane, hydroquinone, spirochroman, spiroindanone and their derivatives, organic sulfur compounds and organic phosphorous compounds. Examples of the light stabilizer include derivatives of benzophenone, benzotriazole, dithiocarbamate and tetramethyl piperidine and the like.

In addition, at least one type of electron acceptor may be incorporated for improvement of sensitivity, reduction of rest potentials, alleviation of fatigue resulting from repeated use, and so on. Electron acceptors capable of being used in the photosensitive member of the present invention may include, for example, succinic anhydride, maleic anhydride, maleic dibromanhydride, phthalic anhydride, phthalic tetrabromanhydride, tetracyanoethylene, tetracyanoquinodimethane, o-dinitrobenzene, m-dinitrobenzene, chloranil, dinitroanthraquinone, trinitrofurolenone, picric acid, o-nitrobenzoic acid, p-nitrobenzoic acid and phthalic acid as well as the compound (I). Among them, furolenone based compounds, quinone based compounds, and benzene derivatives having electron absorbing substituents such as Cl, CN and $NO_2$ are especially preferable.

(Developing Stage)

The developing stage described above is a stage of developing an electrostatic latent image on the surface of a latent image holding member to obtain a toner image using a developer layer containing at least a toner, which is formed on the surface of the latent image holding member. In the developing stage, the developer layer is conveyed to a developing nip, the developer layer and the latent holding member are placed in contact with each other or at a certain interval, and the electrostatic latent image on the surface of the latent image holding member are developed by the toner while applying a bias to between the developer holding member and the latent image holding member.

The developer contains at least a toner, and contains other components as required. The developer is a so called two-component developer for charging the toner using a carrier, a single-component developer for forming a thin film to charge the toner using a layer controlling blade or the like on the developer holding member, or the like.

(Transfer Stage)

The transfer stage is a stage of transferring a toner image formed on the surface of the latent image holding member directly to the surface of a recording material; or a stage comprised of a first transfer stage of transferring the toner image to the surface of an intermediate transferring member, and a second transfer stage of transferring the toner image formed on the surface of the intermediate transferring member to the surface of the recording material.

Transfer methods include contact-type transfer in which a transferring roller, transferring belt or the like is abutted against the electrostatic latent image holding member to transfer a toner image on the surface of the recording material or intermediate transferring member, and non-contact-type transfer in which a corotron or the like is used to transfer the toner image to the surface of the recording material or intermediate transferring member. Particularly, in a full color image forming apparatus, previously known transfer methods and the like are suitable for use, such as a method in which a transferring roll around which a transfer paper is wound, a conveyor belt and the like are used to transfer toners of four colors of yellow, magenta, cyan and black, or the like, directly to the transfer paper, and a transfer method using an indirect transfer system in which the toners of four colors or the like are multiple-transferred to the surface of the belt-shaped or cylindrical intermediate transferring member (first transfer stage), and the toner is then transferred to the recording material (second transfer stage).

(Fixation Stage)

The fixation stage is a stage of fixing the toner image transferred to the surface of the recording material, and fixation using a contact thermal fixation system or the like is one of suitable fixation methods. Specifically, heat roller fixation and belt fixation are used.

(Other Stages)

The other stages include, for example, a charging stage, a light exposure stage and a cleaning stage. The charging stage is a stage of uniformly charging the surface of the latent image holding member, and for the charging method in the charging stage, a well known method using a non-contact charging system with a corotron or the like, or contact charging system with a charging roller, charging film, charging brush or the like may be selected as appropriate, but a contact charging device is suitable for use in terms of alleviation of the amount of ozone emission. The light exposure stage is a stage of exposing the surface of the latent image holding member (surfaces of the photosensitive layer, the dielectric layer and the like) to light after the charging stage by an electrophotographic method or electrostatic recording method to form an electrostatic latent image on the surface of the surface of the latent image holding member. For the light exposure method in the light exposure stage, a well known light exposure method may be selected as appropriate.

In addition, the double side image forming method according to the present invention is a method of forming images on both sides of a recording material using a double side image forming apparatus described below.

The double side image forming apparatus comprises charging means for charging a latent image holding member, latent image processing means for forming an electrostatic latent image on the charged latent image holding member by exposing the same to light, developing means for developing the above described electrostatic latent image using a toner, transfer-separate means for transferring a formed first toner image to a first face of a recording material to separate the toner image from the latent image holding member being a toner image holding member, and transferring a formed second toner image to a second face of the recording material to separate the toner image from the above described latent image holding member, and fixation means for heat-fixing the transferred first and second toner images to first and second faces of the recording material one after another with a roller or belt.

Furthermore, in the double side image forming method using the double side image forming apparatus described above, the developing stage, the transfer stage, the fixation stage and other stages are same as those described above, and therefore these stages are not described here.

The transfer-separate means in the double side image forming apparatus may be such that the toner of each color is developed on the latent image holding member, transferred to a (intermediate) transferring belt or (intermediate) transferring drum, and then transferred to the first and second faces of the recording material at a time.

In addition, by using the toner of the present invention, stable developing, transfer and fixation performances can be achieved without the possibility of a specific toner being selectively accumulated even if a residual toner is collected in a developing device without providing a cleaning system on the latent holding member.

In addition, the fixation means in the double side image forming apparatus according to the present invention may be fixation means supplying no release agent, namely oilless fixation means.

The fixation means described above are not specifically limited as long as they are, for example, well known oilless heat fixing means, but preferable are belt-nip-type fixation means constituted by a heat fixing roller and an endless belt, in which a transferring material having a toner image formed thereon is made to pass through a formed nip to fix the toner image.

Double-sided copying is achieved by fixing the toner image on the first face, and then transferring and fixing the toner image to the second face.

EXAMPLES

The present invention will be more specifically described below with Examples. Furthermore, in descriptions of toner compositions and carriers, "part" means "part by weight" unless otherwise specified.

Furthermore, in production of toner compositions, carrier and electrostatic latent image developers, measurements are made by the methods described below.

<Measurement of Volume Average Particle Size of Calcium Compound Particles>

Particles are embedded in a curable resin, thinly sliced by a diamond cutter, and observed by a TEM. The image thereof is printed, 50 samples are randomly extracted with a primary particle as a sample, and the diameter of a circular particle corresponding to the area of the image is defined as a volume average particle size.

<Measurement of Resistance>

Figure 6:
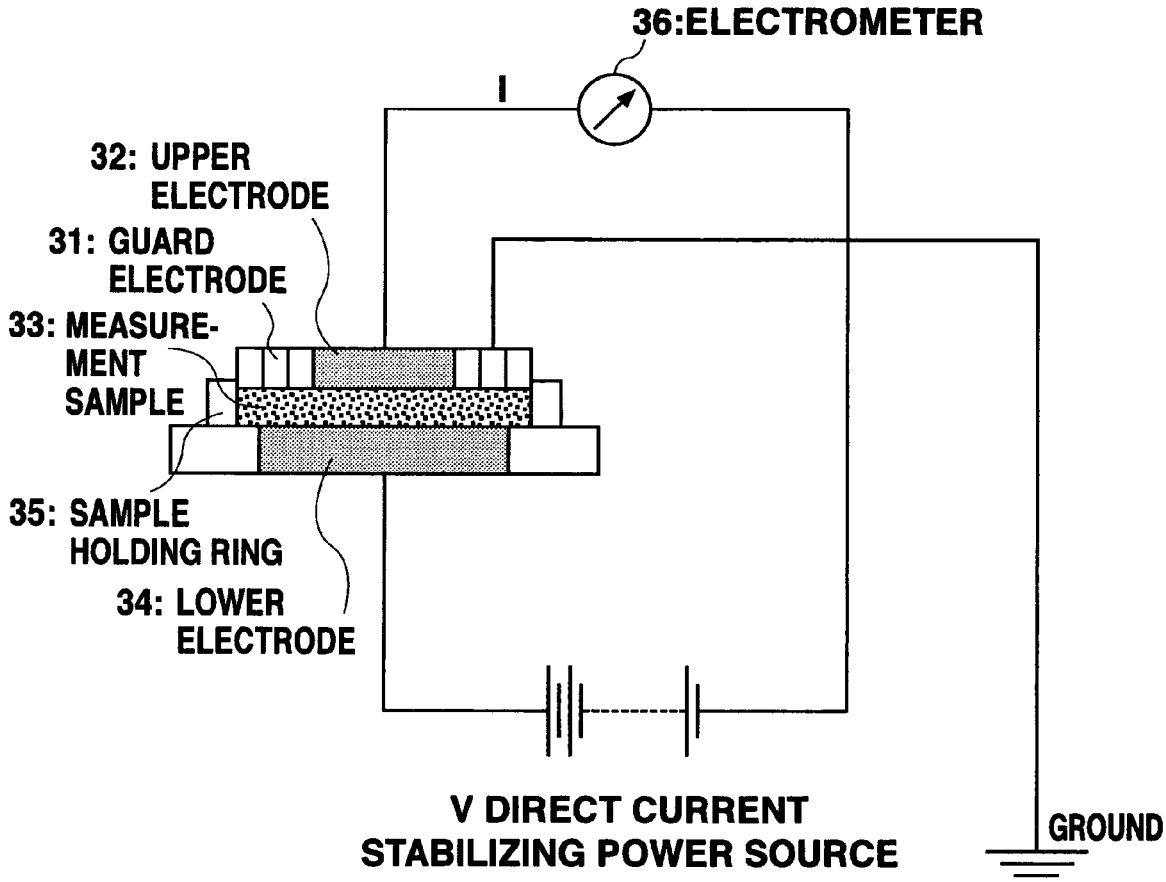
FIG. 6 is a schematic diagram showing an apparatus configuration for the volume specific resistances of carriers used in Examples and Comparative Examples of the present invention.
Figure 7:
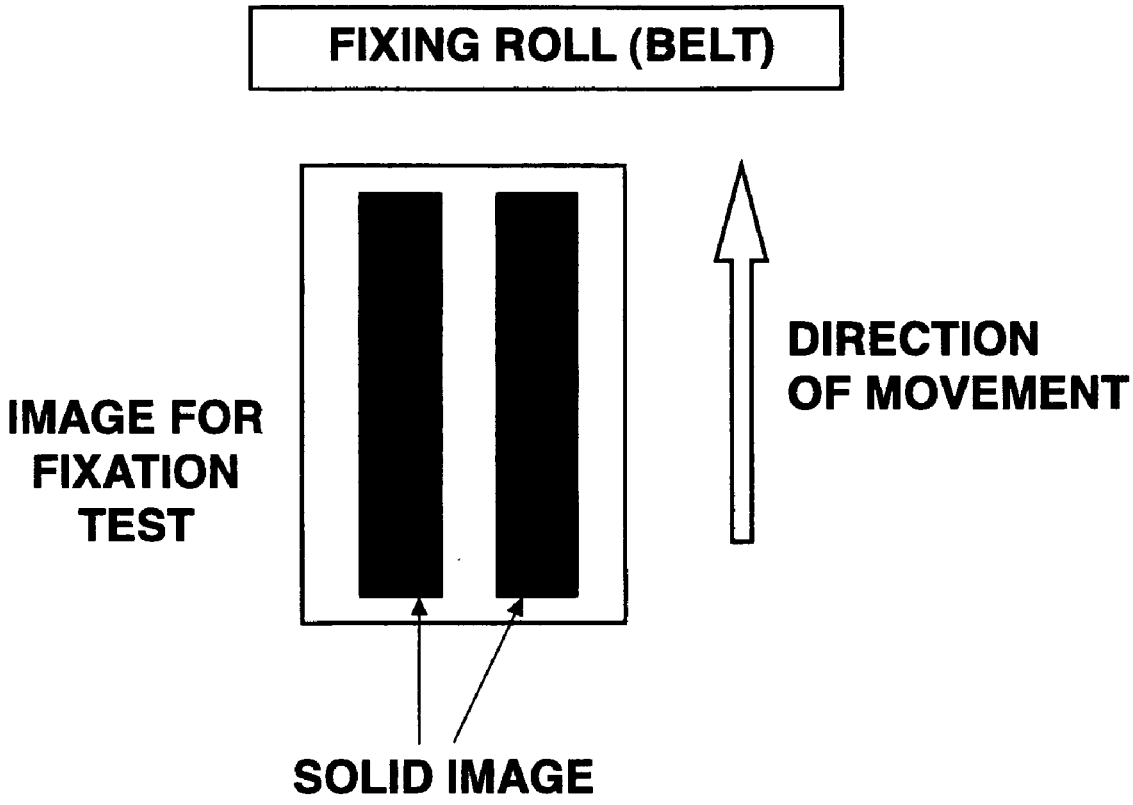
FIG. 7 is a schematic diagram showing solid image forming during evaluation of toner distribution.

As shown in FIG. 6, a measurement sample 33 having a thickness of H is held between a lower electrode 34 and an upper electrode 32, and the thickness is measured with a pressure applied from above to measure the electrical resistance of the measurement sample 33 by a high voltage resistance meter. Specifically, a pressure of 500 kg/cm$^2$ is applied to a specified titanium oxide sample in a molding machine to prepare a measurement disk. Then, the surface of the disk is cleaned by a brush, the disk is held between the upper electrode 32 and the lower electrode 34 in a cell, and the thickness is measured by a dial gauge. Then, a voltage is applied, and a current value in an electrometer 36 is read to determine a volume specific resistance.

In addition, a sample of the carrier is filled in the lower electrode 34 of 100 ϕ, an upper electrode 32 is set, a load of 3.43 kg is applied from above the electrode, and the thickness is measured by a dial gauge. Then, a voltage is applied, and a current value in the electrometer 36 is read to determine a volume specific resistance.

<Average Shape Factor SF1 of Toner>

In the present invention, the average shape factor SF1 of the toner means a value calculated using the following equation, and SF1 equals 100 in the case of a spherical form.

$$SF1=(ML^2/A)\times(\pi/4)\times 100$$

where ML is the absolute maximum length of the toner, A is the projector area of the toner, and they are determined as values by analyzing mainly a microscopic image or scanning electron microscopic image using an image analyzing apparatus.

As a specific method for determining an average shape factor, a toner image is captured in an image analyzing apparatus (LUZEX III manufactured by Nireco Co., Ltd.) from an optical microscope to measure a circle equivalent diameter, and the value of the above SF1 is determined for each particle from the maximum length and the area.

<Measurement of Charge Amount>

The charge amount in a full-scale evaluation test is measured by collecting a developer on a mug sleeve in a developing device to measure the charge amount by TB 200 manufactured by Toshiba Co., Ltd. at a temperature of 25° C. and a relative humidity of 55% as described above.

<Population of Calcium Compound Particles on Toner Surface>

In the present invention, the population of calcium compound particles on the toner surface means a value obtained by measuring calcium compound particles and the toner, respectively, by elemental analysis XPS (JPS-9000 MX manufactured by JEOL Ltd.), and performing calculation according to the following equation.

$$\text{population of calcium compound particles on toner surface} = (\text{ratio of Ca to all detected elements on toner surface})/(\text{ratio of Ca to all detected elements on surfaces of calcium compound particles})\times 100$$

[Preparation of Calcium Compound Particles]

(A) Preparation of Calcium Carbonate Particles

Preparation of particles: 30% carbon dioxide is blown into 1,000 g of 6 wt % milk of lime at a rate of 2.5 L/min at a combination starting temperature of 17° C., and is allowed to undergo a reaction until the electric conductance of the suspension secondarily drops and stabilizes in a 2 L stainless beaker. The reaction solution is filtered under a reduced pressure by a Buchner funnel (Nutsche funnel) to separate a mother liquor, and the residue is then dried and ground to obtain calcium carbonate particles.

Surface treatment: Then, the calcium carbonate particles are dispersed in a toluene solution, silicone oil is put into the dispersion, toluene is evaporated away by an evaporator with application of an ultrasonic wave, and the residue is heated at 150° C. for 1 hour, and then ground to obtain surface-treated calcium carbonate particles (A) having an average particle size of 15 nm.

(B) Preparation of Calcium Carbonate Particles

Particles are prepared in the same manner as in (A) except that the combination starting temperature is changed to 20° C., and a surface treatment is carried out in the same manner as in (A) to obtain surface-treated calcium carbonate particles (B) having an average particle size of 50 nm.

(C) Preparation of Calcium Carbonate Particles

Particles are prepared in the same manner as in (A) except that the combination starting temperature is changed to 25° C., and a surface treatment is carried out in the same manner as in (A) except that the surface treating agent is changed from silicone oil to decyltriethoxysilane to obtain surface-treated calcium carbonate particles (C) having an average particle size of 70 nm.

(D) Preparation of Calcium Carbonate Particles

30% carbon dioxide is blown into 1,000 g of 17 wt % milk of lime at a rate of 2.0 L/min at a combination starting temperature of 25° C., and is allowed to undergo a reaction until the electric conductance of the suspension secondarily drops and stabilizes in a 2 L stainless beaker. The reaction solution is filtered under a reduced pressure by a Buchner funnel (Nutsche funnel) to separate a mother liquor, and the residue is then dried and ground to obtain calcium carbonate particles. A surface treatment is carried out in the same manner as in (A) to obtain surface-treated calcium carbonate particles (D) having an average particle size of 200 nm.

(E) Preparation of Surface-untreated Calcium Carbonate Particles

30% carbon dioxide is blown into 1,000 g of 6 wt % milk of lime at a rate of 2.5 L/min at a combination starting temperature of 17° C., and is allowed to undergo a reaction until the electrical conductance of the suspension secondarily drops and stabilizes in a 2 L stainless beaker. The reaction solution is filtered under a reduced pressure by a Buchner funnel (Nutsche funnel) to separate a mother liquor, and the residue is then dried and ground to obtain calcium carbonate particles (E) having an average particle size of 14 nm.

(F) Preparation of Calcium Sulfoaluminate Particles 470 g of 8% aqueous aluminum sulfate solution is added to 500 g of 18 wt % milk of lime in a 2 L stainless beaker. Then, the resultant mixture is stirred while it is heated at 40° C. for 1 hour for aging. The reaction solution is filtered under a reduced pressure by a Buchner funnel (Nutsche funnel) to separate a mother liquor, and the residue is then dried and ground sufficiently to obtain calcium sulfoaluminate particles (F) having an average particle size of 60 nm.

[Method for Producing Colored Particles]

(i) Method for Producing Colored Particles A

| | |
|---|---|
| styrene-n-butyl alcohol resin (Tg = 58° C., Mn = 4,000, Mw = 25,000) | 100 parts |
| carbon black (MOGUL ® L manufactured by Cabot Corporation) | 3 parts |

The above mixture is kneaded by an extruder, ground by a jet mill, and then dispersed by an air classifier to obtain a black toner A with D50=5.0 μm and SF1=148.8.

(ii) Method for Producing Colored Particles B

<Preparation of Resin Dispersion (1)>

| | |
|---|---|
| styrene | 370 parts by weight |
| n-butyl acrylate | 30 parts by weight |
| acrylic acid | 8 parts by weight |
| dodecanethiol | 24 parts by weight |
| carbon tetrabromide | 4 parts by weight |

A material obtained by mixing and dissolving together the above components is emulsification-dispersed in a solution of 6 g of non-ionic surfactant (NONIPOL 400 manufactured by Sanyo Chemical Industries, Ltd.) and 10 g of anionic surfactant (NEOGEN SC manufactured by Dai-ichikogyo Seiyaku Co., Ltd.) in 550 g of ion-exchanged water in a flask, and 50 g of ion-exchanged water having dissolved therein 4 g of ammonium persulfate is put into the resultant dispersion while stirring the dispersion slowly for 10 minutes. After gas in the flask is replaced with nitrogen, the content of the flask is stirred while the flask is heated in an oil bath until the content of the flask reaches a temperature of 70° C., and emulsification polymerization is continued for 5 hours. As a result, a resin dispersion (1) having dispersed therein resin particles with the particle size of 155 nm, Tg of 59° C. and the weight average molecular weight Mw of 12,000 is obtained.

<Preparation of Resin Dispersion (2)>

| | |
|---|---|
| styrene | 280 parts by weight |
| n-butyl acrylate | 120 parts by weight |
| acrylic acid | 8 parts by weight |

A material obtained by mixing and dissolving together the above components is emulsification-dispersed in a solution of 6 g of non-ionic surfactant (NONIPOL 400 manufactured by Sanyo Chemical Industries, Ltd.) and 12 g of anionic surfactant (NEOGEN SC manufactured by Dai-ichikogyo Seiyaku Co., Ltd.) in 550 g of ion-exchanged water in a flask, and 50 g of ion-exchanged water having dissolved therein 3 g of ammonium persulfate is put into the resultant dispersion while stirring the dispersion slowly for 10 minutes. After gas in the flask is replaced with nitrogen, the content of the flask is stirred while the flask is heated in an oil bath until the content of the flask reaches a temperature of 70° C., and emulsification polymerization is continued for 5 hours. As a result, a resin dispersion (2) having dispersed therein resin particles with the particle size of 105 nm, Tg of 53° C. and the weight average molecular weight Mw of 550,000 is obtained.

[Colorant Dispersion]

<Preparation of Colorant Dispersion (1)>

| | |
|---|---|
| carbon black (MOGUL ® L manufactured by Cabot Corporation) | 50 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (1) having dispersed therein colorant (carbon black) particles with the average particle size of 250 nm.

<Preparation of Colorant Dispersion (2)>

| | |
|---|---|
| Cyan pigment C.I. Pigment Blue 15:3 | 70 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (2) having dispersed therein colorant (Cyan pigment) particles with the average particle size of 250 nm.

<Preparation of Colorant Dispersion (3)>

| | |
|---|---|
| Magenta pigment C.I. Pigment Red 122 | 70 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (3) having dispersed therein colorant (Magenta pigment) particles with the average particle size of 250 nm.

<Preparation of Colorant Dispersion (4)>

| | |
|---|---|
| Yellow pigment C.I. Pigment Yellow 180 | 100 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (4) having dispersed therein colorant (Yellow pigment) particles with the average particle size of 250 nm.

[Preparation of Release Agent Dispersion (1)]

| | |
|---|---|
| paraffin wax (HNPO 190 manufactured by Nippon Seiro Co., Ltd., melting point 85° C.) | 50 parts by weight |
| cationic surfactant (SANIZOL B 50 manufactured by Kao Corporation) | 5 parts by weight |

The above components are dispersed for 10 minutes using a homogenizer (Ultra Tarax T50 manufactured by IKA Corporation) in a stainless steel rounded flask, and then dispersed by a pressure discharge-type homogenizer to prepare a release agent dispersion (1) having dispersed therein release agent particles with the average particle size of 550 nm.

[Preparation of Agglomerated Particles]

| | |
|---|---|
| resin dispersion (1) | 120 parts by weight |
| resin dispersion (2) | 80 parts by weight |
| colorant dispersion (1) | 200 parts by weight |
| release agent dispersion (1) | 40 parts by weight |
| cationic surfactant (SANISOL B50 manufactured by Kao Corporation) | 1.5 parts by weight |

The above components are mixed and dispersed using a homogenizer (Ultra Tarax T50 manufactured by IKA Corporation) in a stainless steel rounded flask, and the content of the flask is stirred while it is heated to 50° C. in a heating oil bath. After the resultant dispersion is left standing at 45° C. for 20 minutes, an observation is made by an optical microscope to find that agglomerated particles with the average particle size of about 5.0 μm are formed. 60 g of resin dispersion (1) is gently added to the dispersion as a resin containing fine particle dispersion. Then, the temperature of the heating oil bath is increased to 50° C., and the mixture is left standing for 30 minutes. An observation is made by the optical microscope to find that deposit particles with the average particle size of about 5.6 μm are formed.

[Preparation of Colorant Particles B]

3 g of anionic surfactant (NEOGEN SC manufactured by Dai-ichikogyo Seiyaku Co., Ltd.) is added to the agglomerated particles described above, the stainless steel rounded flask is then sealed, and the content of the flask is heated to 105° C. while stirring using a magnetic seal, and is left standing for 4 hours. Then, after cooling, the reaction product is filtered, sufficiently washed with ion-exchanged water, and then dried to obtain electrostatic image developing colored particles B.

<Production of Colored Particles Kuro B>

The colorant dispersion (1) is used to obtain a Kuro toner with the SF1 of 128.5 and the particle size D50 of 5.8 μm by the above described methods for preparation of agglomerated particles and colored particles.

<Production of Colored Particles Cyan B>

Agglomerated particles are prepared in the same manner as in the above described method for preparation of agglomerated particles except that a colorant dispersion (2) is used instead of the colorant dispersion (1), and colored particles are prepared in the same manner as in the above described method for colored particles to obtain a Cyan toner with SF1 of 130 and the particle size D50 of 5.6 μm.

<Production of Colored Particles Magenta B>

Agglomerated particles are prepared in the same manner as in the above described method for preparation of agglomerated particles except that a colorant dispersion (3) is used instead of the colorant dispersion (1), and colored particles are prepared in the same manner as in the above described method for colored particles to obtain a Magenta toner with SF1 of 132.5 and the particle size D50 of 5.5

<Production of Colored Particles Yellow B>

Agglomerated particles are prepared in the same manner as in the above described method for preparation of agglomerated particles except that a colorant dispersion (4) is used instead of the colorant dispersion (1), and colored particles are prepared in the same manner as in the above described method for colored particles to obtain a Yellow toner with SF1 of 127 and the particle size D50 of 5.9 μm.

<Production of Carrier>

| | |
|---|---|
| ferrite particles (average particle size: 50 μm) | 100 parts |
| toluene | 14 parts |
| styrene-methyl methacrylate copolymer (ratio of components: 90/10, Mw = 65,000) | 2 parts |
| carbon black (R330 manufactured by Cabot Corporation) | 0.2 parts |

First, the above components except for ferrite particles are stirred by a stirrer for 10 minutes to prepare a dispersed covering solution, and the covering solution and ferrite particles are then put in a vacuum degassing kneader, where they are stirred at 60° C. for 30 minutes, then degassed by applying heat and reducing a pressure at the same time, and dried to obtain a carrier. This carrier has a volume specific resistance value of $10^{11}$ Ωcm when an electric field of 1,000 V/cm is applied.

EXAMPLE 1

1 part of calcium carbonate particles (A) and 1.3 parts of hydrophobic silica (RX50 manufactured by Nippon Aerosil Co., Ltd.) having an average particle size of 40 nm are blended with 100 parts of the above colored particles B of Kuro B, Cyan B, Magenta B and Yellow B toners, respectively, at a circumferential speed of 32 m/s for 10 minutes using a Henschel mixer, and coarse particles are then removed using a 45 μm mesh sieve to obtain toners. 100 parts of the carrier described above and 5 parts of the above toner are stirred at 40 rpm for 20 minutes using a V blender, and screened with a sieve having a mesh size of 177 μm to obtain a developer.

EXAMPLE 2

1 part of calcium carbonate particles (B) and 1.0 part of hydrophobic silica (R972 manufactured by Nippon Aerosil Co., Ltd.) having an average particle size of 16 nm are blended with 100 parts of the above colored particles Kuro B at a circumferential speed of 32 m/s for 10 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

EXAMPLE 3

0.7 parts of calcium carbonate particles (C) and 1.5 parts of hydrophobic silica (R972 manufactured by Nippon Aerosil Co., Ltd.) having an average particle size of 16 nm are blended with 100 parts of the above colored particles Kuro B at a circumferential speed of 32 m/s for 10 minutes using a Henschel mixer, and coarse particles are then removed using a 45 μn mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

EXAMPLE 4

1.3 parts of calcium carbonate particles (A) and 1.2 parts of hydrophobic silica (RX50 manufactured by Nippon Aerosil Co., Ltd.) having an average particle size of 40 nm are blended with 100 parts of the above colored particles Kuro A at a circumferential speed of 32 m/s for 10 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

EXAMPLE 5

0.5 parts of calcium carbonate particles (B) and 1.4 parts of hydrophobic silica (RX50 manufactured by Nippon Aerosil Co., Ltd.) having an average particle size of 40 nm are blended with 100 parts of the above colored particles Kuro B at a circumferential speed of 20 m/s for 5 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

EXAMPLE 6

2 parts of calcium carbonate particles (A) and 1.4 parts of hydrophobic silica (RX50 manufactured by Nippon Aerosil Co., Ltd.) having an average particle size of 40 nm are blended with 100 parts of the above colored particles Kuro B at a circumferential speed of 20 m/s for 5 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

EXAMPLE 7

6 parts of calcium carbonate particles (A) and 1.7 parts of hydrophobic silica (RX50 manufactured by Nippon Aerosil Co., Ltd.) having an average particle size of 40 nm are blended with 100 parts of the above colored particles Kuro B at a circumferential speed of 20 m/s for 5 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

EXAMPLE 8

A toner is prepared to obtain a developer in the same manner as in Example 3 except that calcium carbonate particles (E) are used instead of calcium carbonate particles (C).

EXAMPLE 9

A toner is prepared to obtain a developer in the same manner as in Example 3 except that calcium sulfoaminate particles (F) are used instead of calcium carbonate particles (C).

Comparative Example 1

0.7 parts of hydrophobic titanium oxide (T805 manufactured by Nippon Aerosil Co., Ltd.) having an average particle size of 21 nm and 1.2 parts of hydrophobic silica (RX50 manufactured by Nippon Aerosil Co., Ltd.) are blended with 100 parts of the above colored particles Kuro B at a circumferential speed of 32 m/s for 10 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

Comparative Example 2

0.8 parts of calcium carbonate particles (D) and 1.4 parts of hydrophobic silica (R972 manufactured by Nippon Aerosil Co., Ltd.) having an average particle size of 16 nm are blended with 100 parts of the above colored particles Kuro B at a circumferential speed of 20 m/s for 5 minutes using a Henschel mixer, and coarse particles are then removed using a 45 μm mesh sieve to obtain a toner. 100 parts of the carrier described above and 5 parts of the above toner are stirred at 40 rpm for 20 minutes using a V blender, and screened with a sieve having a mesh size of 177 μm to obtain a developer.

Comparative Example 3

A toner is prepared in the same manner as in Example 3 except that 0.3 parts of calcium carbonate particles (C) are used instead of 0.7 parts of calcium carbonate particles (C). 100 parts of the carrier described above and 5 parts of the above toner are stirred at 40 rpm for 20 minutes using a V blender, and screened with a sieve having a mesh size of 177 μm to obtain a developer.

Comparative Example 4

A toner is prepared to obtain a developer in the same manner as in Example 7 except that 8.5 parts of calcium carbonate particles (A) are used instead of 6 parts of calcium carbonate particles (A).

[Evaluations]

The developers of the Examples and Comparative Examples described above are used to make evaluations on the charge amount, transferability and fixing characteristics using modified Docu Centre Color 500 manufactured by Fuji Xerox Co., Ltd., which is a double side image forming apparatus, comprising charge means for charging a latent image holding member, latent image processing means for forming an electrostatic latent image on the charged latent image holding member by exposing the same to light, developing means for developing the above described electrostatic image using a toner, transfer-separate means for transferring a formed first toner image to a first face of a recording material to separate the toner image from the latent image holding member being a toner image holding member, and transferring a formed second toner image to a second face of the recording material to separate the toner image from the above described latent image holding member, cleaning means for removing a toner remaining on the latent image holding member after the toner is transferred, and fixation means for heat-fixing the transferred first and second toner images to first and second faces of the recording material one after another. Furthermore, double side image forming is achieved by heat-fixing the first toner image to the first face of the recording material by a roll, and then transferring the formed second toner image to the second face of the recording material and heat-fixing the same thereto by a roller.

In addition, the recording material used in the above modified apparatus is J paper (A4 size paper containing calcium carbonate) manufactured by Fuji Xerox Co., Ltd.

The charge environment stability of the charge amount is rated as follows.

$\Delta TV$=(charge amount at temperature and humidity of 10° C. and 20%)−(charge amount at temperature and humidity of 29° C. and 90%).

$\Delta TV < 8$ μC/g . . . ○, $\Delta TV \geqq 8$ μC/g . . . x

For evaluation of transferability, transfer is hard-stopped at the time when the transferring stage is ended, the amount of transferred toner a is determined from measurements of the weight of the toner on the transferring material before and after removal of the toner, the amount of toner remaining on the photosensitive member b is determined in the same way, and a transfer efficiency is calculated from the following equation.

transfer efficiency $\eta(\%)=a\times 100/(a+b)$

The transferability is rated as follows.

$\eta \geqq 90\%$ . . . ○

$\eta < 90\%$ . . . x

For uneven toner distributions on the second face of the A4 size paper, images are printed on both faces of the A4 size paper, and sensory evaluations are made on the line areas of the images. Also, sensory evaluations are made on reproducibility of the medium color of the color image on the second face of the A4 size paper.

The results are shown in Table 62.

TABLE 62

RESULTS OF EVALUATION WITH MODIFIED DOCU CENTRE COLOR 500

| | VOLUME AVERAGE PARTICLE SIZE D(NM) | ADDED AMOUNT (wt %) | W/d | CHARGING CHARACTERISTICS (μC/G) TEMPERATURE AND HUMIDITY = 29° C., 90% | CHARGING CHARACTERISTICS (μC/G) TEMPERATURE AND HUMIDITY = 10° C., 20% | CHARGING CHARACTERISTICS (μC/G) RATE | TRANSFERABILITY (TRANSFER EFFICIENCY % = TRANSFERRED AMOUNT/ DEVELOPED AMOUNT) TEMPERATURE AND HUMIDITY = 29° C., 90% | TRANSFERABILITY RATE | TRANSFERABILITY TEMPERATURE AND HUMIDITY = 10° C., 20% | TRANSFERABILITY RATE | UNEVEN TONER DISTRIBUTIONS ON SECOND FACE OF PAPER | REPRODUCIBILITY OF MEDIUM COLOR ON SECOND FACE OF PAPER |
|---|---|---|---|---|---|---|---|---|---|---|---|---|
| EXAMPLE 1 | | | | | | | | | | | | |
| K | 15 | 1 | 66.7 | 35 | 40 | ○ | 93 | ○ | 95 | ○ | NONE | GOOD |
| C | 15 | 1 | 66.7 | 35 | 40 | ○ | 95 | ○ | 97 | ○ | NONE | GOOD |
| M | 15 | 1 | 66.7 | 34 | 36 | ○ | 94 | ○ | 97 | ○ | NONE | GOOD |
| Y | 15 | 1 | 66.7 | 37 | 44 | ○ | 93 | ○ | 96 | ○ | NONE | GOOD |
| EXAMPLE 2 | 50 | 1 | 20 | 34 | 38 | ○ | 95 | ○ | 97 | ○ | NONE | GOOD |
| EXAMPLE 3 | 70 | 0.7 | 10 | 36 | 41 | ○ | 96 | ○ | 98 | ○ | NONE | GOOD |
| EXAMPLE 4 | 15 | 1.3 | 86.7 | 30 | 35 | ○ | 90 | ○ | 92 | ○ | NONE | GOOD |
| EXAMPLE 5 | 50 | 0.5 | 10 | 34 | 40 | ○ | 93 | ○ | 95 | ○ | NONE | GOOD |
| EXAMPLE 6 | 15 | 2 | 133 | 31 | 33 | ○ | 94 | ○ | 96 | ○ | NONE | GOOD |
| EXAMPLE 7 | 15 | 6 | 400 | 23 | 27 | ○ | 95 | ○ | 97 | ○ | NONE | GOOD |
| EXAMPLE 8 | 14 | 0.7 | 50 | 32 | 35 | ○ | 95 | ○ | 96 | ○ | NONE | GOOD |
| EXAMPLE 9 | 60 | 0.7 | 11.7 | 34 | 38 | ○ | 96 | ○ | 98 | ○ | NONE | GOOD |
| COMPARATIVE EXAMPLE 1 | — | 0 | 0 | 32 | 40 | X | 93 | ○ | 96 | ○ | RECOGNIZABLE | BAD |
| COMPARATIVE EXAMPLE 2 | 200 | 0.8 | 4 | 34 | 42 | X | 92 | ○ | 94 | ○ | SLIGHTLY RECOGNIZABLE | BAD |
| COMPARATIVE EXAMPLE 3 | 70 | 0.3 | 4.3 | 34 | 43 | X | 93 | ○ | 95 | ○ | SLIGHTLY RECOGNIZABLE | BAD |
| COMPARATIVE EXAMPLE 4 | 15 | 8.5 | 567 | 17 | 20 | ○ | 88 | X | 91 | ○ | (FOGGING) | BAD (CHARGE AMOUNT IS TOO SMALL) |

Note:
In Table 62, K represents Black, C represents Cyan, M represents Magenta, and Y represents Yellow.

For the developer having a toner containing calcium compound particles of the present invention in which the amount W of added calcium compound particles and the particle size d of the calcium compound particles meet the requirement of 5<W/d<500, almost no uneven toner distributions occur in the second face (back face) of the paper when images are formed on both faces, the medium color of the color print on the second face is clear, and both the charge environment stability and transfer ability are satisfactory, as shown in the results of Examples 1 to 9.

On the other hand, for the developer having a toner containing no calcium compound particles, or containing calcium compound particles in which the requirement of 5<W/d<500 is not met and W/d is equal to or smaller than 5, the toner in the line image area is unevenly distributed in the second face of the paper, the medium color of the color print is unclear, and the charge environment stability is slightly poor as shown in the results of Comparative Examples 1, 2 and 3, resulting in unsatisfactory image quality. In addition, for the developer having a toner with W/d equal to or greater than 500, the charge amount is so small that fogging occurs and the medium color of the color print is unclear as shown in the results of Comparative Example 4, resulting in unsatisfactory image quality.

In addition, when the cleaning blade of the above system is removed, an electrostatic brush is added, and the charging apparatus is changed to a roller charging apparatus to conduct studies using Kuro B of Example 5, images as clear as those in the initial stage are obtained even after 20,000 copies are made, and no problems arise in terms of images.

Furthermore, when in the above system, no blade and brush cleaning is used, but a corotron charging device is used to conduct studies using Kuro B of Example 5, images as clear as those in the initial stage are obtained even after 20,000 copies are made, and no problems arise in terms of images.

In addition, Examples and Comparative Examples where other calcium compound particles are used will be described below.

[Preparation of Calcium Compound Particles]

(G) Preparation of Calcium Carbonate Particles

30% carbon dioxide is blown into 1,000 g of 15 wt % milk of lime at a rate of 2.0 L/min at a combination starting temperature of 25° C., and is allowed to undergo a reaction until the electric conductance of the suspension secondarily drops and stabilizes in a 2 L stainless beaker. The reaction solution is filtered under a reduced pressure by using a Buchner funnel (Nutsche funnel) to separate a mother liquor, and the, residue is then dried and ground to obtain calcium carbonate particles (G) with the particle size of 130 nm.

(H) Preparation of Calcium Carbonate Particles

Then, the calcium carbonate particles (G) are dispersed in a toluene solution, decyltriethoxysilane is put into the dispersion, toluene is evaporated away by a evaporator with application of an ultrasonic wave, and the residue is heated at 150° C. for 1 hour, and then ground to obtain surface-treated calcium carbonate particles (H) having an average particle size of 150 nm.

(I) Preparation of Calcium Carbonate Particles

A slurry of calcium carbonate particles (G) having 10% by weight of solid components is conditioned at 65° C. A fatty acid mixture containing 60% by weight of sodium oleate, 20% by weight of sodium stearate and 20% by weight of sodium palmitate is added to the slurry while the slurry is stirred by a dispersion apparatus, and the slurry is press-dehydrated after stirring. The resultant filtered cake is dried by a boxy-type dryer, and then ground to obtain surface-treated calcium carbonate particles (I) with the average particle size of 150 nm treated with a fatty acid mixture.

(J) Preparation of Calcium Sulfoaluminate Particles 470 g of 8% aqueous aluminum sulfate solution is added to 500 g of 15 wt % milk of lime at 50° C. in a 2 L stainless beaker. Then, the resultant mixture is stirred while it is heated at 50° C. for 1 hour for aging. The reaction solution is filtered under a reduced pressure by using a Buchner funnel (Nutsche funnel) to separate a mother liquor, and the residue is then dried and ground to obtain calcium sulfoaluminate particles (J) having an average particle size of 180 nm.

EXAMPLE 10

| | |
|---|---|
| linear polyester (linear polyester obtained from terephthalic acid/bisphenol A, ethylene oxide adducts/cyclohexanedimethanol: Tg = 62° C., Mn = 4,000, Mw = 35,000, acid value = 12, base value = 25) | 48 parts |
| carbon black (R330 manufactured by Cabot Corporation) | 8 parts |
| polyethylene wax (melting point: 135° C.) | 4 parts |
| calcium carbonate particles (H) | 40 parts |

The above mixture is kneaded by an extruder, and ground by a surface grinding-type grinder, particles are then classified to separate fine and coarse particles by an air classifier, and a process for obtaining particles of medium sizes is repeated three times to obtain black toner particles with the average shape factor SF1 of 128.5 and the particle size d50 of 8 μm.

EXAMPLE 11

| | |
|---|---|
| linear polyester (linear polyester obtained from terephthalic acid/bisphenol A, ethylene oxide adducts/cyclohexanedimethanol: Tg = 62° C., Mn = 4,000, Mw = 35,000, acid value = 12, base value = 25) | 74 parts |
| carbon black (R330 manufactured by Cabot Corporation) | 6 parts |
| polyethylene wax (melting point: 135° C.) | 5 parts |
| calcium carbonate particles (H) | 15 parts |

The above mixture is kneaded by an extruder, and ground by a surface grinding-type grinder, particles are then classified to separate fine and coarse particles by an air classifier, and a process for obtaining particles of medium sizes is repeated three times to obtain black toner particles with the average shape factor SF1 of 135.6 and the particle size d50 of 10.5 μm.

EXAMPLE 12

Operations are carried out in the same manner as in Example 10 except that calcium carbonate particles (I) are used instead of calcium carbonate particles (H) to obtain black toner particles with the average shape factor SF1 of 132.0 and the particle size d50 of 8 μm.

EXAMPLE 13

Operations are carried out in the same manner as in Example 10 except that particles are further subjected to a hot-air treatment to obtain black toner particles with the average shape factor SF1 of 110.6 and the particle size d50 of 8.6 μm.

EXAMPLE 14

Operations are carried out in the same manner as in Example 10 except that calcium carbonate particles (G) are used instead of calcium carbonate particles (H) to obtain black toner particles with the average shape factor SF1 of 136.0 and the particle size d50 of 9 μm.

EXAMPLE 15

| | |
|---|---|
| linear polyester (linear polyester obtained from terephthalic acid/bisphenol A, ethylene oxide adducts/cyclohexanedimethanol: Tg = 62° C., Mn = 4,000, Mw = 35,000, acid value = 12, base value = 25) | 32 parts |
| carbon black (R330 manufactured by Cabot Corporation) | 6 parts |
| polyethylene wax (melting point: 135° C.) | 4 parts |
| calcium carbonate particles (H) | 58 parts |

The above mixture is kneaded by an extruder, and ground by a surface grinding-type grinder, particles are then classified into separate fine and coarse particles by an air classifier, and a process for obtaining particles of medium sizes is repeated three times to obtain black toner particles with the average shape factor SF1 of 130.5 and the particle size d50 of 7 μm.

EXAMPLE 16

Operations are carried out in the same manner as in Example 10 except that the linear polyester is changed to a different linear polyester (linear polyester obtained from terephthalic acid/bisphenol A, ethylene oxide adducts/cyclohexanedimethanol: Tg=65° C., Mn=4,100, Mw=58,000, acid value=8, base value=15) to obtain black toner particles with the average shape factor SF1 of 138.0 and the particle size d50 of 9.5 μm.

EXAMPLE 17

Operations are carried out in the same manner as in Example 10 except that the linear polyester is changed to a different linear polyester (linear polyester obtained from terephthalic acid/bisphenol A, ethylene oxide adducts/bisphenol A, propylene oxide adducts/cyclohexanedimethanol: Tg=60° C., Mn=4,100, Mw=15,000, acid value=14, base value=30) to obtain black toner particles with the average shape factor SF1 of 125.0 and the particle size d50 of 7.5 μm.

EXAMPLE 18

Operations are carried out in the same manner as in Example 10 except that calcium sulfoaluminate particles (J) are used instead of calcium carbonate particles (H) to obtain black toner particles with the average shape factor SF1 of 134.4 and the particle size d50 of 8.5 μm.

Comparative Example 5

| | |
|---|---|
| linear polyester (linear polyester obtained from terephthalic acid/bisphenol A, ethylene oxide adducts/cyclohexanedimethanol: Tg = 62° C., Mn = 4,000, Mw = 35,000, acid value = 12, base value = 25) | 90 parts |
| carbon black (R330 manufactured by Cabot Corporation) | 6 parts |
| polyethylene wax (melting point: 135° C.) | 4 parts |

The above mixture is kneaded by an extruder, and ground by a surface grinding-type grinder, and particles are then classified into separate fine and coarse particles by an air classifier to obtain black toner particles with the average shape factor SF1 of 145.0 and the particle size d50 of 9.2 μm.

Comparative Example 6

| | |
|---|---|
| linear polyester (linear polyester obtained from terephthalic acid/bisphenol A, ethylene oxide adducts/cyclohexanedimethanol: Tg = 62° C., Mn = 4,000, Mw = 35,000, acid value = 12, base value = 25) | 85 parts |
| carbon black (R330 manufactured by Cabot Corporation) | 6 parts |
| polyethylene wax (melting point: 135° C.) | 4 parts |
| calcium carbonate particles (H) | 5 parts |

The above mixture is kneaded by an extruder, and ground by a surface grinding-type grinder, particles are then classified into separate fine and coarse particles by an air classifier, and a process for obtaining particles of medium size is repeated three times to obtain black toner particles with the average shape factor SF1 of 135.8 and the particle size d50 of 9.5 μm.

Comparative Example 7

Operations are carried out in the same manner as in Example 10 except that the linear polyester is changed to an another linear polyester (styrene-acryl obtained from styrene/butyl methacrylic acid: Tg=65° C., Mn=3,800, Mw=81,000, acid value=14, base value =30) to obtain black toner particles with the average shape factor SF1 of 139.0 and the particle size d50 of 9.5 μm.

Comparative Example 8

| | |
|---|---|
| linear polyester (linear polyester obtained from terephthalic acid/bisphenol A, ethylene oxide adducts/cyclohexanedimethanol: Tg = 62° C., Mn = 4,000, Mw = 35,000, acid value = 12, base value = 25) | 19 parts |
| carbon black (R330 manufactured by Cabot Corporation) | 8 parts |
| polyethylene wax (melting point: 135° C.) | 3 parts |
| calcium carbonate particles (H) | 70 parts |

The above mixture is kneaded by an extruder, and ground by a surface grinding-type grinder, particles are then classified into separate fine and coarse particles by an air classifier, and a process for obtaining particles of medium sizes is repeated three times to obtain black toner particles with the average shape factor SF1 of 130.5 and the particle size d50 of 6.8 μm.

<Production of Carrier>

| | |
|---|---|
| ferrite particles (average particle size: 50 μm) | 100 parts |
| toluene | 14 parts |
| styrene-methacrylate copolymer (ratio of components: 90/10, Mw = 65000) | 2 parts |
| carbon black (R330 manufactured by Cabot Corporation) | 0.2 parts |

First, the above components, except for ferrite particles, are stirred by a stirrer for 10 minutes to prepare a dispersed covering solution, and the covering solution and ferrite particles are then put in a vacuum degassing kneader, where they are stirred at 60° C. for 30 minutes, then degassed by applying heat and reducing a pressure at the same time, and dried to obtain a carrier. This carrier has a volume specific resistance value of $10^{11}$ Ωcm when an electric field of 1,000 V/cm is applied.

<Developers Constituted By Toners of Examples and Comparative Examples and Carriers Described Above>

1 part of decylsilane-treated hydrophobic titania having an average particle size of 15 nm and 0.8 parts of hydrophobic silica (RX50 manufactured by Nippon Aerosil Co., Ltd.) having an average particle size of 40 nm were blended with 100 parts of the above black toners, respectively, at a circumferential speed of 32 m/s for 10 minutes using a Henschel mixer, and coarse particles are then removed using a 45 μm mesh sieve to obtain toners. 100 parts of the carrier described above and 5 parts of the above toner are stirred at 40 rpm for 20 minutes using a V blender, and screened with a sieve having a mesh size of 177 μm to obtain a developer.

[Evaluations]

The developers constituted by the toners described in Examples and Comparative Examples described above and the carriers described above are used to make evaluations on the charge amount, transferability and fixing characteristics using modified Docu Centre 507CP manufactured by Fuji Xerox Co., Ltd. comprising charge means for charging a photosensitive member, latent image processing means for forming an electrostatic latent image on the charged photosensitive member by exposing the same to light, developing means for developing the above described electrostatic latent image using a toner, transfer-separate means for transferring a formed toner image to a recording material to separate the toner image from a latent image holding member being a toner image holding member, and fixation means for heat-fixing the transferred toner image to the recording material by a roller, and comprising, as an image forming method, a charge stage of charging a photosensitive member, a latent image processing stage of forming an electrostatic latent image on the charged photosensitive member by exposing the same to light, a developing stage of developing the above described electrostatic latent image using a toner, a transfer-separate stage of transferring a formed toner image to a recording material to separate the toner image from a latent image holding member being a toner image holding member, and a fixation stage of heat-fixing the transferred toner image to the recording material by a roller.

The absolute value of the charge amount is rated as follows.

TV≧15 μC/g . . . ○

TV<15 μC/g . . . x

For evaluation of transferability, transfer is hard-stopped at the time when the transferring stage is ended, the amount of transferred toner a is determined from measurements of the weight of the toner on the transferring material before and after removal of the toner, the amount of toner remaining on the photosensitive member b is determined in the same way, and a transfer efficiency is calculated from the following equation.

$$\text{transfer efficiency } \eta(\%)=a\times 100/(a+b)$$

The transferability is rated as follows.

η≧90% . . . ○

η<90% . . . x

For uneven distribution of the toner, 50 sheets of A4 size paper bearing 50 mm-wide and 270 mm-wide solid images are continuously passed along the entrance direction of the fixing nip, character images are then formed and fixed in areas including the solid image areas, and sensory evaluations are made on the line parts thereof.

The results are shown in Table 63.

TABLE 63

RESULTS OF EVALUATION WITH DOCU CENTRE 507CP

| | SURFACE TREATMENT | CONTENT (WT %) | TONER AVERAGE SHAPE FACTOR SF1 | $M_W/M_N$ OF BINDER RESIN | POPULATION OF CALCIUM COMPOUND PARTICLES ON SURFACE (%) | CHARGE CHARACTERISTICS (μC/G) | | | TRANSFERABILITY (TRANSFER EFFICIENCY % = TRANSFERRED AMOUNT/DEVELOPED AMOUNT) | | | | UNEVEN DISTRIBUTION OF TONER |
|---|---|---|---|---|---|---|---|---|---|---|---|---|---|
| | | | | | | TEMPERATURE AND HUMIDITY = 29° C., 90% | TEMPERATURE AND HUMIDITY = 10° C., 20% | RATE | TEMPERATURE AND HUMIDITY = 29° C., 90% | | TEMPERATURE AND HUMIDITY = 10° C., 20% | | |
| EXAMPLE 10 | DONE | 40 | 128.5 | 8.8 | 42 | 22 | 27 | ○ | 96 | ○ | 98 | ○ | NONE |
| EXAMPLE 11 | DONE | 15 | 135.5 | 8.8 | 12 | 25 | 31 | ○ | 95 | ○ | 97 | ○ | NONE |
| EXAMPLE 12 | DONE | 40 | 132.0 | 8.8 | 40 | 18 | 25 | ○ | 96 | ○ | 98 | ○ | NONE |
| EXAMPLE 13 | DONE | 40 | 110.6 | 8.8 | 32 | 21 | 26 | ○ | 97 | ○ | 99 | ○ | NONE |
| EXAMPLE 14 | NOT DONE | 40 | 136.0 | 8.8 | 50 | 17 | 23 | ○ | 93 | ○ | 96 | ○ | NONE |
| EXAMPLE 15 | DONE | 58 | 130.5 | 8.8 | 58 | 15 | 19 | ○ | 94 | ○ | 96 | ○ | NONE |
| EXAMPLE 16 | DONE | 40 | 138.0 | 14.1 | 46 | 20 | 25 | ○ | 92 | ○ | 95 | ○ | NONE |
| EXAMPLE 17 | DONE | 40 | 125.0 | 3.6 | 35 | 22 | 27 | ○ | 97 | ○ | 98 | ○ | NONE |
| EXAMPLE 18 | NOT DONE | 40 | 134.4 | 8.8 | 40 | 17 | 22 | ○ | 95 | ○ | 97 | ○ | NONE |
| COMPARATIVE EXAMPLE 5 | — | 0 | 145.0 | 8.8 | 0 | 26 | 30 | ○ | 90 | ○ | 91 | ○ | RECOGNIZABLE |
| COMPARATIVE EXAMPLE 6 | DONE | 5 | 135.8 | 8.8 | 5 | 25 | 29 | ○ | 94 | ○ | 96 | ○ | SLIGHTLY RECOGNIZABLE |
| COMPARATIVE EXAMPLE 7 | DONE | 40 | 139.0 | 21.3 | 43 | 13 | 15 | X | — | — | — | — | — |
| COMPARATIVE EXAMPLE 8 | DONE | 70 | 130.5 | 8.8 | 68 | 10 | 13 | X | — | — | — | — | — |

For the developer of a toner containing calcium compound particles of the present invention, the charge amount and transferability are both satisfactory, and uneven distribution of the toner during fixation is reduced, as shown in the results of Examples 10 to 18.

On the other hand, for the developer of a toner containing no calcium compound particles, uneven distribution of the toner occurs in the line image area as shown in the results of Comparative Example 5, resulting in unsatisfactory image quality.

In addition, for the developer having a toner in which the content of calcium compound particles is not within the predetermined range, uneven distribution of the toner occurs in the line image area as shown in the results of Comparative Example 6, the charge amount is small as shown in the results of Comparative Example 8, and fogging occurs in the non-image area, resulting in unsatisfactory image quality. This developer is observed and as a result, it is found that a large number of calcium compound particles drop off the toner. In addition, if the molecular distribution of the binder resin is not within the predetermined range, the charge amount is small, and fogging occurs in the non-image area, resulting in unsatisfactory image quality.

In addition, Examples and Comparative Examples where inorganic particles are used will be described below.

Preparation of Inorganic Particles (K) Preparation of Calcium Carbonate Particles Preparation of particles: 30% carbon dioxide is blown into 1,000 g of 15 wt % milk of lime at a rate of 2.0 L/min at a combination starting temperature of 25° C., and is allowed to undergo a reaction until the electric conductance of the suspension secondarily drops and stabilizes in a 2 L stainless beaker. The reaction solution is filtered under a reduced pressure by using a Buchner funnel (Nutsche funnel) to separate a mother liquor, and the residue is then dried and ground to obtain calcium carbonate particles.

Surface treatment: Then, the calcium carbonate particles are dispersed in a toluene solution, silicone oil is put into the dispersion, toluene is evaporated away by an evaporator with application of an ultrasonic wave, and the residue is heated at 150° C. for 1 hour, and then ground to obtain surface-treated calcium carbonate particles (K) having an average particle size of 150 nm.

(L) Preparation of Calcium Carbonate Particles

In preparation of calcium carbonate particles, "preparation of particles" is performed in the same manner as in the above described preparation of calcium carbonate particles (K), and "surface treatment" is carried out as follows.

Surface treatment: A slurry of calcium carbonate particles (G) having 10% by weight of solid components is conditioned at 65° C. A fatty acid mixture containing 60% by weight of sodium oleate, 20% by weight of sodium stearate and 20% by weight of sodium palmitate is added to the slurry while the slurry is stirred by a dispersion apparatus, and the slurry is press-dehydrated after stirring. The resultant filtered cake is dried by a boxy-type dryer, and then ground to obtain surface-treated calcium carbonate particles (L) with the average particle size of 150 nm treated with a fatty acid mixture.

(M) Preparation of Calcium Carbonate Particles

Preparation of particles: 30% carbon dioxide is blown into 1,000 g of 10 wt % milk of lime at a rate of 2.0 L/min at a combination starting temperature of 20° C., and is allowed to undergo a reaction until the electrical conductance of the suspension secondarily drops and stabilizes in a 2 L stainless beaker. The reaction solution is filtered under a reduced pressure by using a Buchner funnel (Nutsche funnel) to separate a mother liquor, and the residue is then dried and ground to obtain calcium carbonate particles. The surface treatment is carried out in the same manner as in the preparation of calcium carbonate particles (K) to obtain surface-treated calcium carbonate particles (M) having an average particle size of 70 nm.

(N) Preparation of Calcium Carbonate Particles

Preparation of particles: 30% carbon dioxide is blown into 1,000 g of 20 wt % milk of lime at a rate of 2.0 L/min at a combination starting temperature of 25° C., and is allowed to undergo a reaction until the electrical conductance of the suspension secondarily drops and stabilizes in a 2 L stainless beaker. The reaction solution is filtered under a reduced pressure by using a Buchner funnel (Nutsche funnel) to separate a mother liquor, and the residue is then dried and ground to obtain calcium carbonate particles. The surface treatment is carried out in the same manner as in the preparation of calcium carbonate particles (K) to obtain surface-treated calcium carbonate particles (N) having an average particle size of 200 nm.

(P) Preparation of Hydrous Aluminum Silicate Particles

Sodium silicate and aluminum sulfate, which are used as raw materials, are continuously mixed together while stirring so that the molar ratio of Si to Al equals 1:1. At the same time, sodium hydroxide is added to neutralize the mixture so that the reaction pH is in the range of 10 to 12, whereby a silica alumina gel is prepared. Then, using an aqueous ammonium nitrate solution in an amount such that the equivalent ratio of the aqueous ammonium nitrate solution to sodium in the gel equals 2:1, sodium is ion-exchanged for ammonium at room temperature. Then, exchanged ammonium is removed through baking at 600° C. for 2 hours. Furthermore, the residue is dry-ground to prepare a raw material powder. The raw material powder is placed in an autoclave to make the powder undergo a hydrothermal reaction at 200° C. for 1 day, and at 250° C. for 3 days so that its slurry concentration is 10 wt %. After cooling, the reaction solution is filtered under a reduced pressure by using a Buchner funnel (Nutsche funnel) to separate a mother liquor, and the residue is then dried and ground to obtain hydrous aluminum silicate particles (P) having an average particle size of 200 nm. (Q) Preparation of surface-untreated calcium carbonate particles In preparation of calcium carbonate particles, "preparation of particles" is performed in the same manner as in the above described preparation of calcium carbonate particles (K) to obtain surface-untreated calcium carbonate particles (Q) having an average particle size of 140 nm.

(R) Preparation of Calcium Carbonate Particles

Preparation of particles: 30% carbon dioxide is blown into 1,000 g of 22 wt % milk of lime at a rate of 2.0 L/min at a combination starting temperature of 28° C., and is allowed to undergo a reaction until the electrical conductance of the suspension secondarily drops and stabilizes in a 2 L stainless beaker. The reaction solution is filtered under a reduced pressure by using a Buchner funnel (Nutsche funnel) to separate a mother liquor, and the residue is then dried and ground to obtain calcium carbonate particles. The surface treatment is carried out in the same manner as in the preparation of calcium carbonate particles (K) to obtain surface-treated calcium carbonate particles (R) having an average particle size of 260 nm.

[Method for Producing Colored Particles]

(i) Method for Producing Colored Particles A

| | |
|---|---|
| styrene-n-butyl acrylate resin (Tg = 61° C., Mn = 6,000, Mw = 35,000) | 100 parts |
| carbon black (MOGUL ® L manufactured by Cabot Corporation) | 3 parts |

The above mixture is kneaded by an extruder, ground by a jet mill, and then dispersed by an air classifier to obtain a black toner A with D50=5.0 μm and SF1=148.8.

(ii) Method for Producing Colored Particles B

<Preparation of Resin Dispersion (1)>

| | |
|---|---|
| styrene | 370 parts by weight |
| n-butyl acrylate | 30 parts by weight |
| acrylic acid | 8 parts by weight |
| dodecanethiol | 24 parts by weight |
| carbon tetrabromide | 4 parts by weight |

A material obtained by mixing and dissolving together the above components is emulsification-dispersed in a solution of 6 parts by weight of non-ionic surfactant (NONIPOL 400 manufactured by Sanyo Chemical Industries, Ltd.) and 10 parts by weight of anionic surfactant (NEOGEN SC manufactured by Dai-ichikogyo Seiyaku Co., Ltd.) in 550 parts by weight of ion-exchanged water in a flask, and 50 parts by weight of ion-exchanged water having dissolved therein 4 parts by weight of ammonium persulfate is put into the resultant dispersion while stirring the dispersion slowly for 10 minutes. After gas in the flask is replaced with nitrogen, the content of the flask is stirred while the flask is heated in an oil bath until the content of the flask reaches a temperature of 70° C., and emulsification polymerization is continued for 5 hours. As a result, a resin dispersion (1) having dispersed therein resin particles with the average particle size of 155 nm, Tg of 59° C. and the weight average molecular weight Mw of 12,000 is obtained.

<Preparation of Resin Dispersion (2)>

| | |
|---|---|
| styrene | 280 parts by weight |
| n-butyl acrylate | 120 parts by weight |
| acrylic acid | 8 parts by weight |

A material obtained by mixing and dissolving together the above components is emulsification-dispersed in a solution of 6 parts by weight of non-ionic surfactant (NONIPOL 400 manufactured by Sanyo Chemical Industries, Ltd.) and 12 parts by weight of anionic surfactant (NEOGEN SC manufactured by Dai-ichikogyo Seiyaku Co., Ltd.) in 550 parts by weight of ion-exchanged water in a flask, and 50 parts by weight of ion-exchanged water having dissolved therein 3 parts by weight of ammonium persulfate is put into the resultant dispersion while stirring the dispersion slowly for 10 minutes. After gas in the flask is replaced with nitrogen, the content of the flask is stirred while the flask is heated in an oil bath until the content of the flask reaches a temperature of 70° C., and emulsification polymerization is continued for 5 hours. As a result, a resin dispersion (2) having dispersed therein resin particles with the average particle size of 105 nm, Tg of 53° C. and the weight average molecular weight Mw of 550,000 is obtained.

[Colorant Dispersion]

<Preparation of Colorant Dispersion (1)>

| | |
|---|---|
| carbon black (MOGUL ® L manufactured by Cabot Corporation) | 50 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (1) having dispersed therein colorant (carbon black) particles with the average particle size of 250 nm.

<Preparation of Colorant Dispersion (2)>

| | |
|---|---|
| Cyan pigment C.I. Pigment Blue 15:3 | 70 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (2) having dispersed therein colorant (Cyan pigment) particles with the average particle size of 250 nm.

<Preparation of Colorant Dispersion (3)>

| | |
|---|---|
| Magenta pigment C.I. Pigment Red 122 | 70 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (3) having dispersed therein colorant (Magenta pigment) particles with the average particle size of 250 nm.

<Preparations of Colorant Dispersion (4)>

| | |
|---|---|
| Yellow pigment C.I. Pigment Yellow 180 | 100 parts by weight |
| non-ionic surfactant (NONIPOL 400 manufactured by Sanyo Chemical Industries, Ltd.) | 5 parts by weight |
| ion-exchanged water | 200 parts by weight |

The above components are mixed, dissolved together, and dispersed for 10 minutes using a homogenizer (Ultra Tarax T50 manufactured by IKA Corporation) to prepare a colorant dispersion (4) having dispersed therein colorant (Yellow pigment) particles with the average particle size of 250 nm.

[Preparation of Release Agent Dispersion (1)]

| | |
|---|---|
| paraffin wax (NHPO 190 manufactured by Nippon Seiro Co., Ltd., melting point 85° C.) | 50 parts by weight |
| cationic surfactant (SANIZOL B 50 manufactured by Kao Corporation) | 5 parts by weight |

The above components are dispersed for 10 minutes using a homogenizer (Ultra Tarax T50 manufactured by IKA Corporation) in a stainless steel rounded flask, and then dispersed by a pressure discharge-type homogenizer to prepare a release agent dispersion (1) having dispersed therein release agent particles with the average particle size of 550 nm.

[Preparation of Agglomerated Particles]

| | |
|---|---|
| resin dispersion (1) | 120 parts by weight |
| resin dispersion (2) | 80 parts by weight |
| colorant dispersion (1) | 200 parts by weight |
| release agent dispersion (1) | 40 parts by weight |
| cationic surfactant (SANISOL B50 manufactured by Kao Corporation) | 1.5 parts by weight |

The above components are mixed and dispersed using a homogenizer (Ultra Tarax T50 manufactured by IKA Corporation) in a stainless steel rounded flask, and the content of the flask is stirred while it is heated to 50° C. in a heating oil bath. After the resultant dispersion is left standing at 45° C. for 20 minutes, an observation is made using an optical microscope to find that agglomerated particles with the average particle size of about 5.0 μm are formed. 60 parts by weight of resin dispersion (1) is gently added to the dispersion as a resin containing fine particle dispersion. Then, the temperature of the heating oil bath is increased to 50° C., and the mixture is left standing for 30 minutes. An observation is made using the optical microscope to find that deposit particles with the average particle size of about 5.6 μm are formed.

[Preparation of Colorant Particles B]

3 parts by weight of anionic surfactant (NEOGEN SC manufactured by Dai-ichikogyo Seiyaku Co., Ltd.) is added to the agglomerated particles described above, the stainless steel rounded flask is then sealed, and the content of the flask is heated to 105° C. while stirring using a magnetic seal, and is left standing for 4 hours. Then, after cooling, the reaction product is filtered, sufficiently washed with ion-exchanged water, and then dried to obtain electrostatic image developing colored particles B.

<Production of Colored Particles Kuro B>

The colorant dispersion (1) is used to obtain a Kuro toner with the SF1 of 128.5 and the particle size D50 of 5.8 μm by the above described methods for preparation of agglomerated particles and colored particles.

<Production of Colored Particles Cyan B>

Agglomerated particles are prepared in the same manner as in the above described method for preparation of agglomerated particles except that a colorant dispersion (2) is used instead of the colorant dispersion (1), and colored particles are prepared in the same manner as in the above described method for colored particles to obtain a Cyan toner with SF1 of 130 and the particle size D50 of 5.6 μm.

<Production of Colored Particles Magenta B>

Agglomerated particles are prepared in the same manner as in the above described method for preparation of agglomerated particles except that a colorant dispersion (3) is used instead of the colorant dispersion (1), and colored particles are prepared in the same manner as in the above described method for colored particles to obtain a Magenta toner with SF1 of 132.5 and the particle size D50 of 5.5 μm.

<Production of Colored Particles Yellow B>

Agglomerated particles are prepared in the same manner as in the above described method for preparation of agglomerated particles except that a colorant dispersion (4) is used instead of the colorant dispersion (1), and colored particles are prepared in the same manner as in the above described method for colored particles to obtain a Yellow toner with SF1 of 127 and the particle size D50 of 5.9 μm.

[Production of Carrier]

| | |
|---|---|
| ferrite particles (average particle size: 50 μm) | 100 parts |
| toluene | 14 parts |
| styrene-methyl methacrylate copolymer (ratio of components: 90/10, Mw = 75,000) | 2 parts |
| carbon black (R330 manufactured by Cabot Corporation) | 0.2 parts |

First, the above components, except for ferrite particles, are stirred by a stirrer for 10 minutes to prepare a dispersed covering solution, and the covering solution and ferrite particles are then put in a vacuum degassing kneader, where they are stirred at 60° C. for 30 minutes, then degassed by applying heat and reducing a pressure at the same time, and dried to obtain a carrier. This carrier has a volume specific resistance value of $10^{11}$ Ωcm when an electric field of 1,000 V/cm is applied.

<Production of Photosensitive Member 1>

An example of production of a photosensitive member with the surface layer having charge transformability and constituted by a siloxane based resin having a crosslinked structure.

A draw tube with the diameter of 84 mm made of JIS A3003 alloy is prepared, and the tube is polished by a centreless polishing apparatus to have a surface roughness Rz of 0.5 μm. As a cleaning stage, this cylinder is subjected to a degreasing treatment, an etching treatment with a 2 wt % sodium hydroxide solution for 1 minute, a neutralization treatment and washing with pure water, in this order. Then, as an anodic oxidization treatment stage, an anodic oxide film (current density 1.0 A/dm$^2$) is formed on the surface of the cylinder with a 10 wt % sulfuric acid solution. The cylinder is washed with water, and then dipped in a 1 wt % nickel acetate solution at 80° C. for 20 minutes to carryout a sealing treatment. Furthermore, the cylinder is washed with pure water and dried. In this way, an anodic oxide film having a thickness of 7 μm is formed on the aluminum cylinder.

On this aluminum substrate, 1 part of chlorogallium phthalocyanine having strong diffraction peaks at Bragg angles (2θ±0.2°) of 7.4°, 16.6°, 25.5° and 28.3° in the X-ray diffraction spectrum is mixed with 1 part of polyvinyl butyral (S-LEC BM-S manufactured by Sekisui Chemical Co., Ltd.) and 100 parts of n-butyl acetate, the resultant mixture is treated with a paint shaker together with a glass bead for 1 hour and thereby dispersed, and the coating solution thus obtained is then dip-coated on the above described undercoat layer, and dried by heating at 100° C. for 10 minutes to form a charge generation layer having a thickness of about 0.15 μm.

A coating solution in 20 parts of chlorobenzene of 2 parts of benzidine compound having a structure described below and 3 parts of polymer compound (viscosity average molecular weight 40,000) is coated on the charge generation layer by a dip coating method, and heated at 110° C. for 40 minutes to form a charge transport layer having a thickness of about 20 μm. This is referred as a photosensitive member 1.

[Chemical formula]

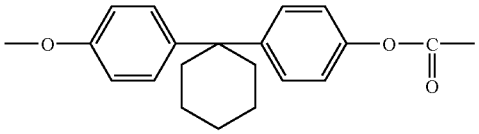

#1 Basic Unit

The constituent materials shown below are dissolved in 5 parts of isopropyl alcohol, 3 parts of tetrahydrofuran and 0.3 parts of distilled water, 0.5 parts of ion-exchange resin (amberlist 15E) are added to this solution, and the resultant mixture was hydrolyzed for 24 hours by stirring at room temperature.

| Constituent materials | |
|---|---|
| illustrative compound 261 | 2 parts |
| methyl trimethoxysilane | 2 parts |
| tetramethoxysilane | 0.5 parts |
| colloidal silica | 0.3 parts |

0.04 parts of aluminum tris-acetyl acetate and 0.1 parts of 3,5-di-butyl-4-hydroxytoluene (BHT) are added to 2 parts of solution with the ion-exchange resin filtered away from the hydrolyzed solution, and this coating solution is coated on the charge transport layer by a ring type-dip coating method, air-dried at room temperature for 30 minutes, and then cured by heating at 170° C. for 1 hour to form a surface layer having a thickness of about 3 μm.

EXAMPLE 19

0.8 parts of hydrophobic titania with the average particle size of 15 nm surface-treated with decylsilane, 1.2 parts of hydrophobic silica (RX50 manufactured by Nippon Aerosil Co., Ltd.) having an average particle size of 40 nm and 0.6 parts of calcium carbonate particles (K) are blended with 100 parts of the above colored particles B of Black, Cyan, Magenta and Yellow toners, respectively, at a circumferential speed of 32 m/s for 10 minutes using a Henschel mixer, and coarse particles are then removed using a 45 μm mesh sieve to obtain toners. 100 parts of the carrier described above and 5 parts of the above toner are stirred at 40 rpm for 20 minutes using a V blender, and screened with a sieve having a mesh size of 177 μm to obtain a developer.

EXAMPLE 20

0.8 parts of hydrophobic titania with the average particle size of 15 nm surface-treated with decylsilane, 1.2 parts of hydrophobic silica (RX50 manufactured by Nippon Aerosil Co., Ltd.) having an average particle size of 40 nm and 1.0 part of calcium carbonate particles (L) are blended with 100 parts of the above colored particles of Kuro B at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

EXAMPLE 21

0.8 parts of hydrophobic titania with the average particle size of 15 nm surface-treated with decylsilane, 1.2 parts of hydrophobic silica (RX50 manufactured by Nippon Aerosil Co., Ltd.) having an average particle size of 40 nm and 0.6 parts of calcium carbonate particles (M) are blended with 100 parts of the above colored particles of Kuro B at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

EXAMPLE 22

0.8 parts of hydrophobic titania with the average particle size of 15 nm surface-treated with decylsilane, 1.2 parts of hydrophobic silica (RX50 manufactured by Nippon Aerosil Co., Ltd.) having an average particle size of 40 nm and 1.3 parts of calcium carbonate particles (N) are blended with 100 parts of the above colored particles of Kuro B at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

EXAMPLE 23

0.9 parts of hydrophobic titania with the average particle size of 15 nm surface-treated with decylsilane, 1.3 parts of hydrophobic silica (RX50 manufactured by Nippon Aerosil Co., Ltd.) having an average particle size of 40 nm and 1.3 parts of calcium carbonate particles (K) are blended with 100 parts of the above colored particles of Kuro A at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

EXAMPLE 24

0.8 parts of hydrophobic titania with the average particle size of 15 nm surface-treated with decylsilane, 1.2 parts of hydrophobic silica with the average particle size of 40 nm surface-treated with silicone oil, and 1.0 part of calcium carbonate particles (L) are blended with 100 parts of the above colored particles of Kuro B at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

EXAMPLE 25

0.8 parts of hydrophobic titania with the average particle size of 15 nm surface-treated with decylsilane, 1.2 parts of hydrophobic silica with the average particle size of 40 nm surface-treated with silicone oil, and 0.6 parts of calcium carbonate particles (Q) are blended with 100 parts of the above colored particles of Kuro B at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

EXAMPLE 26

A toner is prepared to obtain a developer in the same manner as in Example 25 except that hydrous aluminum silicate particles are used instead of calcium carbonate particles (Q).

Comparative Example 9

A toner is prepared to obtain a developer in the same manner as in Example 20 except that calcium carbonate particles (L) are excluded. (The Mohs hardness of silica is 7, and the Mohs hardness of titania is 6.5 to 7.)

Comparative Example 10

0.8 parts of hydrophobic titania with the average particle size of 15 nm surface-treated with decylsilane, 1.2 parts of hydrophobic silica with the average particle size of 40 nm surface-treated with silicone oil, and 0.6 parts of cerium dioxide with the average particle size of 650 nm (Mohs hardness: 7) are blended with 100 parts of the above colored particles of Kuro B at a circumferential speed of 32 m/s for 10 minutes using a Henschel mixer, and coarse particles are then removed using a 45 μm mesh sieve to obtain toners. 100 parts of carrier and 5 parts of the above toner are stirred at 40 rpm for 20 minutes using a V blender, and screened with a sieve having a mesh size of 177 μm to obtain a developer.

Comparative Example 11

A toner is prepared to obtain a developer in the same manner as in Example 4 except that alumina with the average particle size of 200 nm (Mohs hardness: 9) is used instead of calcium carbonate particles (N).

[Evaluations]

The developers of Examples and Comparative Examples described above were used to carry out a long run test of 20,000 copies using modified Docu Centre Color 500 manufactured by Fuji Xerox Co., Ltd. comprising charge means for charging a latent image holding member, latent image processing means for forming an electrostatic latent image on the charged latent image holding member by exposing the same to light, developing means for developing the above described electrostatic latent image using a toner, transfer-separate means for transferring a formed toner image to a recording material to separate the toner image from a latent image holding member being a toner image holding member, and fixation means for heat-fixing the transferred toner image to the recording material by a roller, and evaluations were made on transferability, contamination of the photosensitive member and scratches. The above described photosensitive member is changed from a Docu Centre Color 500 original photosensitive member (organic photosensitive member) to the photosensitive member 1 with the surface layer constituted by a siloxane based resin having a crosslinked structure.

For the charge amount of the toner and the transfer efficiency, the results of the test in the initial stage are shown, and for the contamination and scratches of the photosensitive member, the results of observation of the photosensitive member after 20,000 copies are made are shown.

For evaluation of transferability, transfer is hard-stopped at the time when the transferring stage is ended, the amount of transferred toner a is determined from measurements of the weight of the toner on the transferring material before and after removal of the toner, the amount of toner remaining on the photosensitive member b is determined in the same way, and a transfer efficiency is calculated from the following equation.

$$\text{transfer efficiency } \eta(\%)=a\times 100/(a+b)$$

The transferability is rated as follows.

$\eta \geqq 90\%$ . . . ○

$\eta < 90\%$ . . . x

For evaluation on contamination of the photosensitive member and scratches of the photosensitive member, "no contaminated" is rated as ○ and "contaminated" is rated as x, and "no scratched" is rated as ○ and "scratched" is rated as x.

The results are shown in Table 64.

TABLE 64

RESULTS OF EVALUATION WITH DOCU CENTRE COLOR 500

| | MOHS HARDNES | CHARGE AMOUNT (−μC/G) TEMPERATURE AND HUMIDITY = 29° C., 90% RH | CHARGE AMOUNT (−μC/G) TEMPERATURE AND HUMIDITY = 10° C., 20% RH | TRANSFER EFFICIENCY (%) TEMPERATURE AND HUMIDITY = 29° C., 90% RH VALUE | TRANSFER EFFICIENCY (%) TEMPERATURE AND HUMIDITY = 29° C., 90% RH RATE | TRANSFER EFFICIENCY (%) TEMPERATURE AND HUMIDITY = 10° C., 20% RH VALUE | TRANSFER EFFICIENCY (%) TEMPERATURE AND HUMIDITY = 10° C., 20% RH RATE | CONTAMINATION OF PHOTOSENSITIVE MEMBER TEMPERATURE AND HUMIDITY = 29° C., 90% RH | CONTAMINATION OF PHOTOSENSITIVE MEMBER TEMPERATURE AND HUMIDITY = 10° C., 20% RH | SCRATCHES OF PHOTOSENSITIVE MEMBER TEMPERATURE AND HUMIDITY = 29° C., 90% RH | SCRATCHES OF PHOTOSENSITIVE MEMBER TEMPERATURE AND HUMIDITY = 10° C., 20% RH |
|---|---|---|---|---|---|---|---|---|---|---|---|
| EXAMPLE 19 | | | | | | | | | | | |
| K | 3 | 35.0 | 40.1 | 93 | ○ | 96 | ○ | ○ | ○ | ○ | ○ |
| C | 3 | 38.5 | 43.5 | 95 | ○ | 98 | ○ | ○ | ○ | ○ | ○ |
| M | 3 | 37.2 | 42.5 | 94 | ○ | 97 | ○ | ○ | ○ | ○ | ○ |
| Y | 3 | 40.1 | 46.3 | 95 | ○ | 97 | ○ | ○ | ○ | ○ | ○ |
| EXAMPLE 20 | 3 | 36.8 | 40.5 | 94 | ○ | 96 | ○ | ○ | ○ | ○ | ○ |
| EXAMPLE 21 | 3 | 36.5 | 42.1 | 92 | ○ | 95 | ○ | ○ | ○ | ○ | ○ |
| EXAMPLE 22 | 3 | 36.8 | 43.3 | 95 | ○ | 98 | ○ | ○ | ○ | ○ | ○ |
| EXAMPLE 23 | 3 | 33.4 | 38.2 | 90 | ○ | 93 | ○ | ○ | ○ | ○ | ○ |
| EXAMPLE 24 | 3 | 38.0 | 43.7 | 93 | ○ | 97 | ○ | ○ | ○ | ○ | ○ |
| EXAMPLE 25 | 3 | 31.3 | 35.6 | 93 | ○ | 97 | ○ | ○ | ○ | ○ | ○ |
| EXAMPLE 26 | 2~2.5 | 30.5 | 36.8 | 91 | ○ | 93 | ○ | ○ | ○ | ○ | ○ |
| COMPARATIVE EXAMPLE 9 | 6.5~7 | 38.9 | 45.7 | 87 | X | 93 | ○ | X | X | ○ | ○ |
| COMPARATIVE EXAMPLE 10 | 7 | 36.5 | 42.3 | 88 | X | 94 | ○ | ○ | ○ | X | X |
| COMPARATIVE EXAMPLE 11 | 9 | 32.2 | 36.8 | 90 | X | 94 | ○ | ○ | ○ | X | X |

Note:
In Table 64, K represents Black, C represents Cyan, M represents Magenta, and Y represents Yellow.

For the developer of the toner using inorganic particles of the present invention having a Mohs hardness of 2 to 4.5, satisfactory charge sustainability is shown as in the results of Examples 19 to 26, and transferability is kept at a satisfactory level even in repeated use over a long period of time. In addition, a photosensitive member is taken out after 20,000 copies are made, and the surface of the photosensitive member is observed to find that scratches/uneven abrasion and contamination are insignificant. Furthermore, in Example 20, no problems occur in the photosensitive member even after 40,000 copies are made.

On the other hand, for the developer of the toner that does not use inorganic particles having a Mohs hardness of 2 to 4.5, contamination is clearly recognized when a photosensitive member is taken out after 20,000 copies are made, and the surface of the photosensitive member is observed, as shown in the results of Comparative Examples 9 to 11. In addition, scratches/uneven abrasion are clearly recognized as shown in the results of Comparative Examples 10 and 11.

By using the dry toner for electrostatic latent image developer, the developer and the image forming method of the present invention, high image quality can be maintained over a long period of time. By using the toner composition for electrostatic latent image developer for double-sided copying, the developer and the image forming method, high image quality can be achieved on both sides when fine images are formed on both sides. Furthermore, according to the image forming method of the present invention, particularly, contamination of the latent image holding member and scratches and uneven abrasion in the latent image holding member can be prevented, thus making it possible to maintain high image quality with stability over a long period of time.

Furthermore, for the present invention, preferred or illustrative embodiments have been described, but the present invention is not limited to those embodiments, and includes every aspect included in claims of this application.

What is claimed is:

1. An electrostatic latent image developing dry toner composition that is used for forming images on both sides of a recording material, wherein said toner contains calcium compound particles, and the amount W of said calcium compound particles added and the size d of said calcium compound particles meet the requirement of $5<W/d<500$ . . . (1) (W: ratio to the total amount of toner (% by weight), d: volume average particle size (μm)).

2. The electrostatic latent image developing dry toner composition according to claim 1, wherein said toner contains a release agent.

3. The electrostatic latent image developing dry toner composition according to claim 1, wherein the size of said calcium compound particles is 5 to 70 nm.

4. The electrostatic latent image developing dry toner composition according to claim 1, wherein said calcium compound particles are calcium carbonate particles.

5. The electrostatic latent image developing dry toner composition for double-sided copying according to claim 1, wherein said calcium compound particles are surface-treated.

6. The electrostatic latent image developing dry toner composition according to claim 1, wherein said toner is a toner having an average shape factor SF1 of 100 to 140:

$$SF1=(ML^2/A)\times(\pi/4)\times 100$$

where ML is the absolute maximum length of the toner, A is the projector area of the toner, and they are determined as values by analyzing mainly a microscopic image or scanning electron microscopic image using an image analyzing apparatus.

7. The electrostatic latent image developing dry color toner composition according to claim 1, wherein said toner is a color toner.

8. An electrostatic latent image developing dry toner composition having as components at least a binder resin having a molecular distribution Mw/Mn of 3 to 15 and a colorant, wherein said toner contains 10 to 60 parts by weight of calcium compound particles based on the total amount of said toner.

9. The electrostatic latent image developing dry toner composition according to claim 8, wherein said calcium compound particles are surface-treated to impart a hydrophobic nature.

10. The electrostatic latent image developing dry toner composition according to claim 8, wherein said calcium compound particles are calcium carbonate particles.

11. A developer for electrostatic latent image development constituted by a carrier and a toner composition, wherein said carrier has on a core material a coat resin layer having a conductive material dispersed in a matrix resin, said toner composition is used for forming images on both sides of a recording material, and contains calcium compound particles, and the amount W of the calcium compound particles added and the size d of the calcium compound particles meet the requirement of $5<W/d<500$ . . . (1) (W: ratio to the total amount of toner (% by weight), d: volume average particle size (μm)).

12. An image forming method for forming an image using an image forming apparatus comprising charge means for charging an electrostatic latent image holding member, latent image processing means for forming an electrostatic latent image on the charged latent image holding member by exposing the same to light, developing means for developing said electrostatic latent image using a toner, transfer-separate means for transferring a formed toner image to a recording material to separate the toner image from the latent image holding member being a toner image holding member, and fixation means for contact heat-fixing the transferred toner image on the recording material, wherein said toner contains calcium compound particles, and the amount W of said calcium compound particles added and the size d of said calcium compound particles meet the requirement of $5<W/d<500$ . . . (1) (W: ratio to the total amount of toner (% by weight), d: volume average particle size (μm)), and the surface layer of said latent image holding member has a charge transport property, and is constituted by a siloxane based resin having a crosslinked structure.

13. The color image forming method according to claim 12, wherein said transfer-separate means develop the toner of each color on the latent image holding member, transfer the developed toner to a transferring belt or transferring drum, and then transfer the toner of each color to a transferring member at a time.

14. The color image forming method according to claim 12, wherein said fixation means are fixation means supplying substantially no release agent.

15. An image forming method for forming an image using an image forming apparatus comprising charge means for charging an electrostatic latent image holding member, latent image processing means for forming an electrostatic latent image on the charged latent image holding member by exposing the same to light, developing means for developing said electrostatic latent image using a toner, transfer-separate means for transferring a formed toner image to a recording material to separate the toner image from the latent image holding member being a toner image holding member, cleaning means for removing a toner remaining on the toner image holding member after the toner is transferred, and fixation means for contact heat-fixing the transferred toner image on the recording material, wherein said toner contains calcium compound particles, and the amount W of said calcium compound particles added and the size d of said calcium compound particles meet the requirement of $5<W/d<500$ . . . (1) (W: ratio to the total amount of toner (% by weight), d: volume average particle size (μm)), the surface layer of said latent image holding member has a charge transport property, and is constituted by a siloxane based resin having a crosslinked structure, and said cleaning means collect the residual toner on the latent image holding member using an electrostatic brush without scraping the latent image holding member.

16. A double-sided color image forming method for forming an image using a double-sided image forming apparatus comprising charge means for charging an electrostatic latent image holding member, latent image processing means for forming an electrostatic latent image on the charged latent image holding member by exposing the same to light, developing means for developing said electrostatic latent image using a toner, transfer-separate means for transferring a formed first toner image to a first face of a recording material to separate the toner image from the latent image holding member being a toner image holding member, and transferring a formed second toner image to a second face of the recording material to separate the toner image from said latent image holding member, and fixation means for contact heat-fixing the transferred first and second toner images to the first and second faces of the recording material one after another, wherein the toner for use in said image forming method contains calcium compound particles, and the amount W of said calcium compound particles added and the size d of said calcium compound particles meet the requirement of $5<W/d<500$ . . . (1) (W: ratio to the total amount of toner (% by weight), d: volume average particle size (μm)), and said transfer-separate means develop the toner of each color on said latent image holding member, transfers the toner to a transferring belt or transferring drum, and then transfers at a time the toner of each color to the first face and the second face of the recording material.

17. A double side image forming method for forming an image using a double side image forming apparatus comprising charge means for charging an electrostatic latent image holding member, latent image processing means for forming an electrostatic latent image on the charged latent image holding member by exposing the same to light, developing means for developing said electrostatic latent image using a toner, transfer-separate means for transferring a formed first toner image to a first face of a recording material to separate the toner image from the latent image holding member being a toner image holding member, and transferring a formed second toner image to a second face of the recording material to separate the toner image from said latent image holding member, cleaning means for removing a toner remaining on the toner image holding member after the toner is transferred, and fixation means for contact heat-fixing the transferred first and second toner images to the first and second faces of the recording material one after another, wherein said toner has an average shape factor SF1 of 100 to 140, at least said toner contains calcium compound particles, and the amount W of said calcium compound particles added and the size d of said calcium compound particles meet the requirement of the above formula (1), and said cleaning means collect the residual toner on the latent image holding member using an electrostatic brush without scraping the latent image holding member.

18. A double side image forming method for forming an image using a double side image forming apparatus collecting a residual toner on a latent image holding member in a developing device without scraping the latent image holding member with a blade, wherein said toner has an average shape factor SF1 of 100 to 140, at least said toner contains calcium compound particles, and the amount W of said calcium compound particles added and the size d of said calcium compound particles meet the requirement of the above formula (1).

19. A double side image forming method for forming an image using a double side image forming apparatus comprising charge means for charging an electrostatic latent image holding member, latent image processing means for forming an electrostatic latent image on the charged latent image holding member by exposing the same to light, developing means for developing said electrostatic latent image using a toner, transfer-separate means for transferring a formed first toner image to a first face of a recording material to separate the toner image from the latent image holding member being a toner image holding member, and transferring a formed second toner image to a second face of the recording material to separate the toner image from said latent image holding member, cleaning means for removing a toner remaining on the toner image holding member after the toner is transferred, and fixation means for contact heat-fixing the transferred first and second toner images to the first and second faces of the recording material one after another, wherein said fixation means are fixation means supplying no release agent, and said toner has an average shape factor SF1 of 100 to 140, at least said toner contains calcium compound particles, and the amount W of said calcium compound particles added and the size d of said calcium compound particles meet the requirement of the above formula (1).

* * * * *